United States Patent [19]

Ishiguro et al.

[11] Patent Number: 4,864,350

[45] Date of Patent: Sep. 5, 1989

[54] COPYING APPARATUS HAVING A SORTING UNIT AND A BINDING UNIT AND CONTROLS THEREFOR

[75] Inventors: Kuniaki Ishiguro; Takuma Ishikawa, both of Toyokawa, Japan

[73] Assignee: Minolta Camera Kabushiki Kaisha, Osaka, Japan

[21] Appl. No.: 82,690

[22] Filed: Aug. 7, 1987

[30] Foreign Application Priority Data

| | | | |
|---|---|---|---|
| Aug. 7, 1986 | [JP] | Japan | 61-187346 |
| Aug. 7, 1986 | [JP] | Japan | 61-187347 |
| Aug. 7, 1986 | [JP] | Japan | 61-187348 |
| Aug. 7, 1986 | [JP] | Japan | 61-187349 |
| Aug. 7, 1986 | [JP] | Japan | 61-187350 |
| Aug. 7, 1986 | [JP] | Japan | 61-187351 |
| Aug. 7, 1986 | [JP] | Japan | 61-187352 |
| Aug. 8, 1986 | [JP] | Japan | 61-187325 |
| Aug. 8, 1986 | [JP] | Japan | 61-187326 |
| Aug. 21, 1986 | [JP] | Japan | 61-196446 |
| Aug. 22, 1986 | [JP] | Japan | 61-197732 |
| Sep. 17, 1986 | [JP] | Japan | 61-220524 |
| Sep. 17, 1986 | [JP] | Japan | 61-220525 |
| Nov. 27, 1986 | [JP] | Japan | 61-285051 |
| Nov. 27, 1986 | [JP] | Japan | 61-285060 |
| Nov. 27, 1986 | [JP] | Japan | 61-184546 |
| Dec. 27, 1986 | [JP] | Japan | 61-313250 |

[51] Int. Cl.[4] ..... G03G 15/00

[52] U.S. Cl. ..... 355/311; 355/313; 355/314; 355/323; 355/324

[58] Field of Search ..... 355/14 SH, 3 H, 3 R; 271/288, 290; 270/52, 53, 58

[56] References Cited

U.S. PATENT DOCUMENTS

| | | | |
|---|---|---|---|
| 3,709,595 | 1/1973 | Turner et al. | 355/3 R |
| 3,944,207 | 3/1976 | Bains . | |
| 4,073,391 | 2/1978 | O'Brien et al. | 271/221 X |
| 4,076,408 | 2/1978 | Reid et al. | 355/14 SH |
| 4,134,672 | 1/1979 | Burlew et al. | 355/14 SH |
| 4,145,037 | 3/1979 | Mol | 270/58 |
| 4,203,587 | 5/1980 | Kishi et al. | 271/293 |
| 4,227,275 | 10/1980 | Söderberg | 271/210 X |
| 4,238,066 | 12/1980 | Brooke | 271/272 X |
| 4,248,413 | 2/1981 | Fox | 270/53 |

(List continued on next page.)

FOREIGN PATENT DOCUMENTS

| | | |
|---|---|---|
| 99250 | 1/1984 | European Pat. Off. . |
| 5772537 | 7/1979 | Japan . |
| 61261096 | 6/1981 | Japan . |
| 5943756 | 8/1981 | Japan . |
| 67-72537 | 5/1982 | Japan . |
| 57-131667 | 8/1982 | Japan . |
| 60-248563 | 12/1985 | Japan . |
| 60-183461 | 3/1986 | Japan . |
| 0072569 | 4/1986 | Japan . |
| 61-145069 | 7/1986 | Japan . |
| 2185465 | 7/1987 | United Kingdom . |

OTHER PUBLICATIONS

IBM Technical Bulletin, vol. 18, No. 9, 2/76.

*Primary Examiner*—R. L. Moses

*Attorney, Agent, or Firm*—Burns, Doane, Swecker & Mathis

[57] ABSTRACT

A copying apparatus having an image forming unit, a sorting unit capable of distributing sheets carrying the images formed thereon and a binding unit for binding the distributed sheets are provided. The sorting unit is set to a sorting mode when a binding mode is selected. Further, a copying apparatus having controls for inhibiting the operation of the binding unit so that the operation of the binding unit can be inhibited in the cases where the size of the sheet is not in conformity to the allowable size and where the number of sorted sheets is beyond the number acceptable from the capacity of the binding unit or the number of sorted sheets is only "1". The operation of the binding unit is inhibited where there are any sheets left in the binding unit or staples are found to be absent before starting the operation of the binding unit. The sorting unit is capable of starting the distribution of the sheets from the bottom bin when the binding mode is selected and from the top bin when the non-binding mode is selected.

25 Claims, 40 Drawing Sheets

U.S. PATENT DOCUMENTS

| | | | |
|---|---|---|---|
| 4,248,525 | 2/1981 | Sterrett | 355/14 SH |
| 4,281,920 | 8/1981 | Cross | 355/75 |
| 4,295,733 | 10/1981 | Janssen et al. | 355/14 SH |
| 4,313,670 | 2/1982 | Caldwell | 355/3 R |
| 4,361,393 | 11/1982 | Noto | 270/53 |
| 4,368,972 | 1/1983 | Naramore | 355/3 SH |
| 4,371,155 | 2/1983 | Asterö et al. | 270/53 |
| 4,376,529 | 3/1983 | George et al. | 355/14 SH |
| 4,385,827 | 5/1983 | Naramore | 355/14 SH |
| 4,411,515 | 10/1983 | Kukucka | 355/14 SH |
| 4,424,963 | 1/1984 | Bartholet et al. | 270/53 |
| 4,497,478 | 2/1985 | Reschenhofer et al. | 355/3 SH |
| 4,515,458 | 5/1985 | Masuda et al. | 355/3 R |
| 4,549,804 | 10/1985 | Braun et al. | 355/14 SH |
| 4,564,185 | 1/1986 | Hamlin et al. | 270/53 |
| 4,566,782 | 1/1986 | Britt et al. | 355/14 SH |
| 4,582,421 | 4/1986 | Hamlin et al. | 355/14 SH |
| 4,674,732 | 6/1987 | Hori | 270/53 |
| 4,687,191 | 8/1987 | Stemmle | 270/53 |
| 4,721,821 | 1/1988 | Ito et al. | 355/14 SH |

COPYING APPARATUS HAVING A SORTING UNIT AND A BINDING UNIT AND CONTROLS THEREFOR

BACKGROUND OF THE INVENTION

1. Field of the Invention

The present invention relates to a copying apparatus, more particularly, comprising a sheet distributor and a sheet binder so that the sheets carrying the images transcribed by the copying machine can be distributed and bound accordingly after being ejected from the copying machine.

2. Description of Related Art

Recently, responding to the increasing demand for automatic paper handling systems for copying machines, optional systems such as automatic document feeding systems and sorting systems designed for sorting or grouping duplicate sheets have been developed and commercialized in various types one after another. The users of the copying machines are now requiring the sorter-finisher system capable of automatically binding and stacking the duplicate sheets which have been distributed and stocked in the sorting system, and this type sorter-finisher system has already been commercialized for some of large-sized copying machines.

For example, those publicized in U.S. Pat. No. 4,549,804, issued Oct. 29, 1985 to Braun et al., U.S. Pat. No. 4,248,525, issued Feb. 3, 1981 to Sterret, U.S. Pat. No. 4,361,393, issued Nov. 30, 1982 to Noto, are known as sorter-finisher systems falling under said category. However, all such sorter-finisher systems have their finishers designed for the installation on the side of the sorter. Besides, such sorter-finisher systems are not applicable to the small-sized copying machines designed for the general users, because even the sorter alone is too large both in size and installation area. Especially, the kind of system wherein the sheets distributed among and stocked in the bins have to be taken out by an oscillating arm with sheet holder and transferred to the binder by the feeder is not only too complex mechanically but also too large in size.

Furthermore, there are other problems concerning this kind of sorter-finisher system. It has been pointed out that the binding unit is unable to bind a bunch of sheets completely when the bunch consists of a number of sheets exceeding the allowable number even when the apparatus is operated in the binding mode.

Also, the conventional sorter is designed to distribute the sheets among the bins one by one starting from the top bin for the convenience of the machine operator in taking out the sheets from the bins. In the case where the binding unit has to be installed below the sorting unit, however, the bunches of the sorted sheets will have to be transferred to the binding unit one by one starting from the one distributed to the bottom bin. Thus, when the sheets are distributed first to the top bin and downwards from that point on, even the bins not containing the sheets have to be shifted to the sheet takeout position leading to the binding unit, and this creates a problem and a considerable waste of time in binding operation.

SUMMARY OF THE INVENTION

An object of the present invention is to provide a copying apparatus capable of automatically selecting the automatic mode for the sorting means out of its operation mode when the binding mode for binding the sorted sheets is selected.

A further object of the present invention is to provide a copying apparatus capable of inhibiting the selection of the binding mode when the grouping mode is selected as one of the operation modes of the sorting means.

A further object of the present invention is to provide a copying apparatus with means for indicating that the binding means is in operation.

A further object of the present invention is to provide a copying apparatus capable of inhibiting the binding operation of the apparatus when the size of the sheet selected for the forming of the image is out of the specified sizes which are not applicable to the binding means.

A further object of the present invention is to provide a copying apparatus capable of discontinuing the forming operation or cancelling the binding mode when the number of the sorted sheets has exceeded a specified number, for example, the number allowable for the binding means while the copying apparatus is operated in the binding mode.

A further object of the present invention is to provide a copying apparatus capable of inhibiting the binding means from operating depending on the number of sorted sheets.

A further object of the present invention is to provide a copying apparatus capable of discontinuing the binding operation when the preset number of times of binding action has been reached.

A further object of the present invention is to provide a copying apparatus which is provided with an input means for enabling the binding operation to be discontinued at any time.

A further object of the present invention is to provide a copying apparatus capable of distributing the sheets among the bins in upward order starting from the bottom bin when the apparatus is in the binding mode, whereas the same is done in downward order starting from the top bin when the apparatus is in operation in the non-binding mode.

A further object of the present invention is to provide a copying apparatus capable of inhibiting the binding means and the transport means for transporting the sheets to the binding means from starting when the leftover sheets in the binding means are detected.

A further object of the present invention is to provide a copying apparatus capable of inhibiting the image forming operation when the sheets are still left in the bins of the sorting means.

A further object of the present invention is to provide a copying apparatus capable of inhibiting the operation of the binding means unless the stapler is set to a specified position.

A further object of the present invention is to provide a copying apparatus capable of inhibiting the operation of the binding means or that of means for ejecting the sheets from the binding means to a stacking means when the emptiness of the staples is detected.

In order to accomplish the foregoing objects, a copying apparatus according to the present invention comprises means for forming the image on the sheet, means for distributing the sheets carrying the images formed thereon selectively in either a sorting mode or a non-sorting mode, means for binding the sheets which have been sorted by said sorting means, a first means for selecting the operation mode of said sorting means, a second means for selecting either a binding mode using said binding means or a non-binding mode and a control means for enabling the sorting means to select the sorting mode, regardless of the selection made by the first selecting means, when the binding mode is selected by the second selecting means. The control means is capable of inhibiting the selection of the binding mode by the second selecting means when the grouping mode has been selected by the first selecting means. Further, the copying apparatus according to the present invention is provided with means for determining a size of the sheet forming the images thereon so as to be able to inhibit the operation of the binding means when the size of the sheet is other than that which can be processed by the binding means. Further, the copying apparatus according to the present invention is provided with means for indicating the size of the sheet that is unable to be processed by the binding means and a control means capable of selecting the non-binding mode when the instruction for starting the image forming operation is inputted while the indicating means is still on.

Further, the copying apparatus according to the present invention is provided with means for counting the number of sheets which have been sorted by the sorting means and a control means capable of discontinuing the operation of the copying apparatus or cancelling the binding mode when the number of the sorted sheets has reached the specified number while the copying apparatus is in operation in the binding mode. Further, the copying apparatus according to the present invention is provided with means for setting the number of times of the binding action and a control means for stopping the binding operation when the number of times of binding action has reached the preset number. Further, the copying apparatus according to the present invention is provided with means for inputting the instruction for discontinuing the binding operation and a control means for stopping the operation of the binding means after completing the binding operation for the sheets which has been in progress at the time of the input of the instruction for the discontinuance of the binding operation.

Further, the copying apparatus according to the present invention has a control means that is capable of controlling the sorting means so that the sorting means distributes the sheets to the bins in upward order starting from the bottom bin when the apparatus is in operation in the binding mode, whereas the same is done in downward order starting rom the top bin when the apparatus is in operation in the non-binding mode.

Further, the copying apparatus according to the present invention is provided with means for transporting the sheets sorted among the bins to the binding means, means for detecting the sheets present in the binding means and means for inhibiting the binding means from starting its operation while the detecting means is in operation. This copying apparatus is also provided with means for inhibiting the image forming operation when the presence of the sheets in said bins is detected while the apparatus is in the binding mode.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 is a schematic block diagram showing a copying machine and sorter-finisher system;

FIG. 2 is a internal composition of the sorter-finisher system;

FIG. 3 is a vertical cross-sectional view of sorting unit;

FIG. 4 is a horizontal cross-sectional view of the feed roller section of sorting unit;

FIG. 5 is a perspective view of conveyance unit;

FIG. 6 is an explanatory drawing of floating cam and fixed cam;

FIG. 7 is an explanatory drawing of floating cam;

FIG. 8 is a perspective view of the sheet takeout position;

FIG. 9 is a plan view showing the mechanical relationship of the trunnion and fixed cam;

FIG. 10 is a vertical cross-sectional view showing the rotary detector of fixed cam;

FIG. 11 is a plan view of stapler;

FIG. 12 is an perspective view of stack tray;

FIG. 13 is a perspective view showing another example of stack tray;

FIG. 14 is a plan view showing an operation panel of the copying machine;

FIG. 15 is a plan view showing an operation panel of the ADF;

FIG. 16 is a plan view showing an operation panel of the sorter;

FIG. 17 is a block diagram showing a control circuit;

FIG. 18 is details of the control circuit;

FIG. 19 is a flow chart showing a main routine of the CPU;

Figure 21:
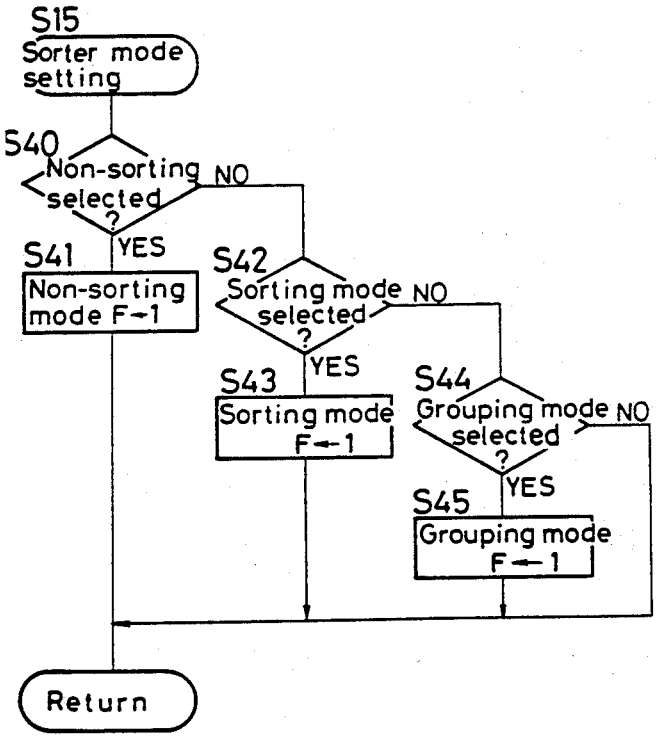
Figure 22:
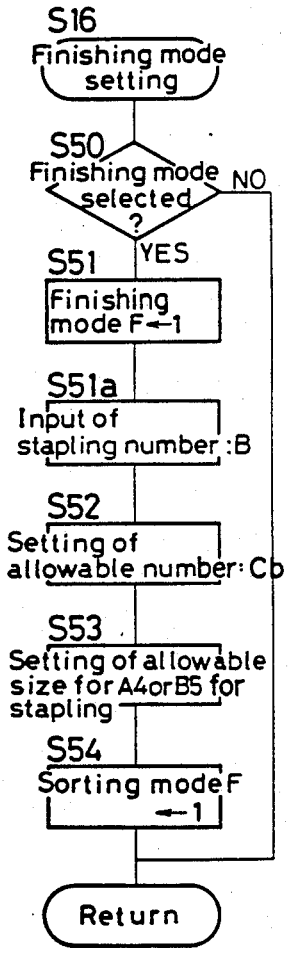
Figure 24:
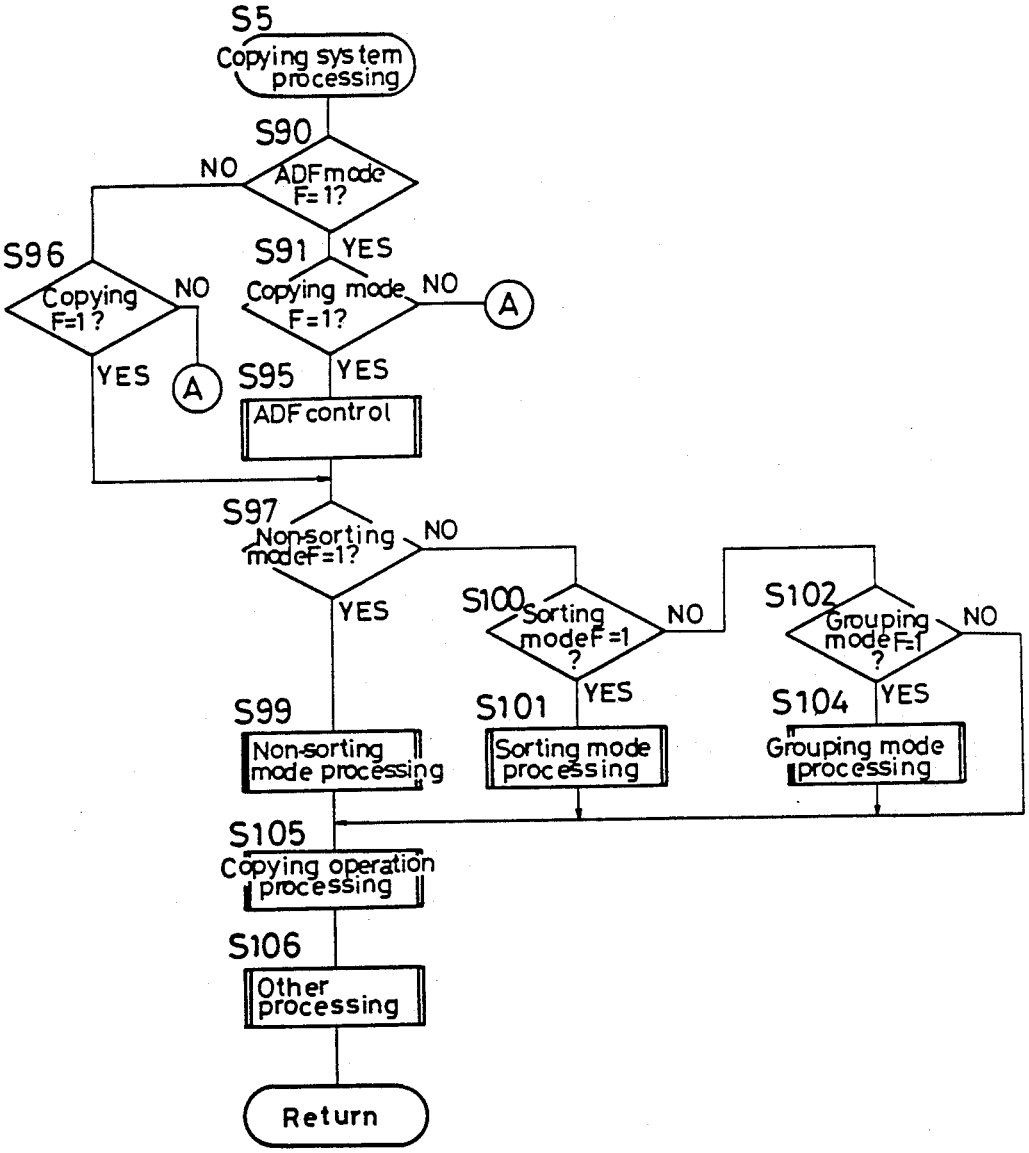
Figure 25:
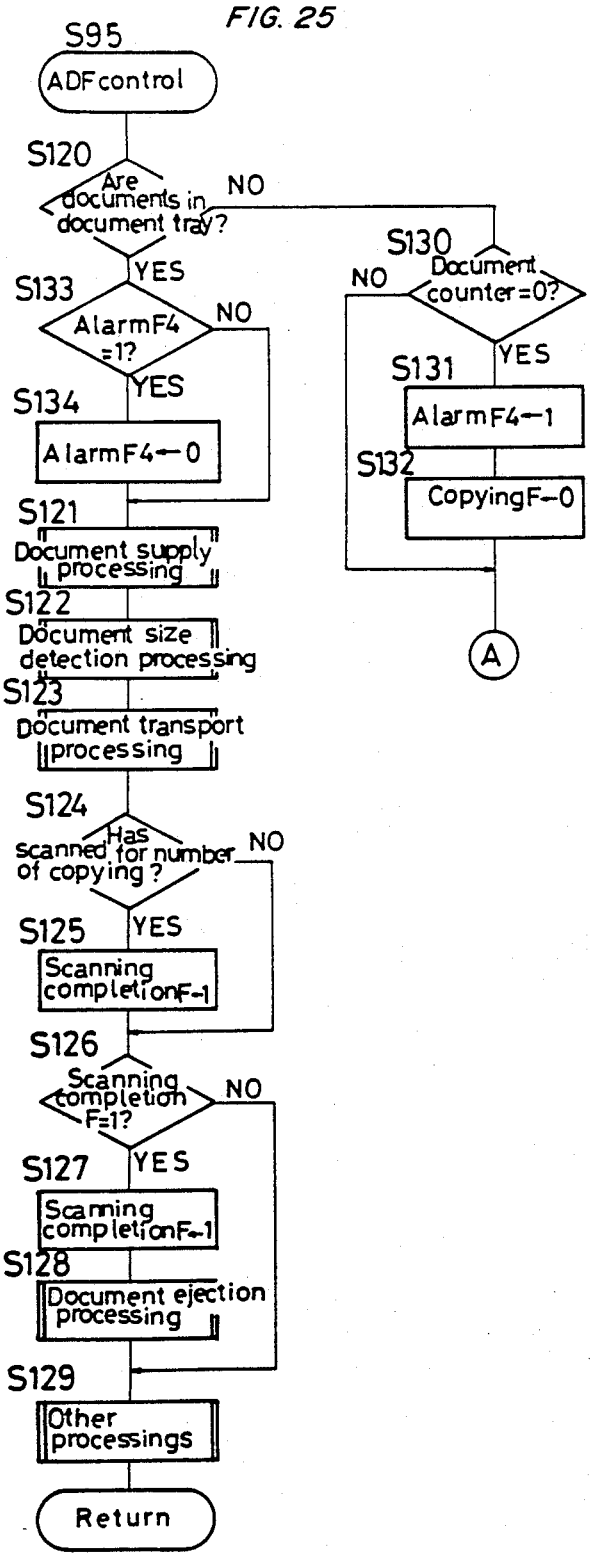
Figure 27:
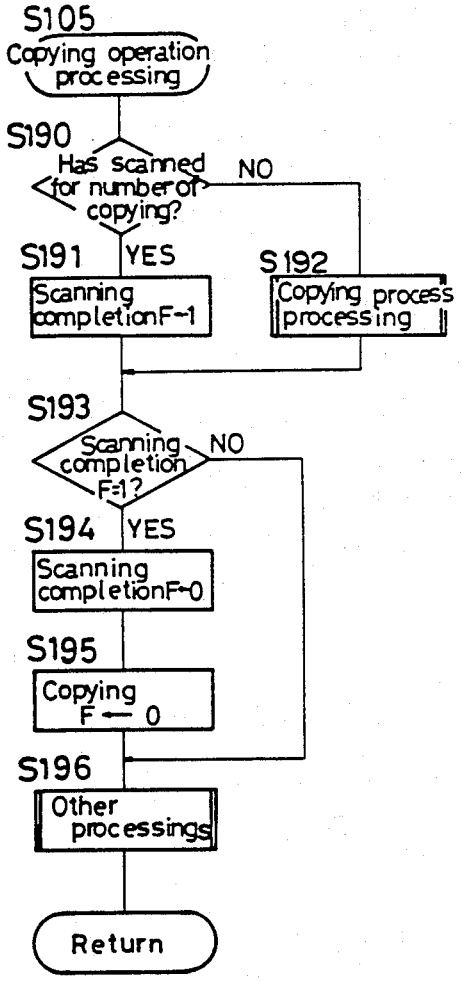
Figure 29:
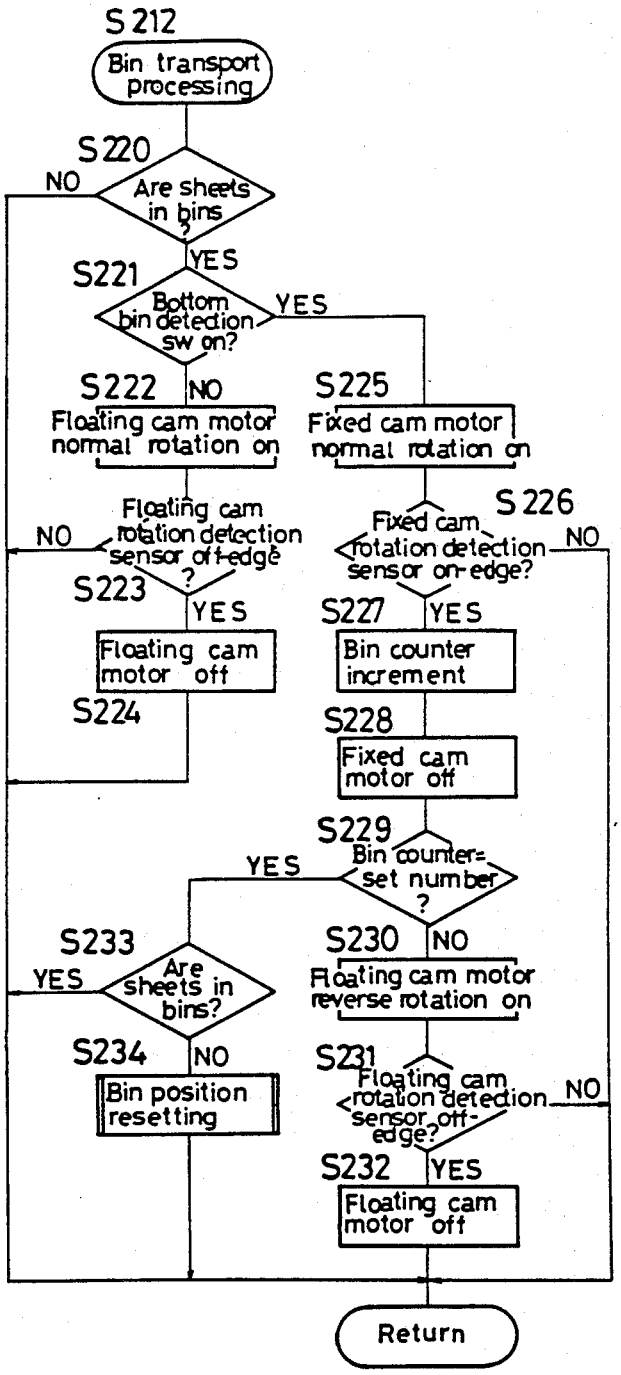
Figure 30:
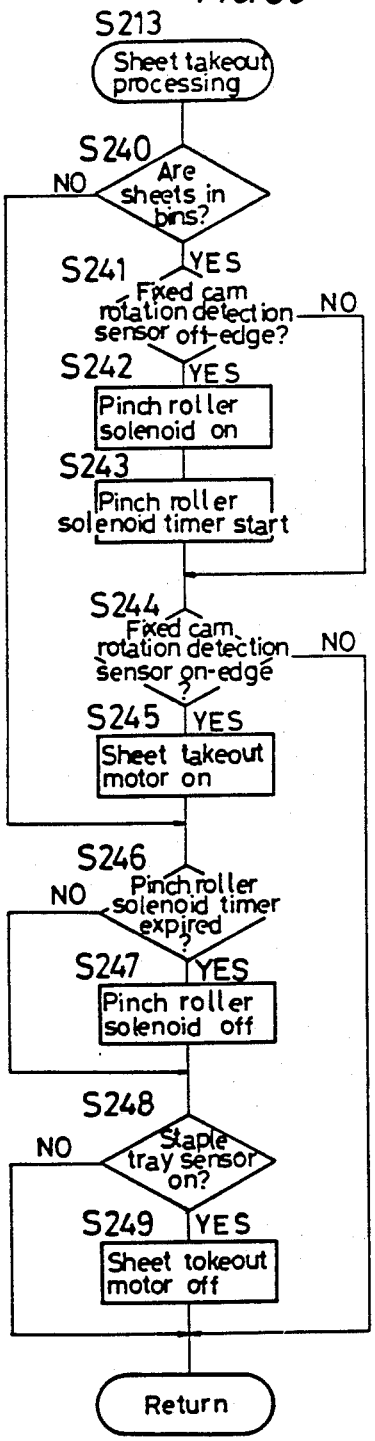
Figure 31:
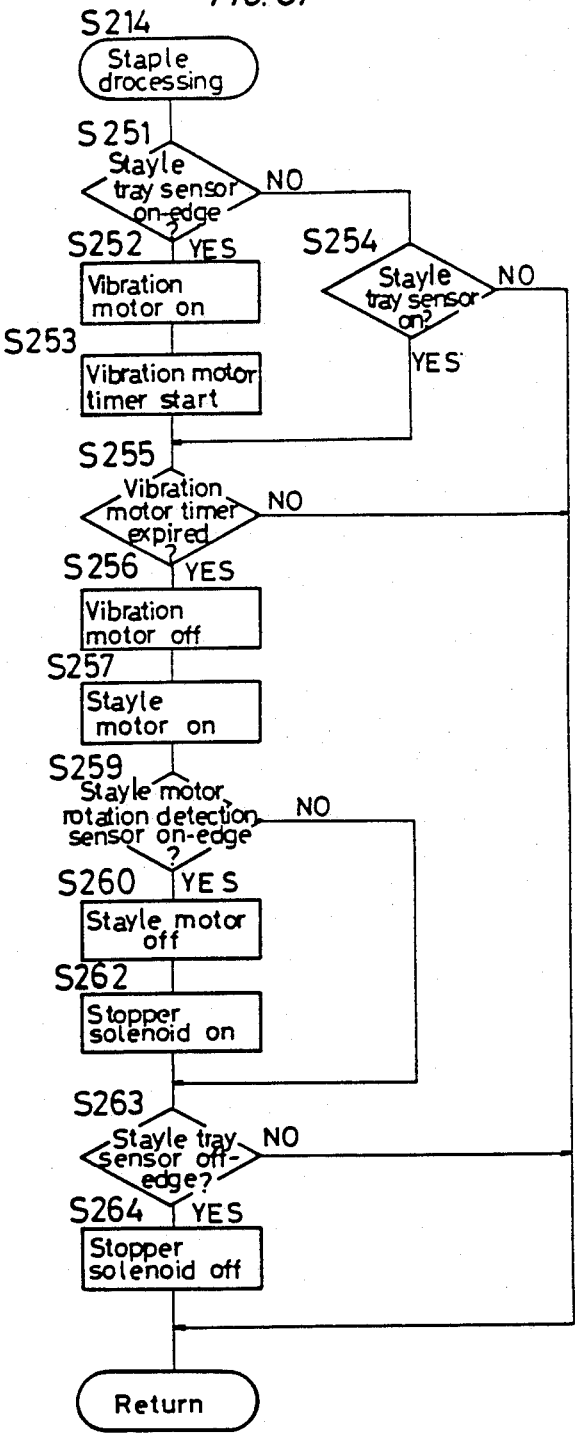
Figure 33:
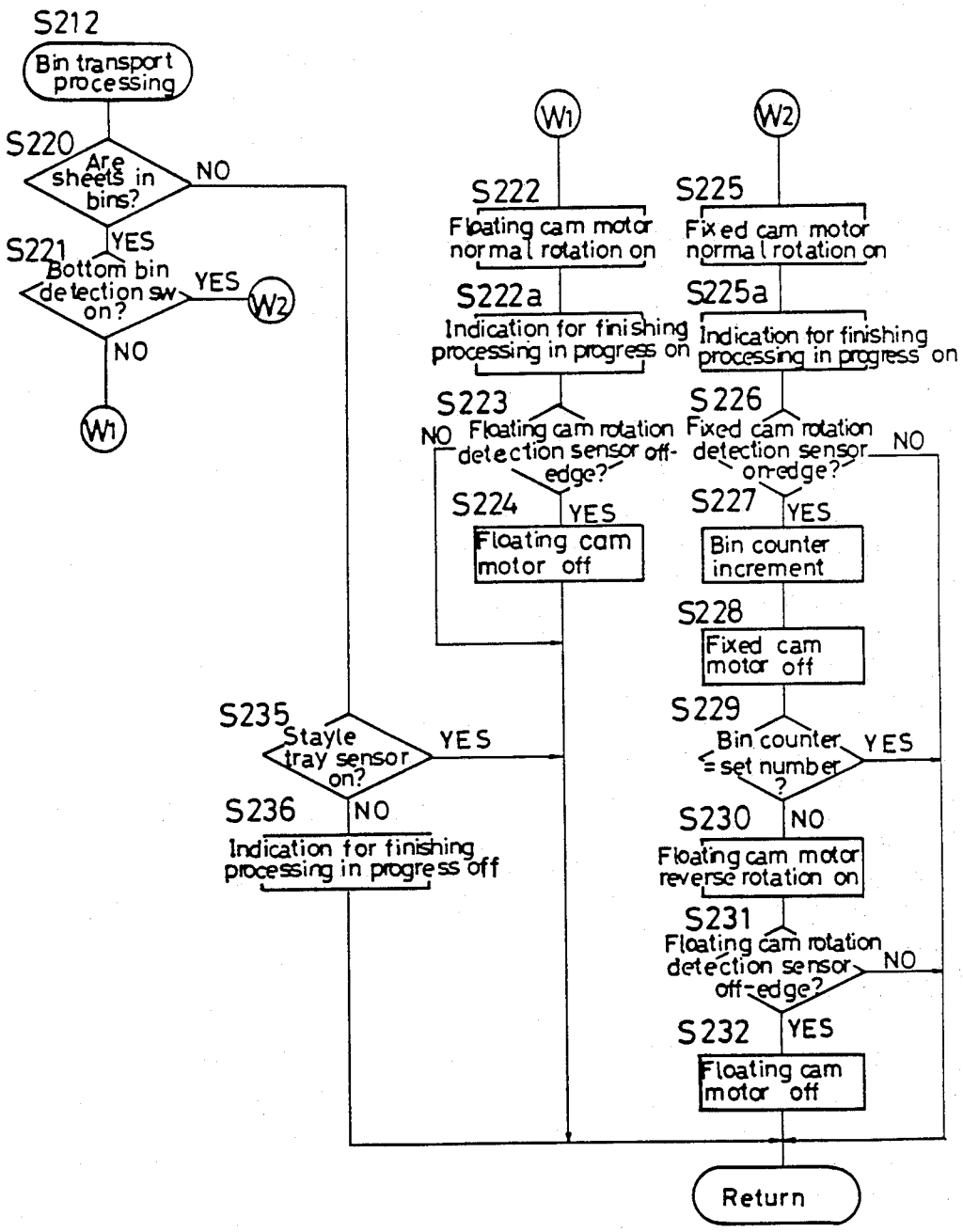
Figure 34:
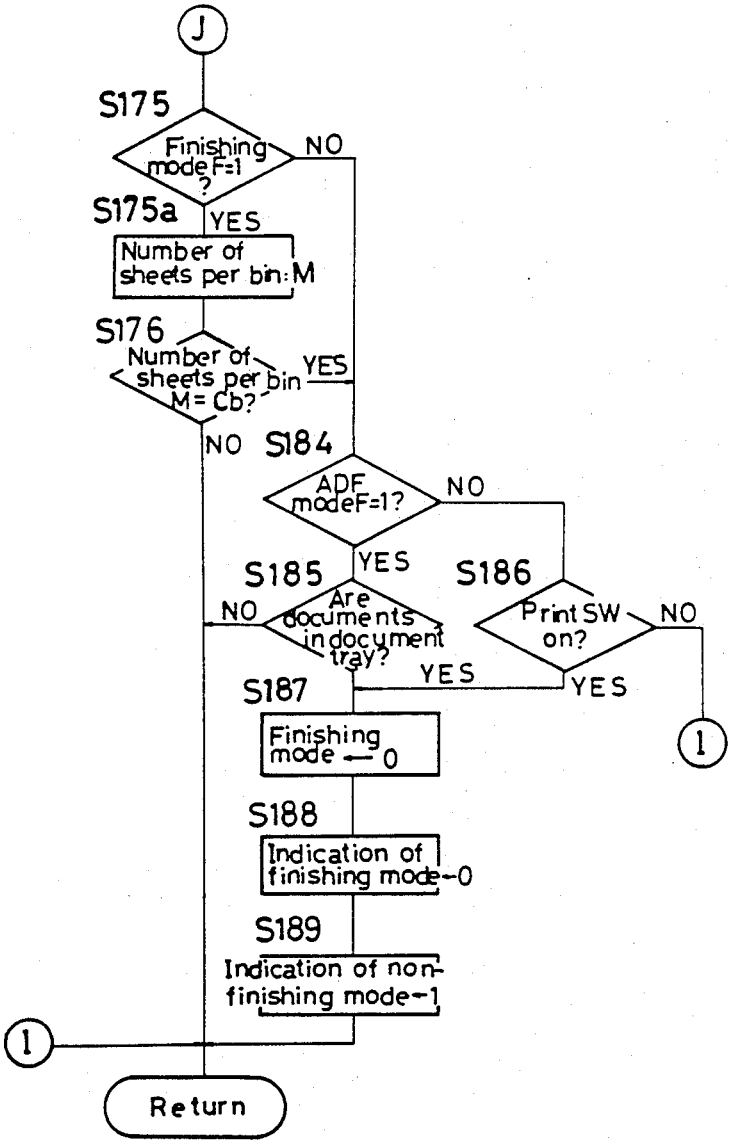
Figure 35:
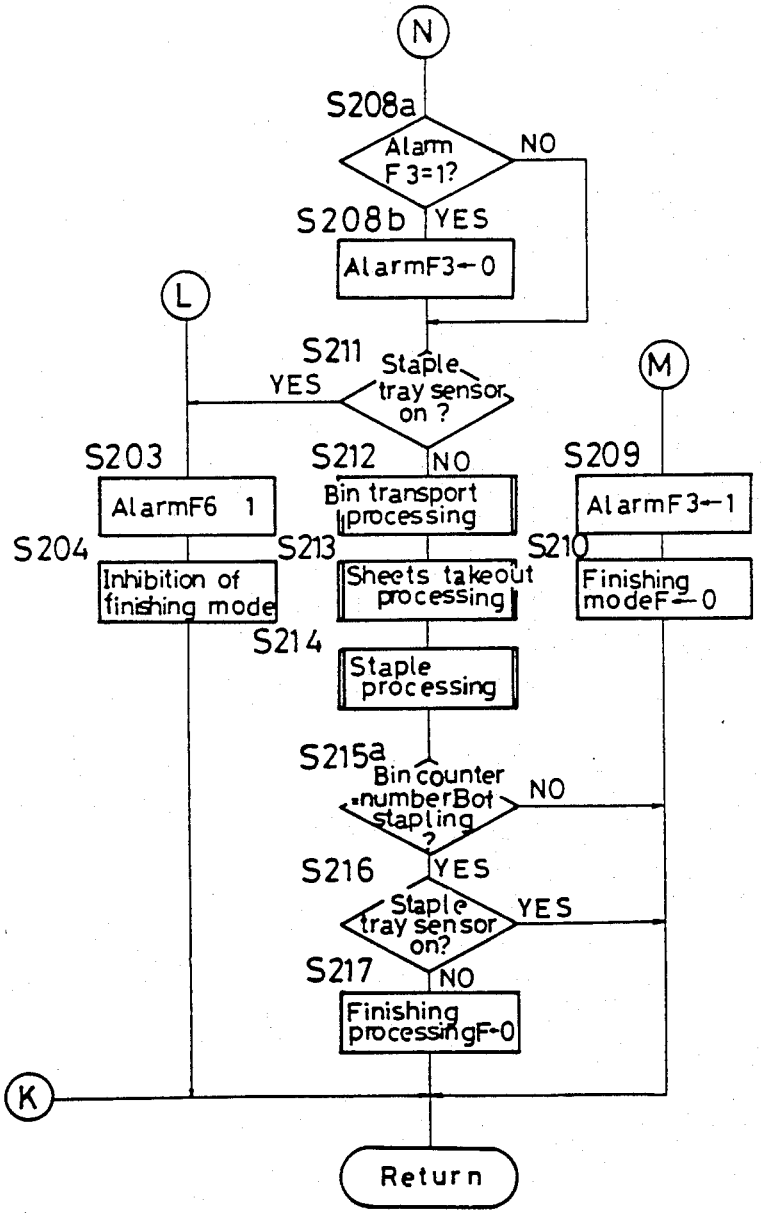
Figure 36:
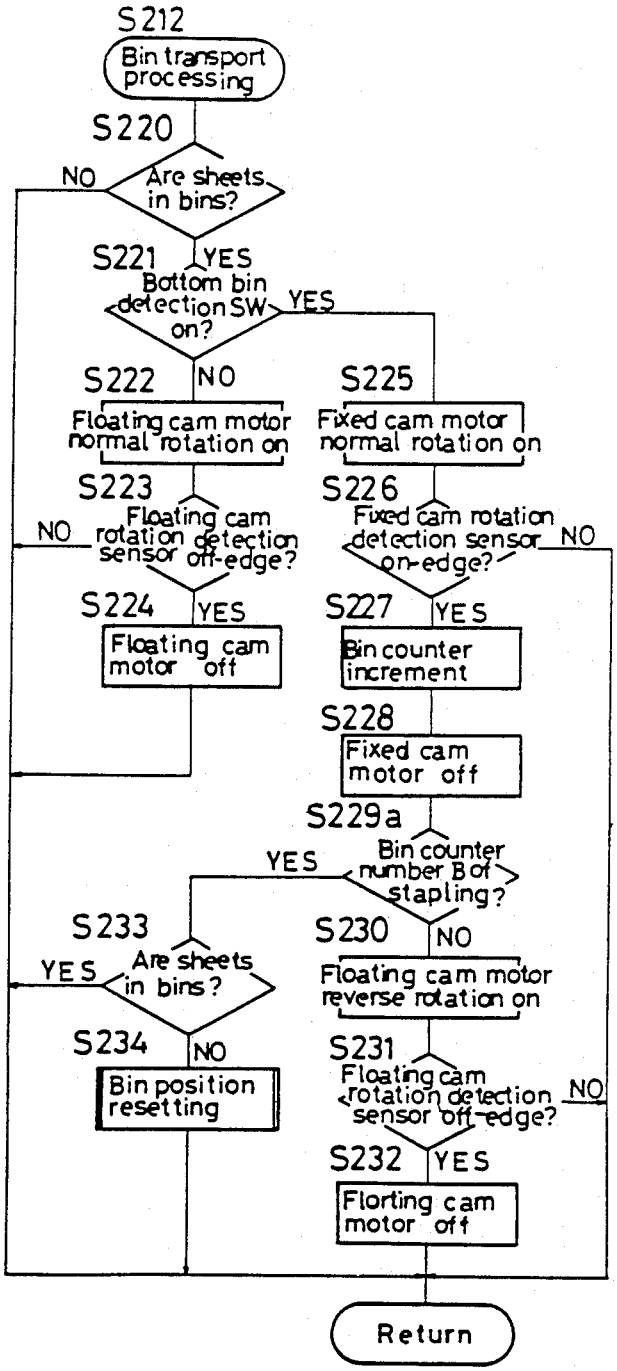
Figure 37:
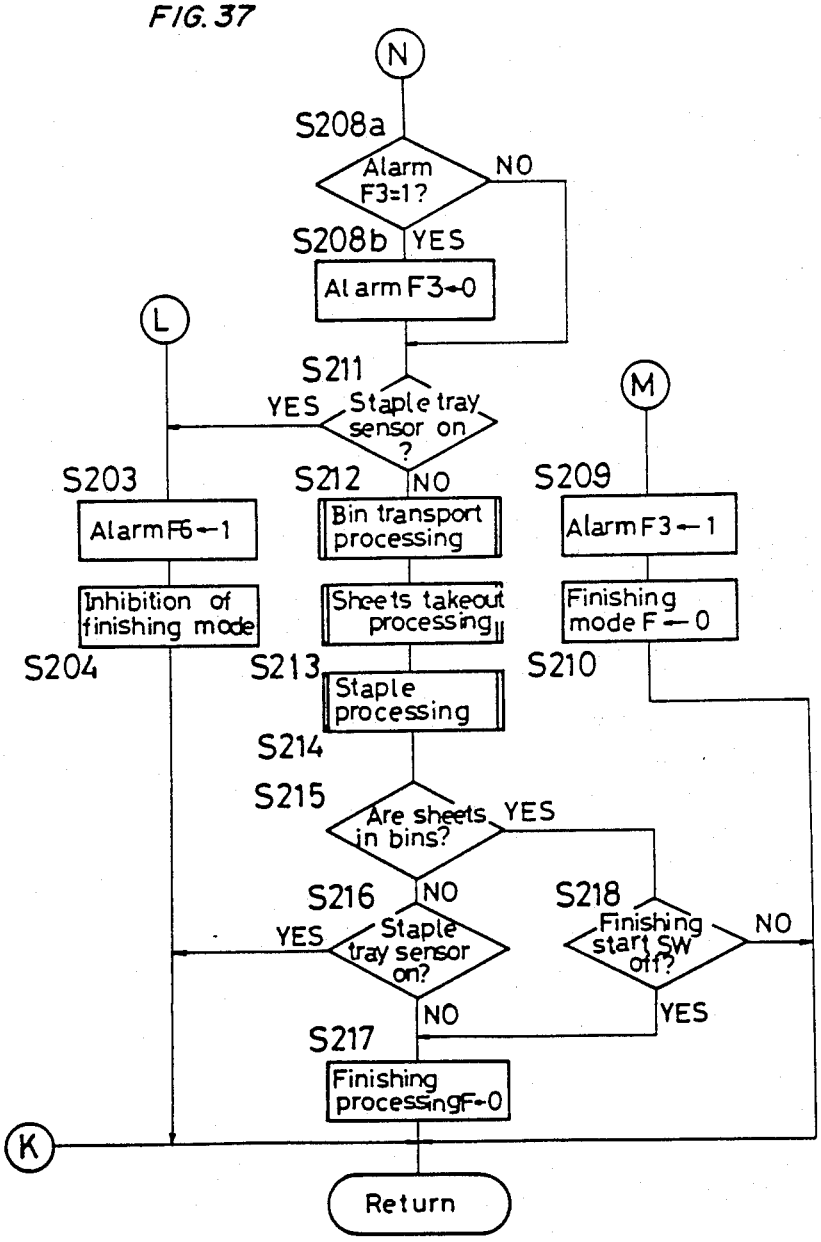
Figure 38:
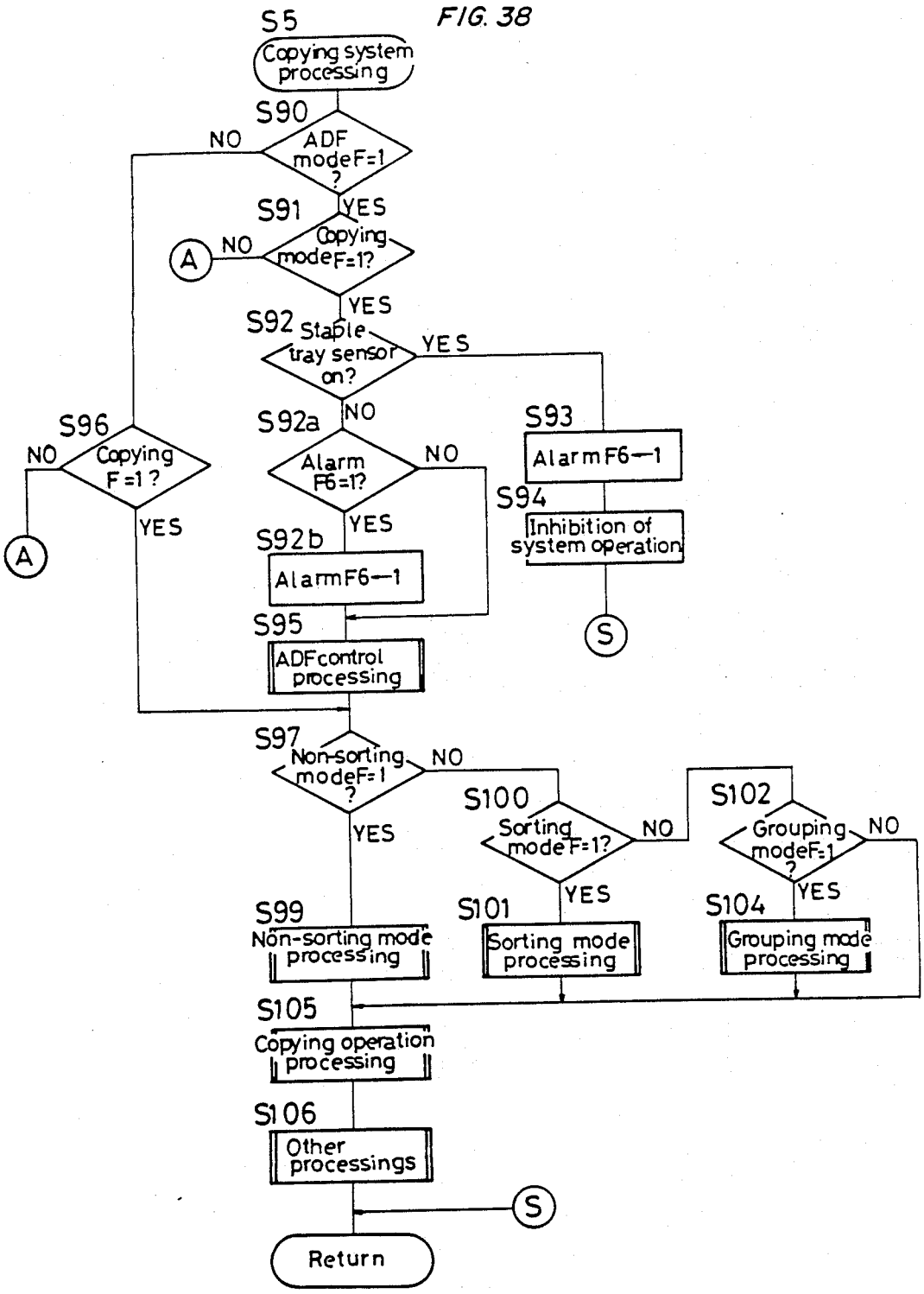
Figure 39A:
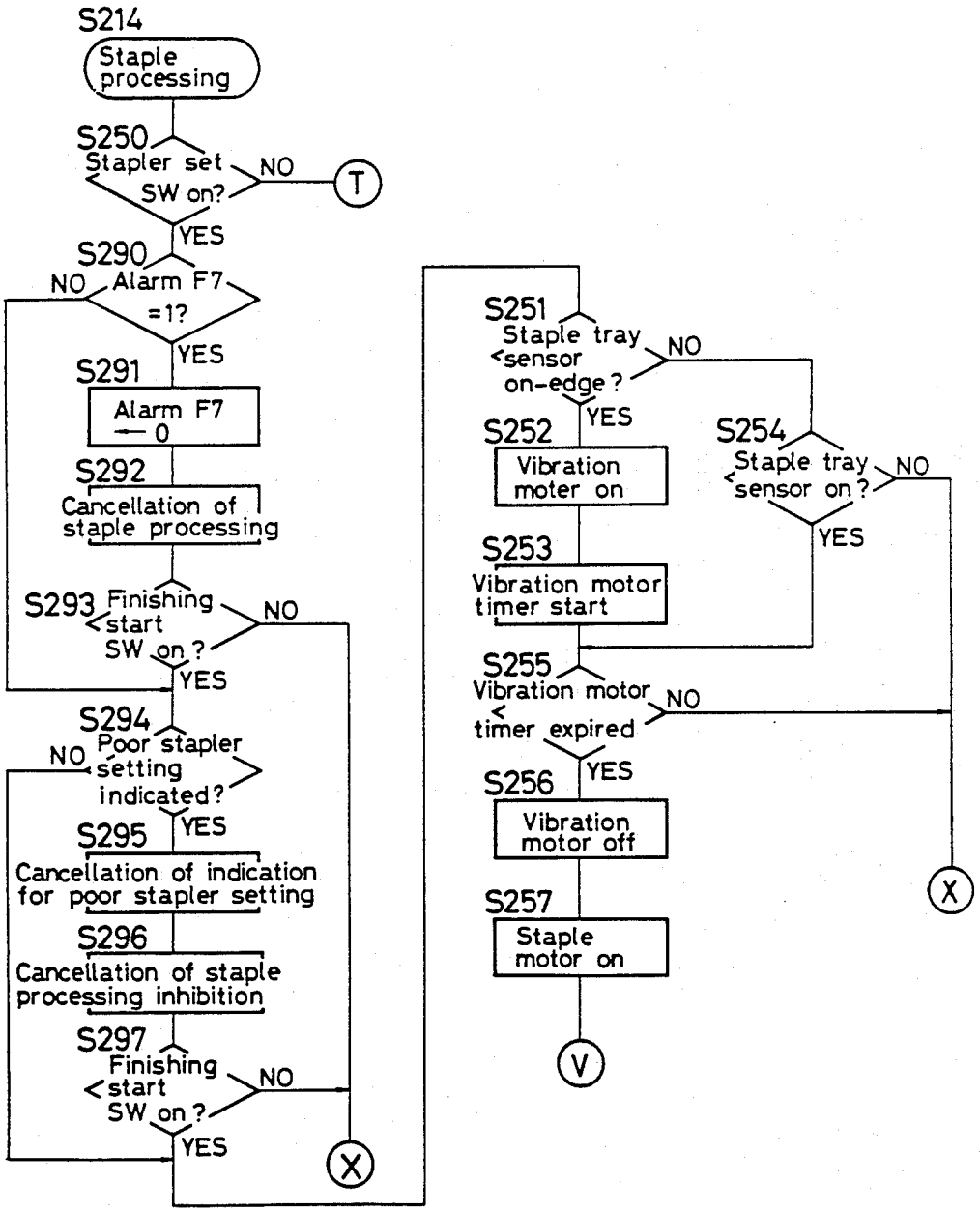
Figure 39B:
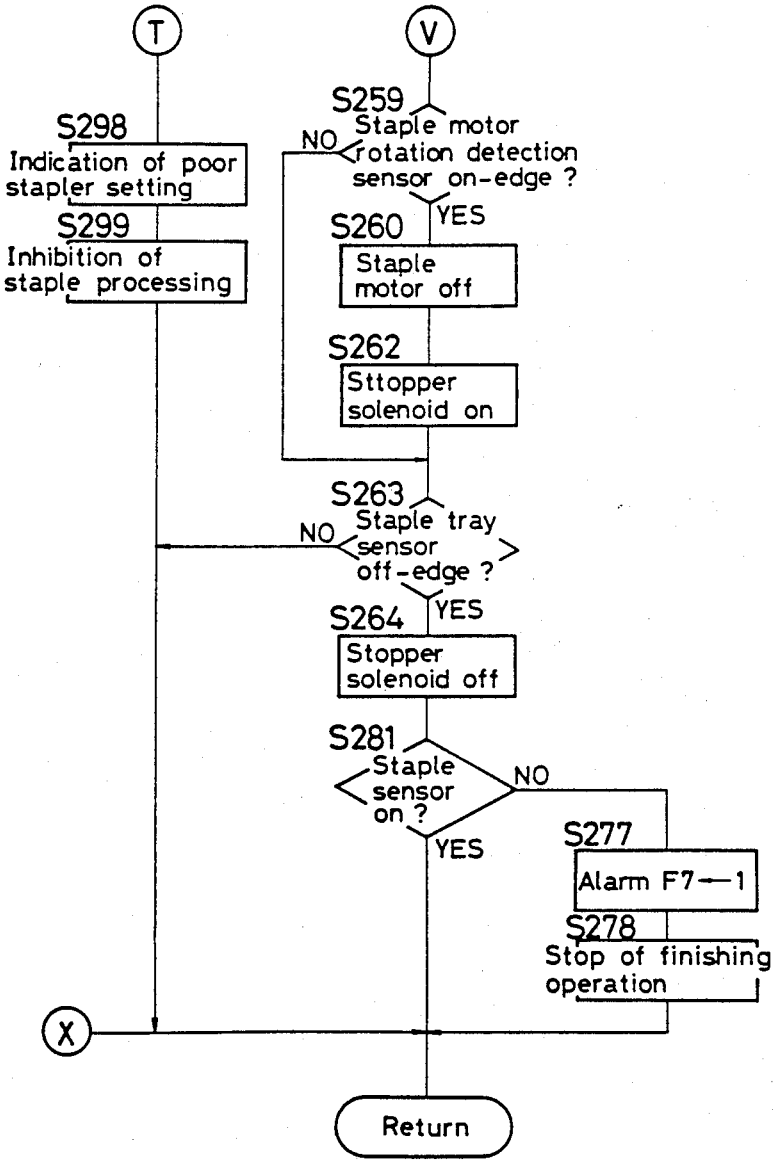
Figure 40:
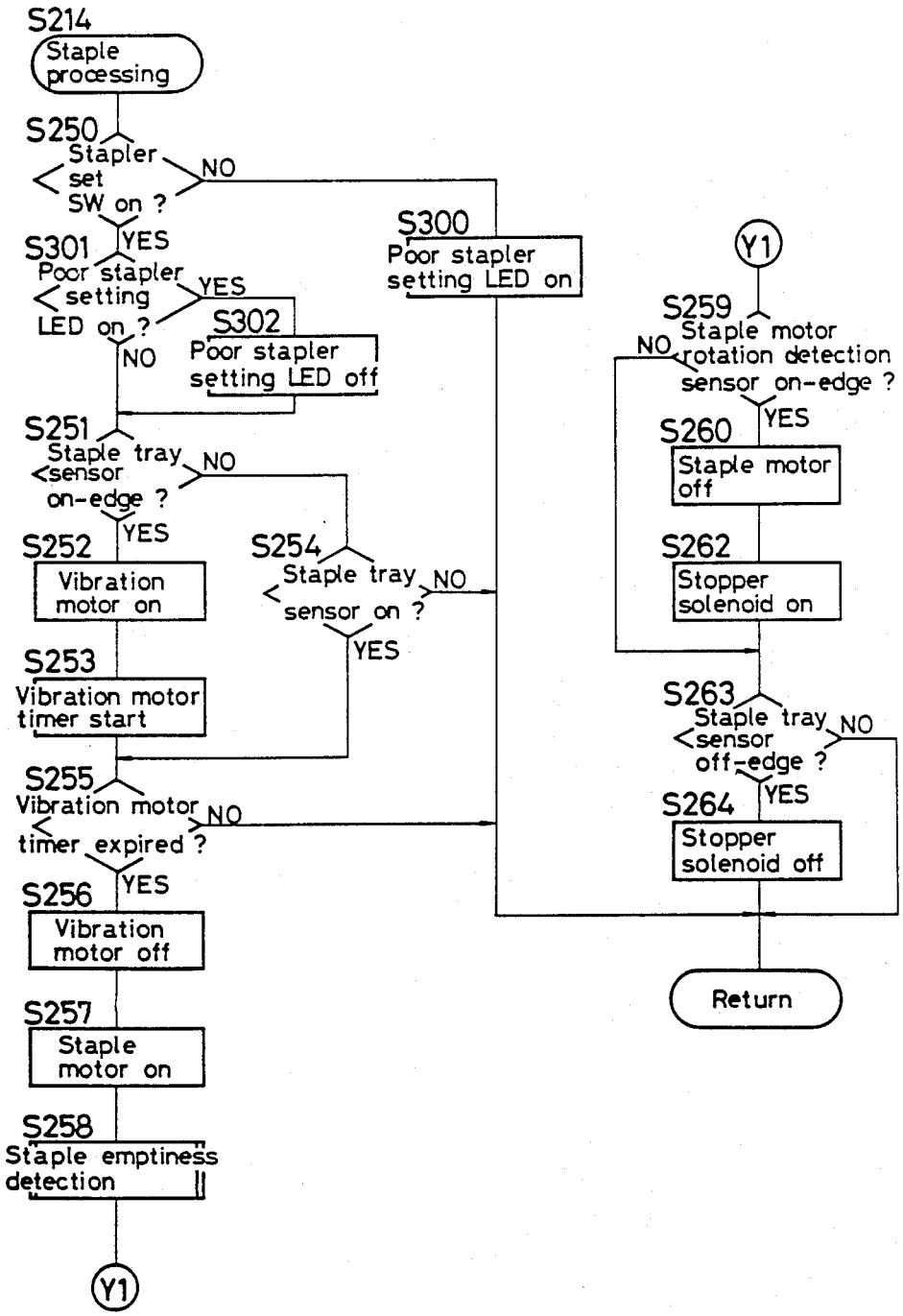
Figure 41:
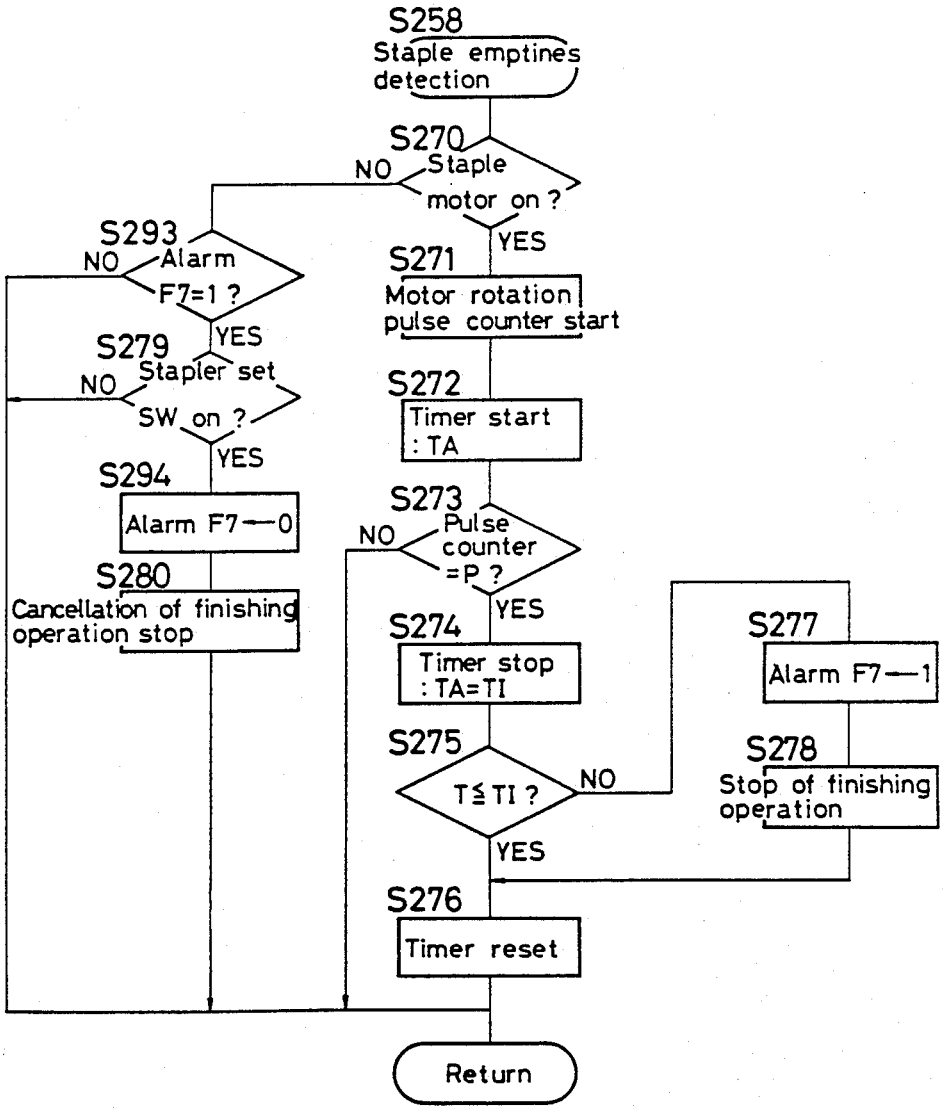
Figure 42:
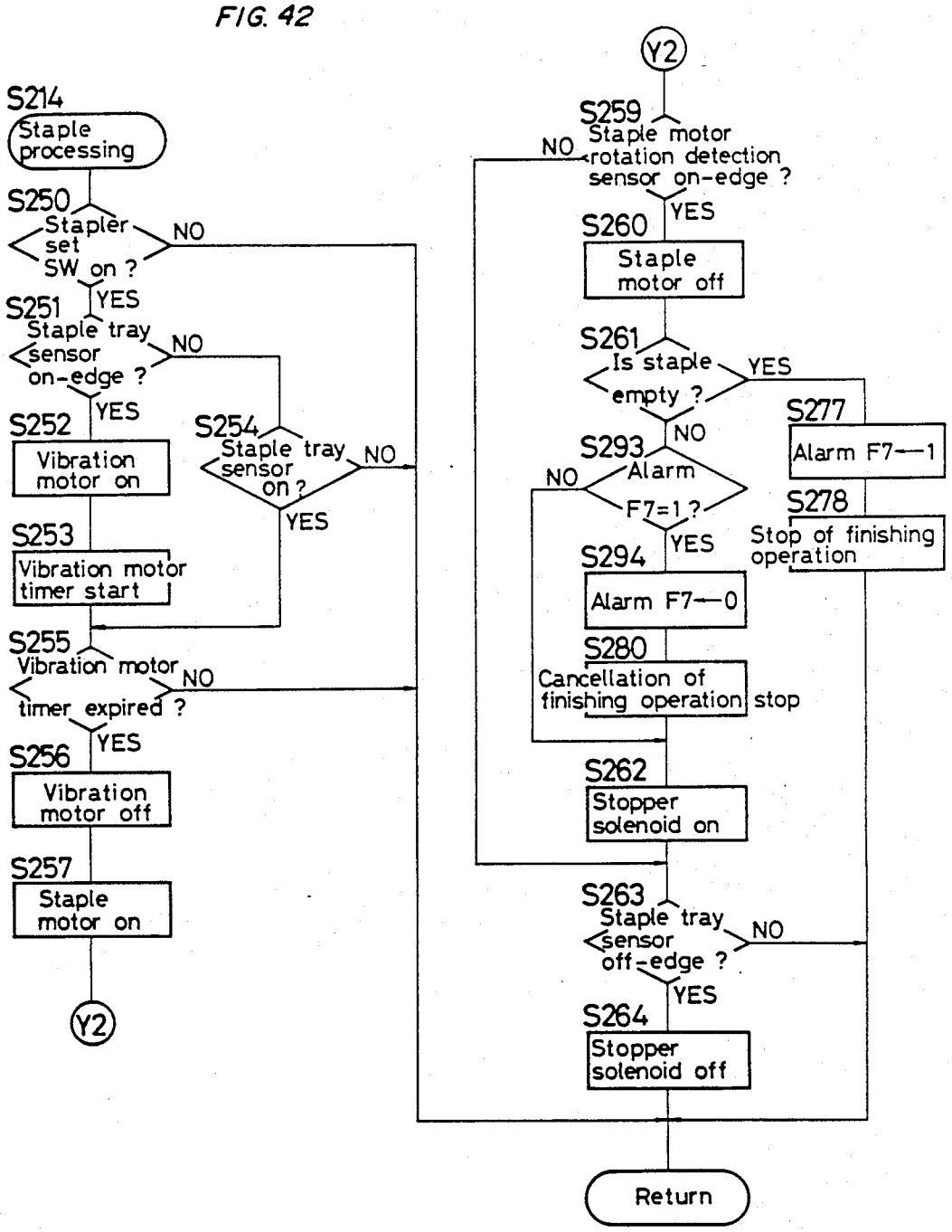

FIGS. **20*a* and 20*b*** are flow charts showing a subroutine for the input processing;

FIG. 21 is a flow chart showing a subroutine for setting of sorter mode;

FIG. 22 is a flow chart showing a subroutine for finishing mode;

FIGS. **23*a* and 23*b*** are flow charts showing a subroutine for indication processing;

FIG. 24 is a flow chart showing a subroutine for copying system processing;

FIG. 25 is a flow chart showing a subroutine for ADF control;

FIGS. **26*a* through 26*d*** are flow charts showing a subroutine for sorting mode processing;

FIG. 27 is a flow chart showing a subroutine for copying operation processing;

FIGS. **28*a* and 28*b*** are flow charts showing a subroutine for finishing processing;

FIG. 29 is a flow chart showing a subroutine for the bin transport processing;

FIG. 30 is a flow chart showing a subroutine for the sheet takeout processing;

FIG. 31 is a flow chart showing a subroutine for stapling operation;

FIGS. **32*a* and 32*b*** are flow charts showing other subroutine for copying system processing;

FIG. 33 is a flow chart showing other subroutine for the bin transport processing;

FIG. 34 is a flow chart showing a part of the other subroutine for sorting mode processing;

FIG. 35 is a flow chart showing a part of the other subroutine for finishing processing;

FIG. 36 is a flow chart showing other subroutine for the bin transport processing;

FIG. 37 is a flow chart showing a part of the other subroutine for finishing processing;

FIG. 38 is a flow chart showing other subroutine for copying system processing;

FIGS. 39*a* and 39*b* are flow charts showing other subroutine for stapling operation;

FIG. 40 is a flow chart showing other subroutine for stapling operation;

FIG. 41 is a flow chart showing a subroutine for detecting the emptiness of staples;

FIG. 42 is a flow chart showing other subroutine for stapling operation; and

Figure 43A:
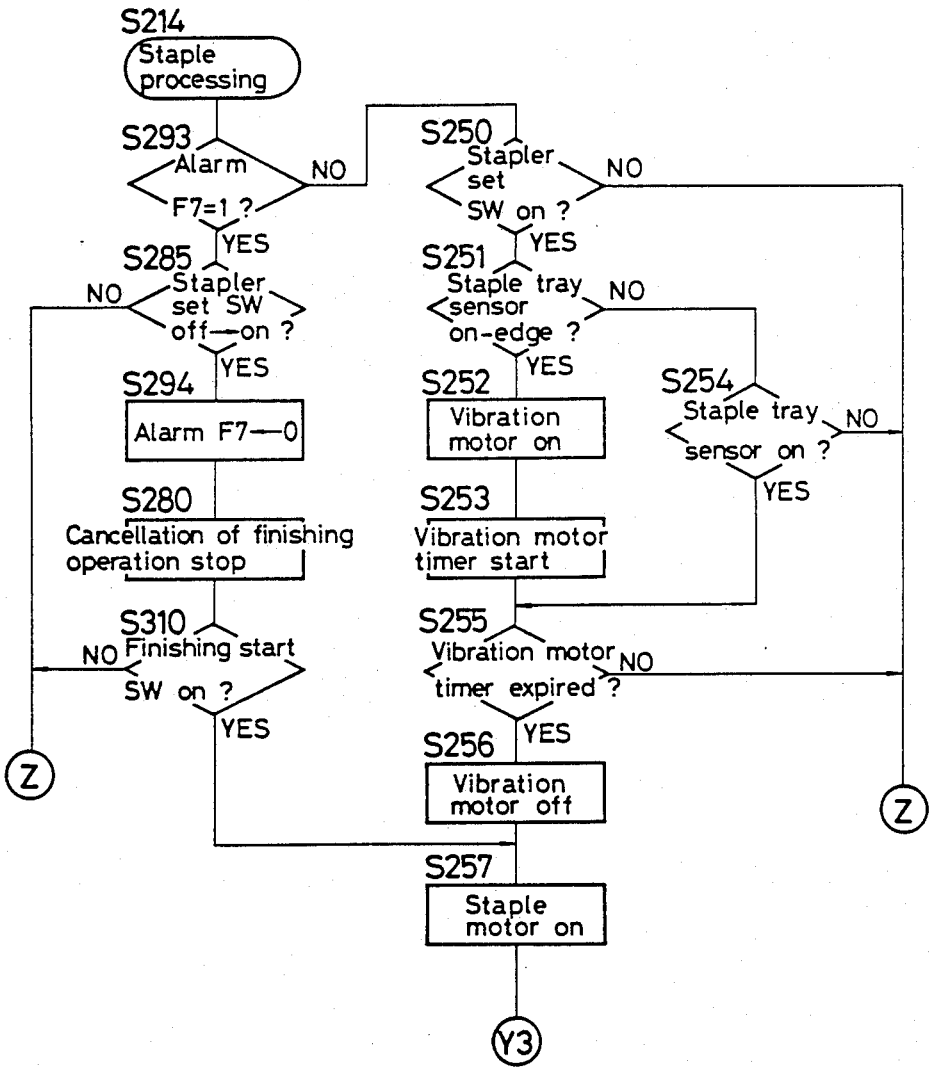
Figure 43B:
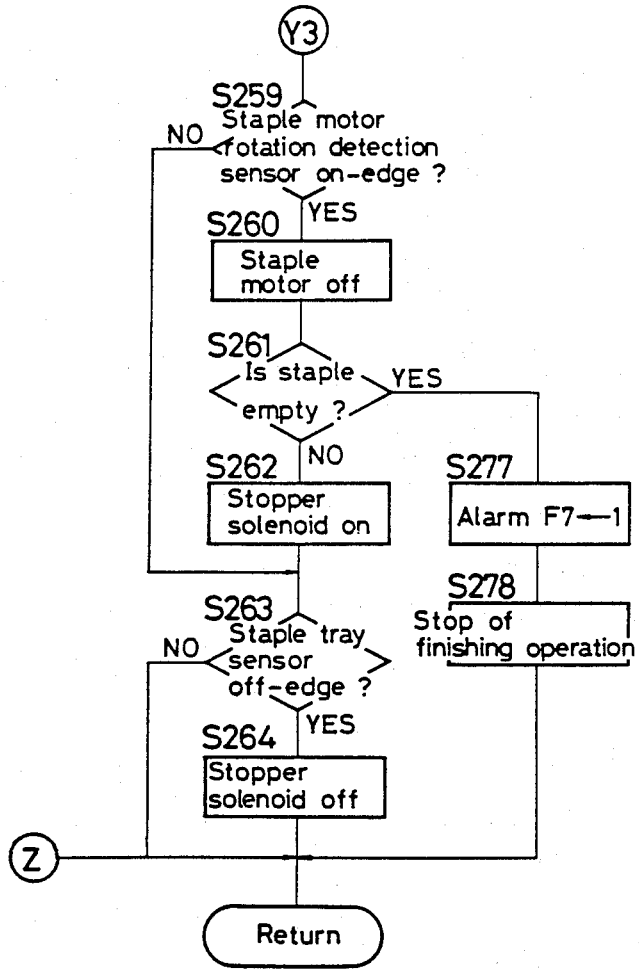

FIGS. 43*a* and 43*b* are flow charts showing other subroutine for stapling operation.

DETAILED DESCRIPTION OF THE PREFERRED EMBODIMENTS

Embodiments of the present invention will be described below with reference to the drawings.

(Composition of whole system)

Figure 1:
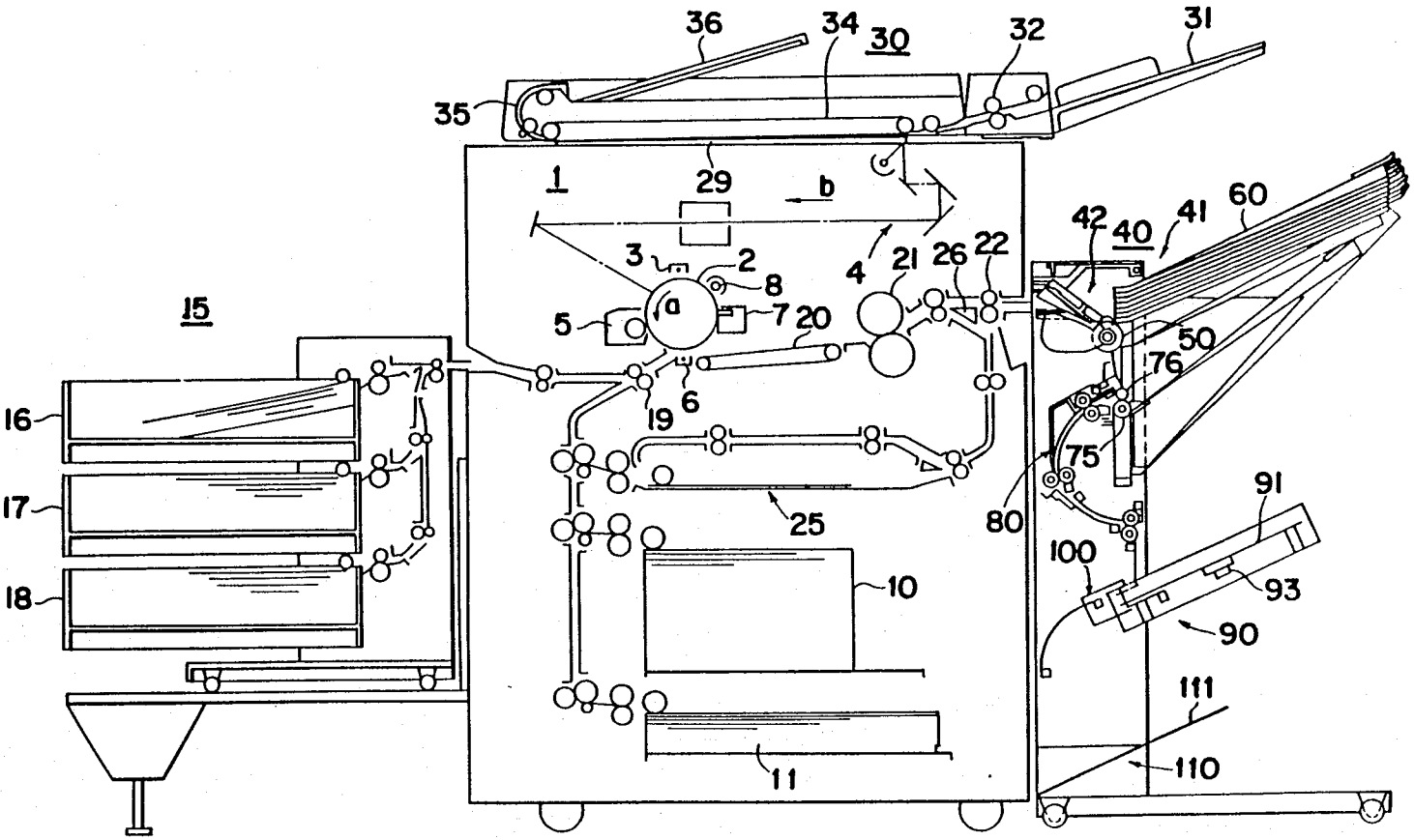
FIG. 1 through FIG. 31 show an embodiment of the present invention.

A sorter-finisher system 40 relating to the present invention is designed to be installed on the side of copying machine 1 as shown in FIG. 1, and the copying machine 1 is provided with an automatic paper feeding unit 15 and an automatic document feeding unit 30 (hereinafter referred to as ADF).

The copying machine 1 operates on the principle of the commonly known electrophotography. In this copying machine 1, a photosensitive drum 2 to be turned towards the direction of an arrow a is charged with a certain amount of static electricity by a static electricity charger 3, and the document set to the specified position by ADF 30 is exposed to the light through a slit when the optical system 40 scans the document towards the direction of an arrow b. This causes the electrostatic latent image formed on the photosensitive drum 2 to be developed into the toner image by the magnetic brush type developing device 5 and then transferred onto the sheet by transfer charger 6.

The sheet fed one by one selectively from the elevate type and cassette type automatic paper feeders 10 and 11 built in the copying machine 1 or the 3-stage paper feed cassettes 16, 17 and 18 of the automatic paper feeder 15 installed outside the copying machine 1 is transported to the transferring portion by a timing roller couple 19 with specified timing. The sheet carrying the copied image is delivered to fixing unit 21 by conveyor belt 20 for fixing the toner image. Then, the sheet is transported to the sorting unit 41 by ejection roller couple 22 while the passage of the sheet is detected by ejection switch SW3 (Refer to FIG. 2) provided immediately before the ejection roller couple 22. The copying machine 1 has a built-in paper re-feeder 25, which enables duplex copy and composite copy, and a sheet transfer selection click 26 is provided before the ejection roller couple 22.

On the other hand, the photosensitive drum 2 continues to turn towards the direction of the arrow a even after the image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed the documents placed on the document tray 31 one by one using the feed roller couple 32 and is set to the specified position on a glass member 29 of document rest by the rotary motion of the conveyor belt 34. After the exposure of the image, the document is ejected onto the ejection tray 36 through transfer pass 35 as conveyor belt 34 turns.

Figure 2:
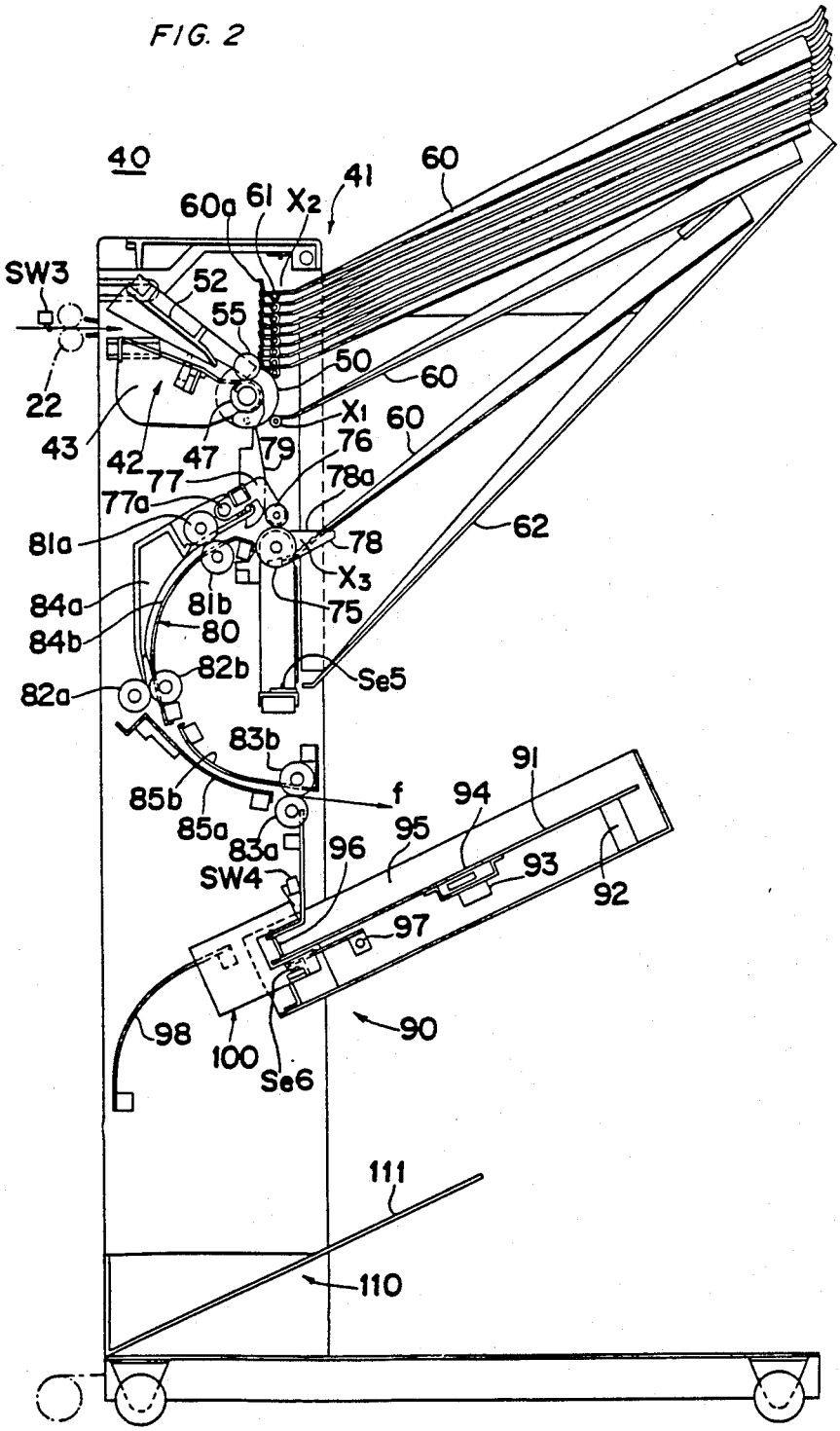

As shown in FIG. 2, the sorter 40 comprises a sorting unit 41 for distributing the sheets among the bins 60, a stapling unit 90 with a staper 100 for binding the sheets and a stacking unit 110 for stacking the stapled sheets. In this sorter 40, the stapling unit 90 is disposed below the sorting unit 41, and the stacking unit 110 is disposed below the stapling unit 90.

(Composition and operation of sorting unit)

Figure 3:
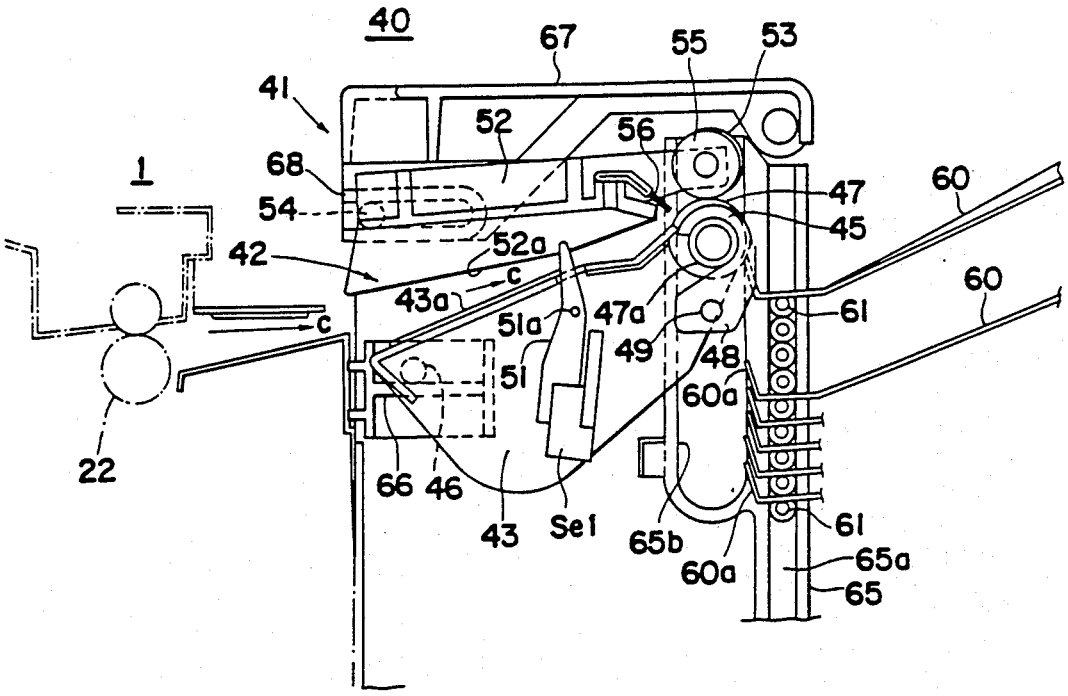
Figure 8:
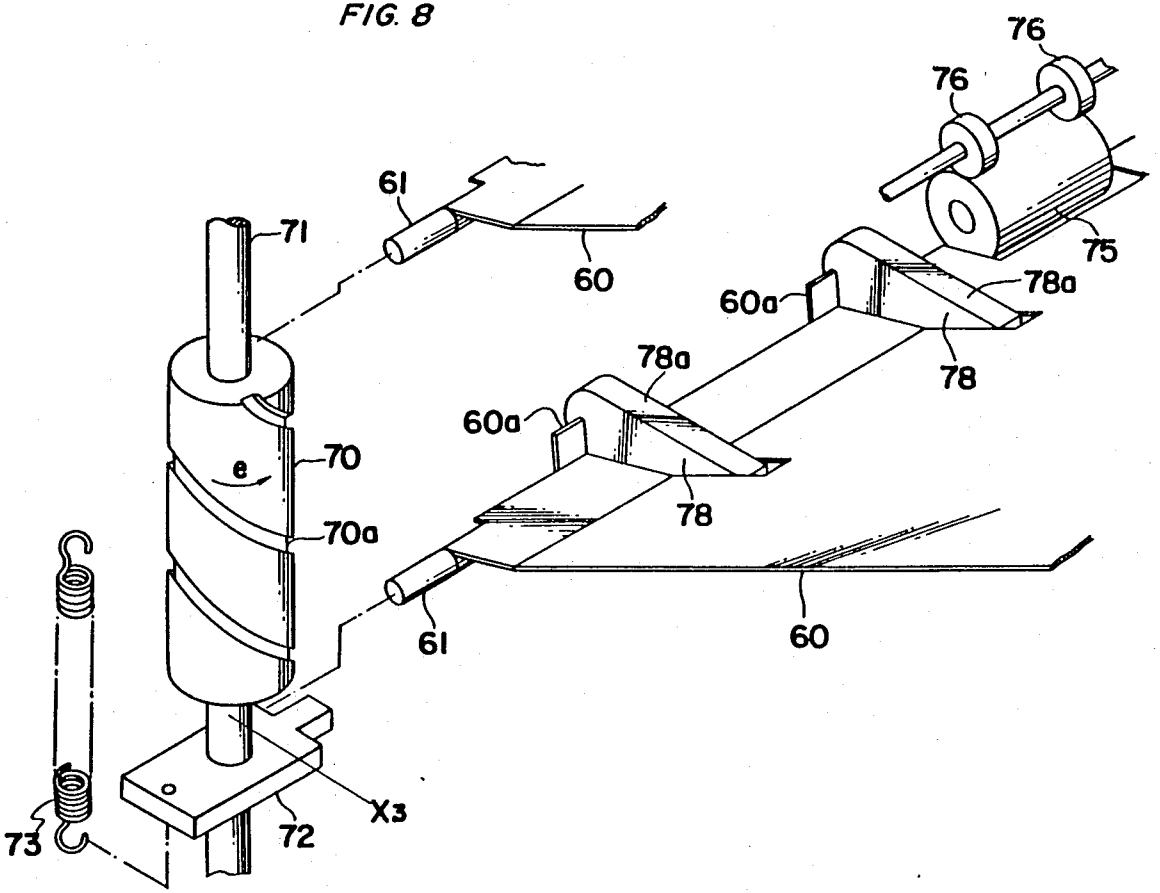
Figure 9:
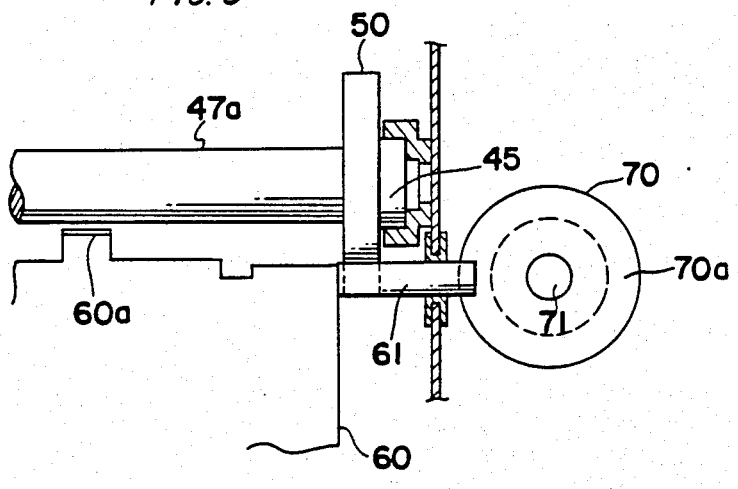

As shown in FIGS. 2, 3 and 8, a plurality of clicks 60*a* for preventing the reverse flow of the sheets and a pair of trunnions 61 are provided on one end of each bin 60. The trunnions 61 engage with a groove 65*a* extending longitudinally along a pair of guide units 65 (only one is shown in FIG. 3) installed on the frame of the sorter 40 in order to regulate the movements of the bins 60 along the longitudinal direction. Another end of each bin 60 is supported by the bin holder 62. A floating cam 50, which will be explained later, shifts the position of the trunnion 61 so that the intervals of the bins 60 can be increased.

The sorting unit 41 distributes the sheets ejected from the copying machine 1 through relative upward and downward movement between a sheet transport unit 42 disposed opposite to the ejection roller couple 22 of the copying machine 1 and bins 60. As shown in FIG. 3, the sheet transport unit 42 comprises an upper unit 52 having a guiding surface 52*a*, a lower unit 43 having a guiding surface 43*a*, a feed roller 47 and a pinch roller 55 so that the sheet from the rollers 47 and 55 is transported to each bin 60 passing between the guiding surfaces 52*a* and 43*a*.

Figure 4:
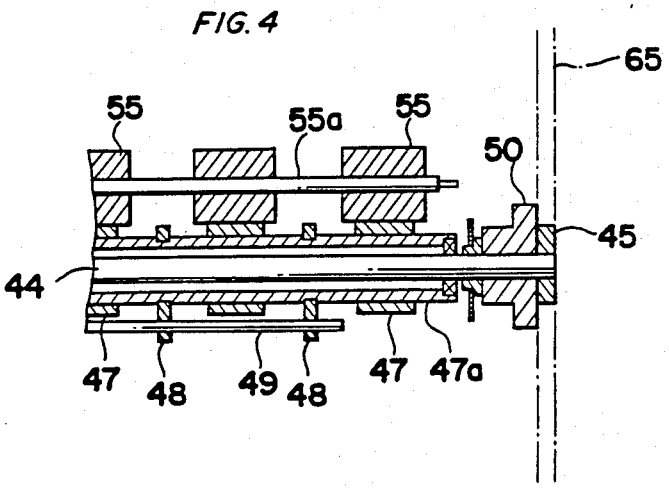
Figure 5:
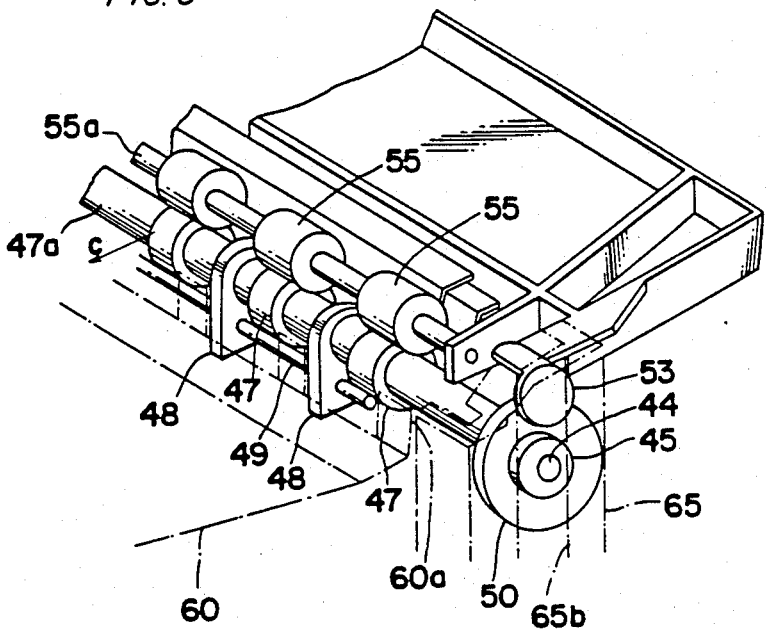

One end of the lower unit 43 is supported movably in upward and downward directions by a supporting shaft 44 disposed on the end of bin 60 orthogonally to the sheet transporting direction indicated by an arrow c. Both ends of the shaft 44 engages with the rail unit 65*b* installed on the guide unit 65 through the collar 45 as shown in FIGS. 4 and 5. Another end of the lower unit 43 has a pin 64 which is supported slidably on a guide member 66.

Figure 6:
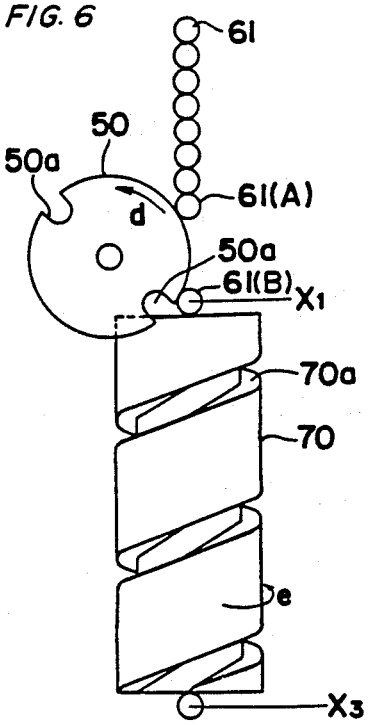
Figure 7:
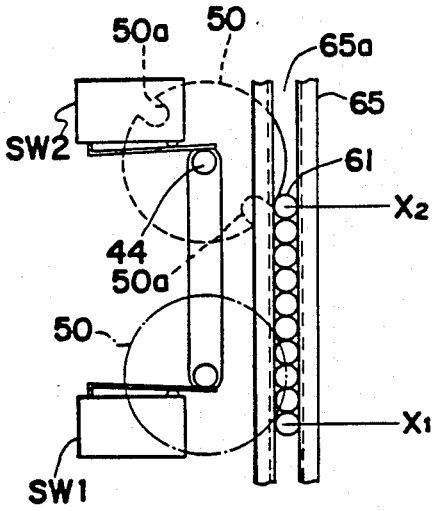

A roller shaft 47*a* whereto plural number of feed rollers 47 are fixed is installed on said supporting shaft 44 in a manner to permit the free rotation of said roller shaft 47*a*, and oscillating plates 48 are hung from said roller shaft 47*a*. The oscillating plates 48 are connected to each other by a rod 49, and the lower part of oscillating plates are located between the reverse flow prevention clicks 60*a* of said bins 60. Besides, as shown in FIGS. 6 and 7, floating cams 50 with notches 50*a* and 50*a* formed on the circumferential surface at intervals of 180° are fixed to both ends of the supporting shaft 44. These floating cams 50 are turned 180° intermittently by the driving source separate from that of the feed roller 47 and support not only the lower unit 43 but also the rear end of bins 60 by means of the trunnions 61 which come to contact their circumferential surface. Furthermore, as shown in FIG. 7, the floating cam 50 can move up and down between a bottom bin position X1 and a top bin position X2, and the cam 50 can be detected by detection switches SW1 and SW2 when it has reached these positions X1 and X2. As shown in FIG. 3, the lower unit 43 is provided with an actuator 51 which turns freely round a pin 51*a* and a photosensor Se1 which can be turned ON and OFF when said actuator 51 turns keeping in contact with the sheet to be transported.

One end of the upper unit 52 has an engaging piece 53 which engages slidably with the rail unit 65*b* thereby oscillating up and down. The other end of the upper unit 52 has a pin 54 which engages slidably with a guide member 68 provided to the top cove 67 of the sorter 40 thereby sliding in horizontal direction. A pinch roller 55 is installed pivotally to said upper unit 52 through the supporting shaft 55*a*. Also, a charge-removing brush 56 is installed to said upper unit 52. The pinch roller 55 pressed against the feed rollers 47 utilizing its own weight, which is capable of being driven by said feed rollers 47.

A transmission type photosensor Se5 (Refer to FIG. 2) whose optical axis is located at the rear end of each bin 60 is installed in said sorting unit 41 s that the presence or absence of the sheets distributed among and in the bins 60 can be detected.

In the above-described composition, the floating cam 50 introduces the trunnion 61 kept in contact with the circumference into the notch 50*a* by every 180° turn in the direction reverse to the direction of the arrow d, thereby not only causing itself to move upward but also causing the introduced trunnion 61 to shift downward to contact the next trunnion 61. Repeating this action causes each bin 60 to shift downward by one step, while the transport unit 42 moves upward. When the sorting mode is selected, the floating cam 50 is located at the bottom bin position X1 as is shown in FIG. 7, and this cam 50 increases the intervals of the bins 60 as it moves upward step by step from this position. The sheets ejected from the copying machine 1 pass between the guiding surfaces 52*a* and 43*a* and between the feed roller 47 and the pinch roller 55 into the bins 60 whose intervals are widened by the floating cam 50. Turning the floating cam 50 towards the normal direction or the direction of the arrow d causes the bins 60 to shift upward one by one, and the cam 50 moves downward together with the transport unit 42.

in the sorting unit 41 having the above-described composition, the sheets can be stored in three different modes. The first mode is the sorting mode to enable the copies of each document to be distributed among the bins 60 and sorted in the order of page numbers. The second mode is the grouping mode to enable the copies of each document to be distributed among the bins 60. The third mode is the non-sorting mode to enable the copies to be stored only in one bin 60.

(Construction and operation of fixed cam)

Here, the explanation will be made as to the fixed cam 70 and the transport unit 80 which are used for transporting the sheets distributed among the bins 60 to a staple tray 91 which will also be explained in the following.

As shown in FIGS. 6 and 8, the fixed cam 70 has a spiral groove 70*a* formed turning 3 times round the circumferential area of the fixed cam 70 for enabling the engagement of said trunnion 61 and said groove 70*a*, and the fixed cam 70 can be turned both towards the normal direction and reverse direction by a motor not shown in the drawing. That is, the fixed cam 70 turns towards the normal direction or the direction of the arrow e to lower the trunnion 61 of the bins 60, which has been shifted to the bottom bin position X1 by said floating cam 50, to the sheet takeout position X3.

On the other hand, as shown in FIG. 8, at the sheet takeout position X3, a receiving member 72 installed to a supporting shaft 71 is not only movable up and down freely along said supporting shaft 71 but also is urged upward by a coil spring 73, thus the trunnion 61 descended to the takeout position X3 supporting flexibly. Said takeout position X3 is provided with a takeout roller 75, pinch rollers 76 which are pressed against said roller 75 by their own weight and sheet guides 78. Also, as shown in FIG. 2, a sheet reverse flow prevention guide 79 is installed between the bottom bin position X1 and the takeout position X3. As shown in FIG. 8, each sheet guide 78 is installed so that a guiding surface 78*a* on the top of said sheet guide 78 comes a little above the position of the sheet reverse flow prevention click 60*a* of each bin 60 which has descended to the takeout position X3 by increasing the angle of its inclination. As shown in FIG. 2, the pinch rollers 76 are rotatably supported with a supporting shaft 77*a* through an arm 77 and are kept in contact with or retracted form the roller 78 by a solenoid not shown in the drawing.

Figure 10:
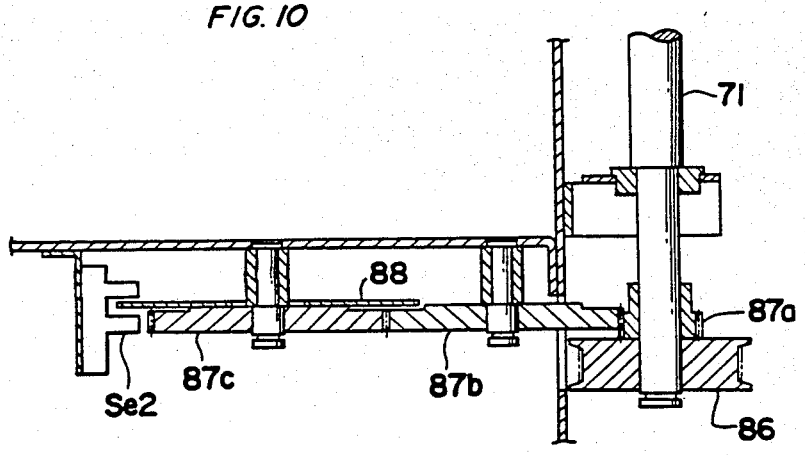

Furthermore, as shown in FIG. 10, a driving pulley 86 and a gear 87*a* are integrally fixed to the lower end of the supporting shaft 71 of said fixed cam 70. The gear 87*a* engages with a gear 87*b* which in turn engages with a gear 87*c*. A disk 88 integrally fixed to the gear 87*c* has the notches not shown in the drawings which are detected by a photosensor Se2 in order to control the number of revolutions of the fixed cam 70.

As shown in FIG. 2, the transport unit 80 comprises transport rollers 81*a*, 81*b*–83*a* and 83*b* and guide plates 84*a*, 84*b*, 85*a* and 85*b*. The transport rollers 81*a*, 82*a* and 83*a* are made of rubber material, while the transport rollers 81*b*, 82*b* and 83*b* are made of spongy material so that they are able to transport the various thickness of stacked sheets.

in the above-described arrangement, the fixed cam 70 is turned 3 times towards the direction of arrow e after said sorting unit 41 has completed the distribution of the sheets. The trunnion 61 of each bin 60 at the bottom bin position X1 is guided by the spiral groove 70*a* to come down to the takeout position X3 where the trunnion 61 is supported with the receiving member 72. At this takeout position X3, the bin 60 inclines at a larger angle than it does at the bottom bin position X1 so that the sheets distributed and stored slide down on the guiding surface 78*a* of the guide 78 due to their own weights. The takeout roller 75 overlaps with the bin 60 so that the end of the sheets are inserted between the rollers 75 and 76 when the bin 60 has reached the takeout position X3, and the sheets are transported to the transport rollers 81*a* and 81*b* by the rollers 75 and 76. Even when the sheets are curled downward, the sheets can be transported between the guide plates 84*a* and 84*b* without fail guided by the guide 78 and the takeout roller 75. Also, even when the sheets are curled upward, the sheets are transported between the guide plates 84*a* and 84*b* guided by the reverse flow prevention guide 79.

When the sheets are transported by the rollers 81*a* and 81*b*, the solenoid not shown in the drawings is turned off (off is initial state) so that the pinch roller 76 moves upward away from the top of the takeout roller 75. On the other hand, when the bin 60 has reached the takeout position X3, the solenoid is turned on to nip the sheets between the pinch rollers 76 and the takeout rollers 75 and the takeout rollers 75 and the transport rollers 81*a*, 81*b*, 82*a*, 82*b*, 83*a* and 83*b* are driven to turn respectively, and this causes the sheets to be transported onto the staple tray 91 through the transport rollers 83*a* and 83*b* as indicated by an arrow f in FIG. 2.

On the other hand, at the time of sheet takeout operation, the floating cam 50 comes to the position corresponding to the bottom bin position X1 and supports the trunnion 61 immediately before being fed to the fixed cam 70 so that the trunnions 61 can be fed to the fixed cam 70 one by one as said floating cam 50 turns 180° intermittently towards the direction reverse to that of an arrow d. In this embodiment, in order to increase the angle of inclination of the bin 60 at the takeout position X3 to facilitate the sheets on the bin 60 sliding downward by their own weight, the interval between the bottom bin position X1 and the takeout position X3, that is, the stroke of the bin 60 that is to move between these two points can be made relatively large. Thus, the torque needed for rotating the fixed cam 70 can be reduced by a small pitch of spiral groove 70*a*. The trunnion 61 is moved from the position X1 to the position X3 by triple rotations of the fixed cam 70 with reduced torque. The trunnion 61(A) immediately before the trunnion 61(B) is supported by the floating cam 50 is fed to the fixed cam 70 so that the trunnion 61(A) can be prevented from being fed to the spiral groove 70*a* at the time of the second or the third turn of the fixed cam 70.

As explained in the foregoing, as the floating cam 50 turns reversely by 180°, and the fixed cam 70 turns 3 times respectively, the bins 60 are brought down step by step to the takeout position X3, and the sheets distributed among the bins 60 are transported onto the staple tray 91 by the transport unit 80.

Each bin 60 brought down to the takeout position X3 is supported by the receiving member 72. And the bin 60 returns to its upward original position by the rotation of the fixed cam 70 towards the direction reverse to the arrow e, and the floating cam 50 towards its normal direction or the direction of the arrow d after all the sheets distributed among the bins 60 are taken out.

(Construction and operation of stapling unit)

As shown in FIG. 2, the stapling unit 90 comprises the staple tray 91, a motor to vibrate the staple tray 91, a guide plate 95, a stopper 96 and a stapler 100. The staple tray 91 is oscillatably installed on the supporting shaft 92 to serve as a supporting point, and the staple tray 91 vibrates by the centrifugal force of an eccentric weight 94 turned by the motor 93. This vibration causes the sheets which have been transported from said transport unit 80 to be trued up while they are regulated by the stopper 96.

Figure 11:
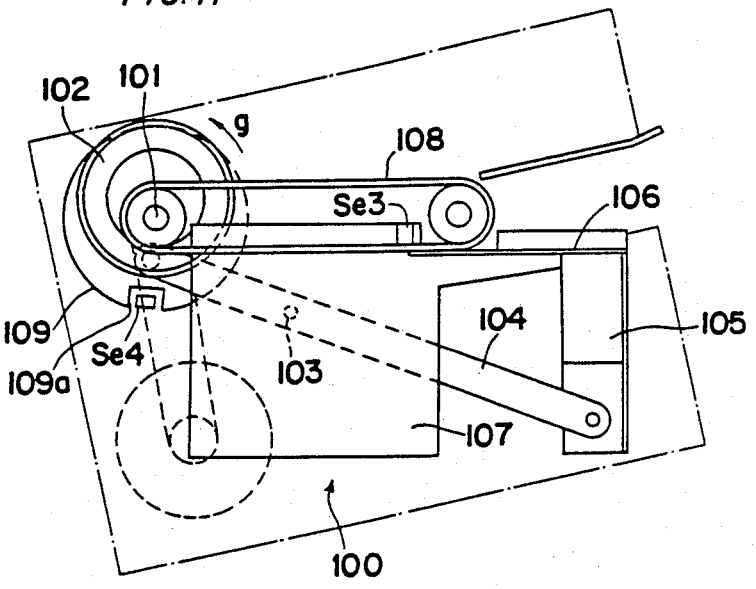

As shown in FIG. 11, the stapler 100 comprises a fixed output shaft 101 of a motor, an oscillating arm 104 on a pin 103 to serve as a supporting point and a cam 102 whose circumferential part is connected to a head 105 so that the rotation of the cam 102 towards the direction of an arrow g by the motor causes the head 105 to move upward through the arm 104, and a staple 106 binds the sheets trued up on the tray 91. The staples 106 are contained in a cartridge 107 and transported to the head 105 by the conveyor belt 108 which is driven to turn by said output shaft 101 of the motor.

The stopper 96 is installed on the supporting shaft 97 to serve as a supporting point so that the stopper 96 can be turned by a solenoid not shown in the drawings. The stopper 96 is normally located on the lower end of the staple tray 91 to determine the end position of the sheets. When the solenoid is turned on, the stopper 96 retreats downwards to cancel the sheet positioning.

The stapler 100 is provided with a photosensor Se3 for detecting the absence of the staples 106 and a sensor Se4 for detecting the number of revolutions of the staple motor so that the sensor Se3 directly detects the staples 106, while the sensor Se4 detects the notch 109*a* of a disk 109 fixed to the output shaft 101 of the motor.

Furthermore, the stapling unit 90 is provided with a photosensor Se6 for detecting the presence and absence of the sheet on the staple tray 91 and a switch SW4 for detecting the mounting and dismounting of the stapler 100.

In the above-described arrangement, the sheets transported onto the staple tray 91 from said transport unit 80 are trued up by the guide plate 95 and the stopper 96 as the tray 91 is vibrated by the rotation of the motor 93. The trued up sheets are bound by the staple motor. When the solenoid is turned on to withdraw the stopper 96 from the tray 91, the bound sheets slides down onto the stack tray 111 by being guided by the plate 98. Such stapling operation is repeated each time when the sheets in the bins 60 are carried onto the staple tray 91.

The absence of the staples 106 is not necessarily required to be detected only by the sensor Se3. That is, at the time of the stapling operation, the absence of the staples 106 can also be detected by said sensor Se4, since the number of revolutions of the staple motor increases when the torque needed for rotating the cam 102 has decreased due to the absence of the staples 106. Thus, the increase in the number of revolutions of the staple motor indicates the absence of the staples 106.

(Construction of stack unit)

Figure 12:
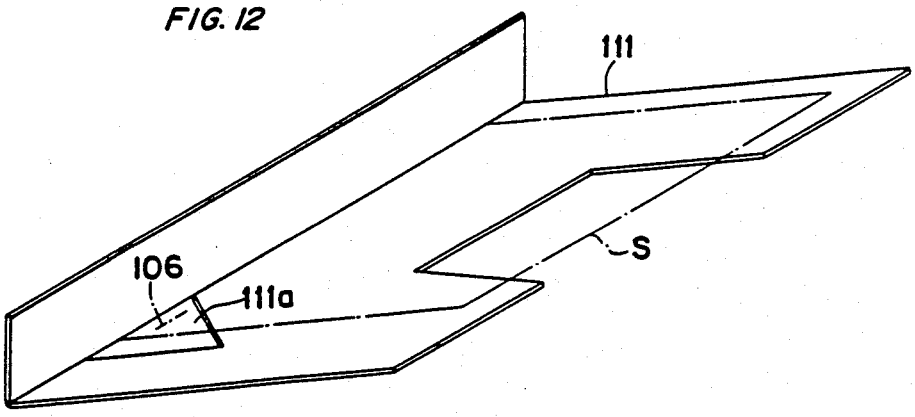

The stack unit 110 comprises the stack tray 111 which is designed for finally containing the sheets bound by said stapler 100. As shown in FIG. 12, the stack tray 111 has a notch 111*a* in its part to be used for the stapling of the sheet S, that is, the part where the part of the sheet stapled with the staple 106 is located so that the sheet bound with the stapler 100 and placed on the tray 111 hangs down into the notch 111*a* by its own weight, whereby not only the stapled parts of bound sheets can be prevented from becoming higher than the non-stapled parts when they are stacked but also the stacking capacity of the tray 111 can be increased.

Figure 13:
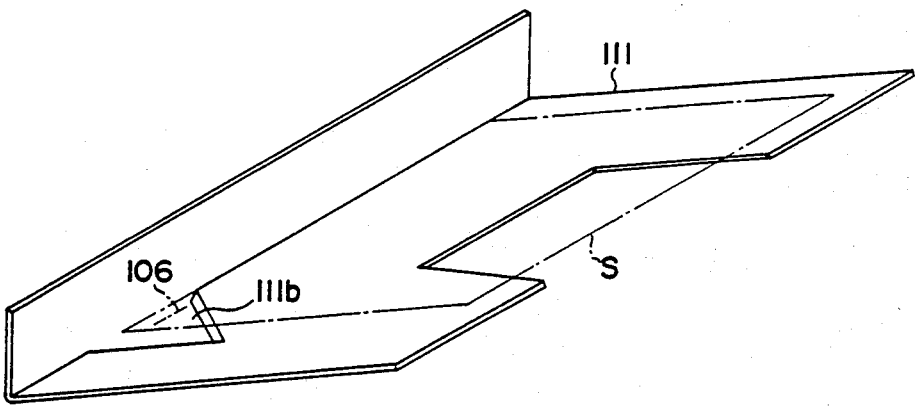

The similar effect can also be achieved when an indent 111*b* is formed in the part of the stack tray 111 where the parts of the sheets bound with staples 106 are stacked as shown in FIG. 13.

(Operation panel)

Figure 14:
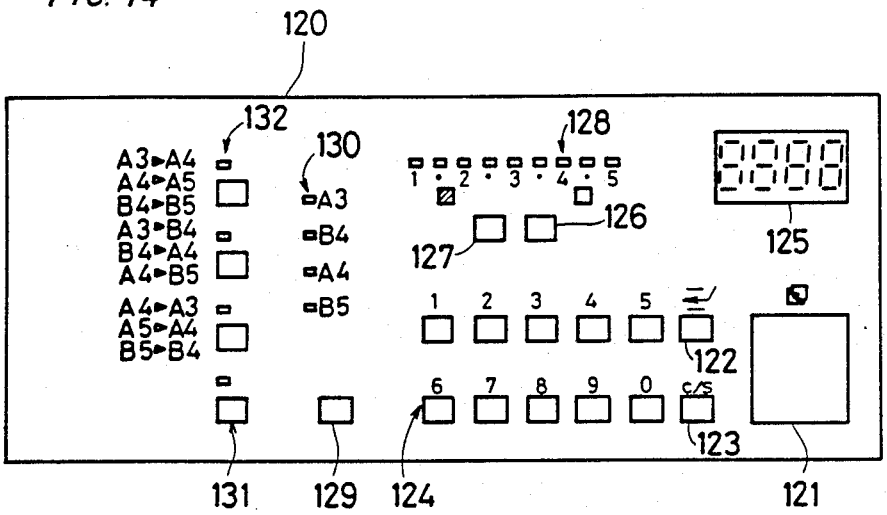
Figure 15:
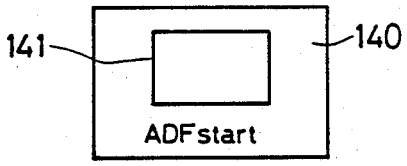
Figure 16:
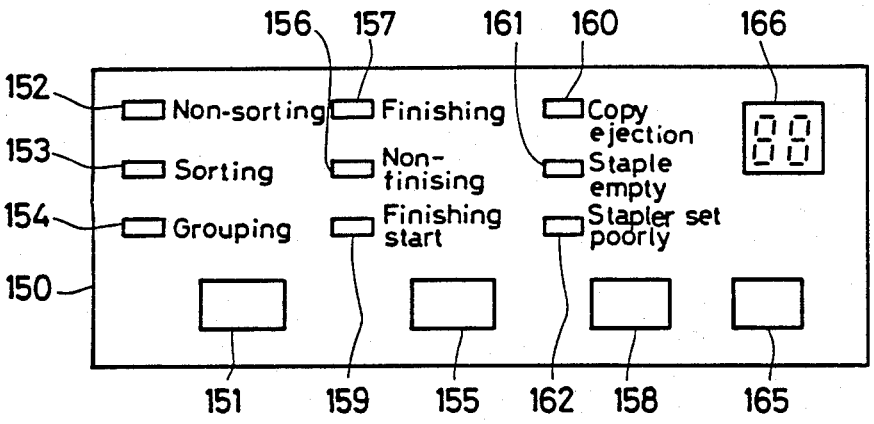

In this embodiment, operation panels are installed at the three places in a copying machine panel 120, an ADF panel 140 and a sorter panel 150 as shown in FIGS. 14, 15 and 16 respectively.

Installed on the copying machine panel 120 are a print key 121 for starting the copying operation when ADF 30 is not used, an interruption key 122 for interrupting the multicopying operation temporarily, a clear/stop key 123 for stopping the copying operation or cancelling the set numbers, ten key group 124 for setting the numbers of multiplies, an indicator 125 for indicating the number of copies and the condition of the copying machine 1, up/down keys 126 and 127 for setting the density for copies, LEDs 128 for indicating the density for copies, a sheet selection key 129 for selecting the sheet size, LEDs 130 for indicating said sizes, magnification selection key group 131 for selecting the copying magnification and LED group 132 for indicating said magnifications.

Installed on the ADF panel 140 is only a start key 141 for starting the ADF. When this start key 141 is turned on, the documents on the document tray 31 are automatically transferred one by one onto the glass 29 of the document rest, and the copying operation is started.

Installed on the sorter panel 150 are a sorter mode selection key 151, non-sorting mode indication LED 152, sorting mode indication LED 153 and grouping mode indication LED 154 which are the indicators of said sorter mode selection key 151, finishing mode selection key 155, non-finishing mode indication LED 156 and finishing mode indication LED which are the indicators of said finishing mode selection key 155, finishing start key 158 and LED 159 as the indicator for said finishing start key 158. A LED 159, when lighted, indicates that the finishing operation is in progress, and, when is flicking, alarms for the necessity of removing the sheets from the staple tray 91. A LED 160 alarms for requiring the necessity of removing the sheets from bins 60, a LED 161 alarms for indicating that the staple 106 is absent and a LED 162 alarms for indicating the poor setting of stapler 100.

The sorter mode selection key 151 selects the modes in the order of non-sorting mode, sorting mode and grouping mode when the key 51 is depressed in succession, and the corresponding LEDs 152, 153 and 154 are lighted accordingly. The finishing mode selection key 155 also selects the modes in the order of non-finishing mode and finishing mode when the key 155 is depressed in succession, and the corresponding LEDs 156 and 157 are lighted accordingly. The finishing start key 158 outputs the signals in the order of the signal for the start of finishing operation and the signal for its cancellation when the key 158 is depressed in succession, and LED 159 lights when the key 158 is depressed for the start of finishing operation.

Furthermore, the sorter panel 150 is provided with a number of stapling setting key 165 for stapling and its indicator 166. The indicator 166 indicates "0" when the finishing mode is not selected, and the number of copies set by said copying machine panel 120 when the finishing mode is selected. The number indicated is deducted each time the setting key 165 is depressed, and the number indicated is the number of sheets to be stapled.

(Control circuit)

Figure 17:
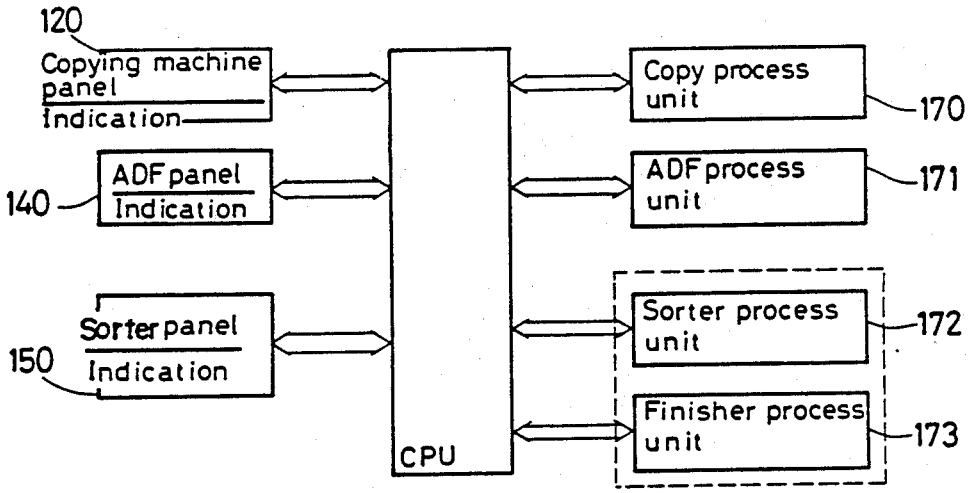

FIG. 17 is a block diagram of the control circuit wherein a microcomputer is connected to the copying machine panel 120, ADF panel 140, sorter panel 150, copy processing unit 171, ADF processing unit 171, sorter processing unit 172 and finisher processing unit 173 so that the signals can be exchanged with each other.

Figure 18:
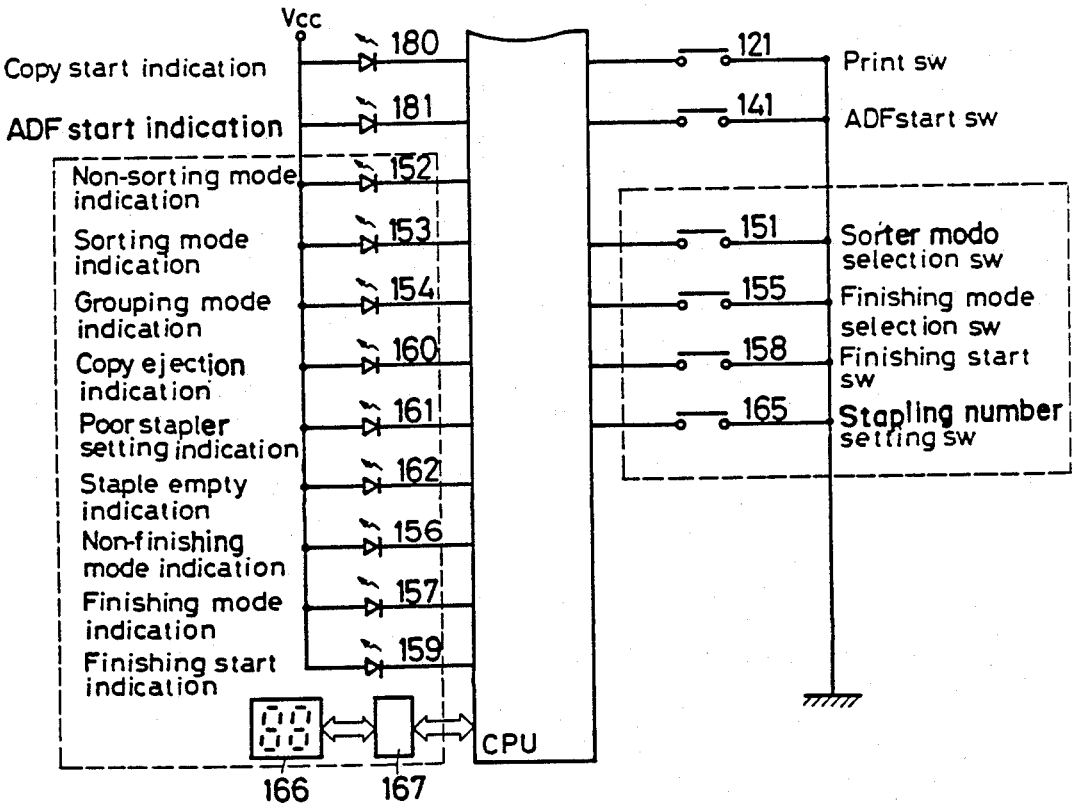

FIG. 18 shows the essential part of the control circuit wherein the input/output port of the microcomputer is connected to the print switch, ADF switch and their built-in indicator LEDs 180 and 181, various selection switches of the sorter panel 150, various indicator LEDs 152 and the indicator 166 of the stapling number, which is connected through the driver 167.

(Control procedure)

Here, the control procedures of the copying machine 1 and the sorter 40 based on the control circuit will be explained in reference to FIG. 19 and on.

Figure 19:
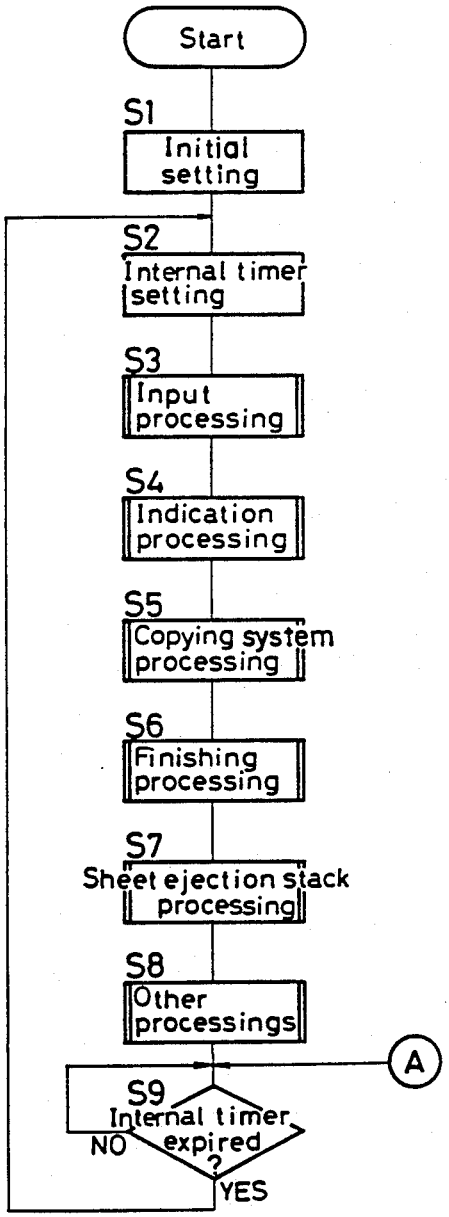
Figure 20A:
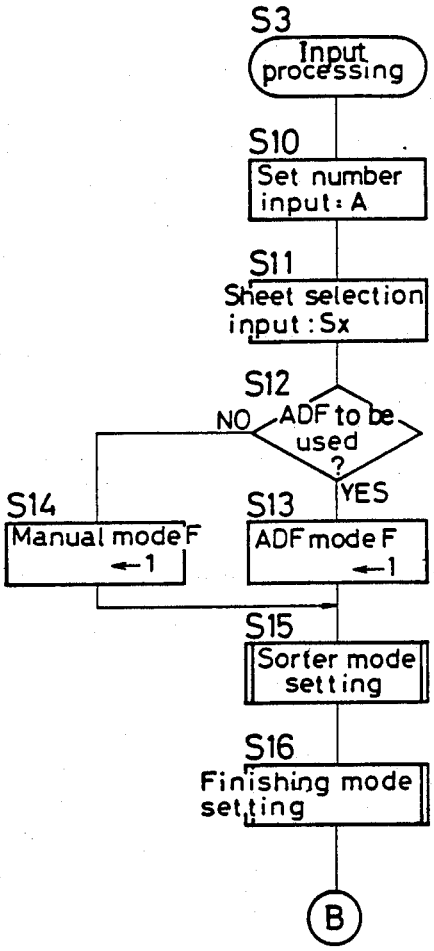
Figure 20B:
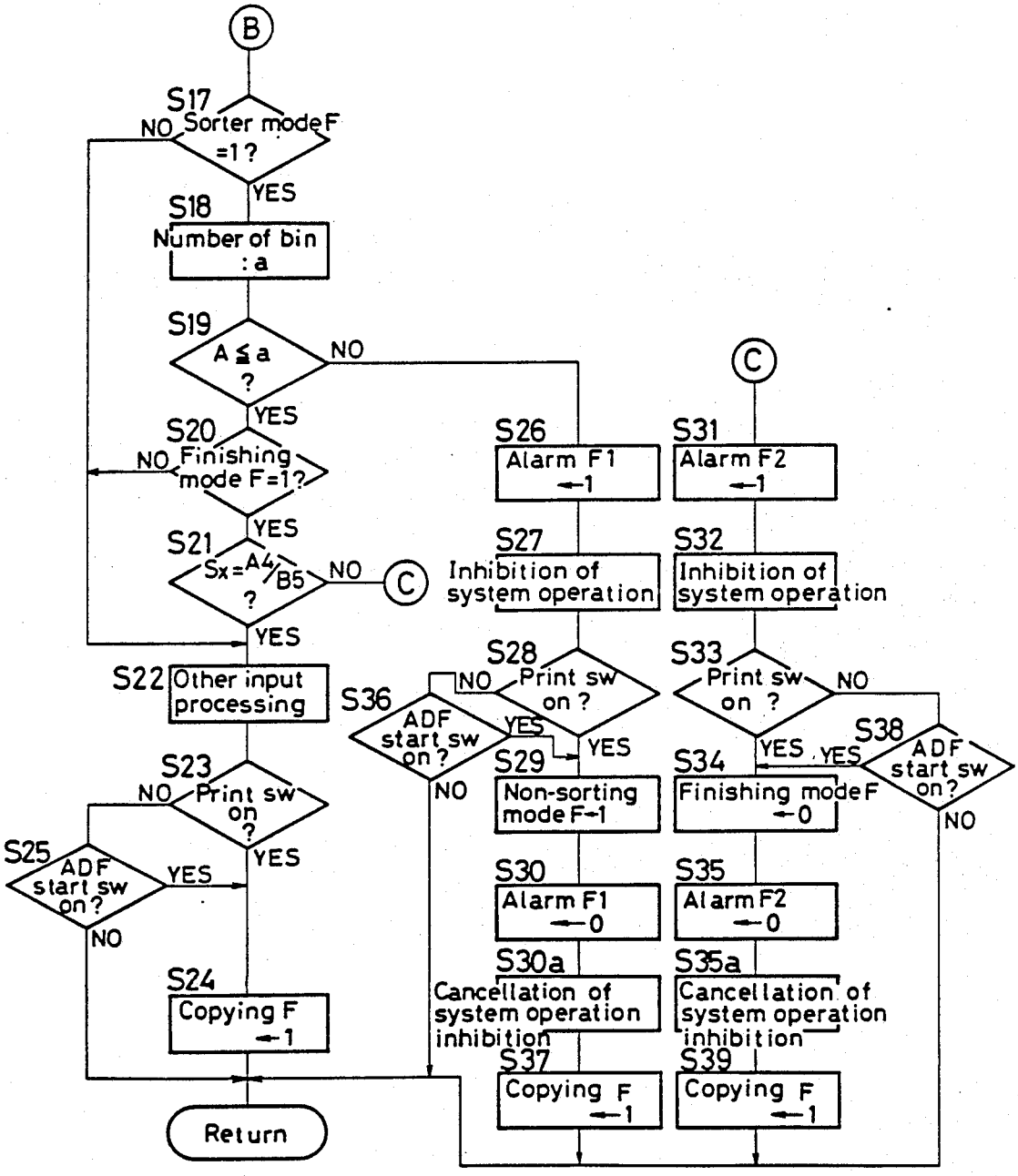

FIG. 19 shows a main routine of said microcomputer.

When the microcomputer is reset, and the program is started, the clearance of random access memory at step S1 and initialization (or setting for initial mode) of various registers and units take place. An internal timer starts at step S2. The internal timer is for setting the time required for the execution of the main routine, which is to be set in advance at the time of initialization at step S1.

Various subroutines, which will be explained later, are called one by one at steps S3 through S8. When the execution of all the subroutines are completed, the processing returns to step S2 after the time set by said internal timer has passed at step S9. The length of time required for one routine is used in making various counting with various counters during the execution of the subroutine.

FIGS. **20*a* and 20*b* show a subroutine for the input processing to be executed at step S3**.

First, a set number A is inputted through the ten key group 124 on the copying machine panel 120 at step S10. Then, the sheet size Sx selected at step S11 is inputted, and whether ADF 30 has been selected for use at step S12 is checked. When said ADF 30 has been selected for use, ADF mode flag is set to "1" at step S13, and, when not selected, manual mode flag is set to "1".

A subroutine for setting sorter mode is executed at step S15 A subroutine for setting finishing mode is executed at step S16, and whether the sorter mode flag is "1" or not is checked at step S17. When the sorter mode flag is "0", the sorting and stapling operations will not be executed, so that the processing goes to step S22. When the sorter mode flag is "1", bin number a is inputted at step S18, and said set number A and the bin number a are compared at step S19. When the set number A is less than the bin number a, the operation in the sorting mode is possible. Whether finishing mode flag is "1" or not is checked at step S20. When the finishing mode flag is "0", the processing goes to step S22, and, when is "1", whether the sheet size Sx is A4 size or B5 size is checked at step S21. In this embodiment, the sheet sizes allowed for stapling operation are A4 size and B5 size. When the result is "Yes", other input processings are executed at step S22.

Further, whether the print switch is turned on or not is checked at step S23. When turned on, the copying flag is set to "1" at step S24 for enabling the copying operation. When not on, whether ADF start switch is turned on or not is checked at step S25. When turned on, the processing at said step S24 is executed, and, when not on, the subroutine will be terminated.

On the other hand, set number A is found to be larger than the bin number a at said step 819, alarm flag F1 is set to "1" at step S26, and the operation of the system is inhibited at step S27. Said alarm flag F1 is for the indication at the time when the number for distribution has exceeded the number of the bins 60. At steps S28 and S36, whether the print switch and ADF start switch are turned on respectively are checked in the same manner as that at steps S23 and S25. When the result is "Yes" or the operator's will for executing the copying operation regardless of alarm signal, non-sorting mode flag is set to "1" at step S29, and the alarm flag F1 is reset to "0" at step S30. Then, the inhibition of system operation is cancelled at step **S30*a*, and the copying flag is set to "1" at step S37**.

Further, when the sheet size Sx is judged to be other than A4 size and 85 size at said step S21, stapling operation is not possible, so that alarm flag F2 is set to "1" at step S31, and the operation of the system at step S32 is inhibited. Said alarm flag F2 is for indicating that the selected sheet size is wrong. Then, whether the print switch and ADF start switch are turned on respectively are checked at steps S33 and S38 in the same manner as that at steps S23 and S25. When the operator's will for executing the copying operation regardless of the alarm signal at step S33 or step S38 is confirmed, the finishing mode flag is reset to "0" at step S34, and the alarm flag F2 is reset to "0" at step S35. The inhibition of the system operation is cancelled at step S35*a*, and the copying flag is set to "1" at step S39.

FIG. 21 shows a subroutine for sorter mode setting to be executed at said step S15.

In the subroutine, whether the non-sorting mode, sorting mode and grouping mode are selected respectively is checked at steps S40, S42 and S44 respectively. When selected, a non-sorting mode flag, sorting mode flag and grouping mode flag are set to "1" respectively at steps S41, S43 and S45.

FIG. 22 shows a subroutine for finishing mode to be executed at said step S16.

First, whether the finishing mode has been selected or not is checked at step S50. When not selected, the subroutine is terminated at once. When selected, the finishing mode flag is set to "1" at step S51. Said number of stapling setting key 165 is turned on at step S51*a*, and the set number A is deducted one by one to set stapling number B. Then, allowable stapling number Cb is set at step S52. The allowable size for stapling is set to A4 or B5 at step S53. The sorting flag mode is set to "1" at step S54 for allowing the operation in the sorting mode.

Figure 23A:
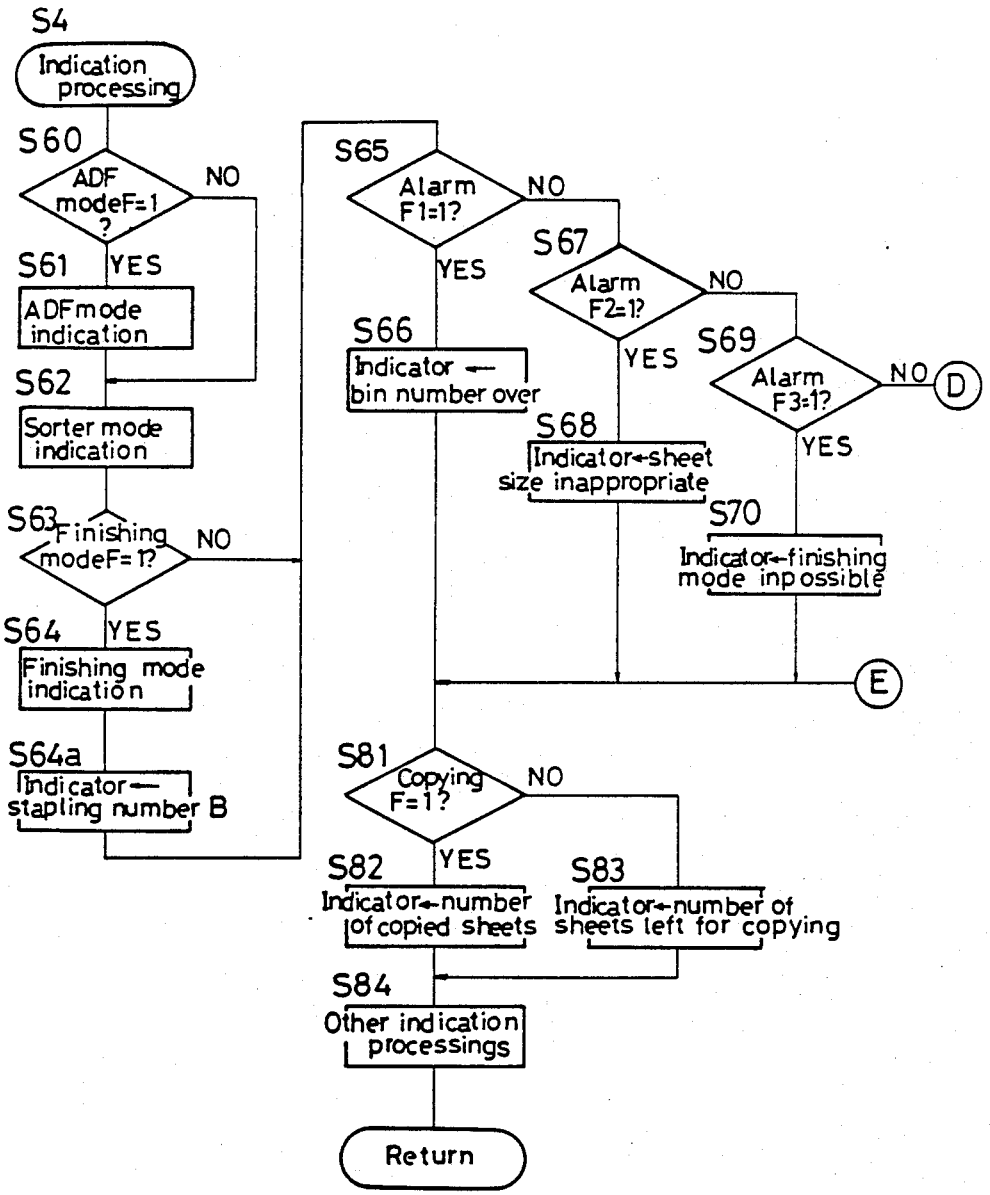
Figure 23B:
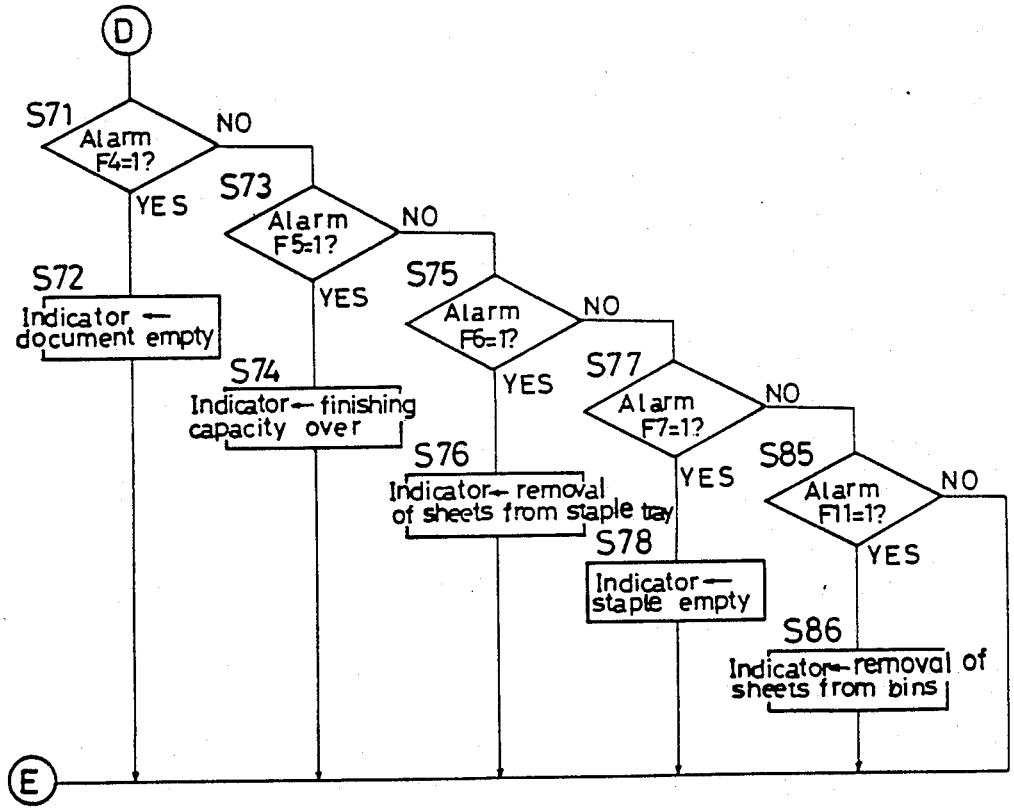

FIGS. 23*a* and 23*b* show a subroutines for indication processing to be executed at step S4 of the main routine.

First, whether the ADF mode flag is set to "1" or not is checked at step S60. When is set to "1", the LED 180 for indicating the ADF mode is lighted. Regardless of whether the ADF mode is set to "1" or "0", one of LEDs 152, 153 and 154 is lighted to indicate the selected mode of sorter 40 at step S62. At step S63, it is determined whether the finishing mode flag is set to "1" or not. When is set to "1", the LED 157 for indicating the finishing mode is lighted at step S64. At step S64*a*, the indicator 166 indicates the number B of sheets to be stapled, and processing goes to step S65. At said step S63, when the finishing mode flag is judged to be "0", the processing goes to step S65.

At step S65, said alarm flag F1 is checked as to whether is set to "1" or not. When set to "1", the indicator 125 indicates that the number of bins is excessive at step S66. At step S67, whether said alarm flag F3 is "1" or not is checked. When set to "1", the indicator 125 indicates that the sheet size is inappropriate at step S68. At step S69, whether alarm flag F3 is "1" or not is checked. When set to "1", the indicator 125 indicates that the finishing mode is not possible at step S70. At step S71, whether alarm F4 is set to "1" or not is checked. When set to "1", the indicator 125 indicates that the document is absent at step S72. At step S73, whether alarm flag F5 is set to "1" or not is checked. When set to "1", the indicator 125 indicates that the finishing capacity is excessive at step S74. At step S75, whether alarm flag F6 is set to "1" or not is checked. When set to "1", the LED 159 is flickering at step S76, indicates that the sheets need to be removed from staple tray 91. At step S77, whether alarm flag F7 is set to "1" or not is checked. When set to "1", the LED 161 for indicating the absence of staple 106 is lighted at step S78. At step S85, whether alarm flag F11 is set to "1" or not is checked. When set to "1", the LED 160 is lighted at step S86, indicates that the sheets need to be removed from bins 60.

Further, whether copying flag is set to "1" or not is checked at step S81. The indicator 125 indicates the number of copied sheets or the number of sheets left for copying at step S82 when the copying flag is set to "1", and at step S83 when it is set to "0". Subsequently, other indication processings are executed at step S84 so that this subroutine can be completed.

FIG. 24 shows a subroutine for the processing of copying system to be executed at step S5 of the main routine.

First, whether the ADF mode flag is set to "1" or not is checked at step S90. When set to "1", whether copying flag is set to "1" or not is checked at step S91. Since the copying operation is allowed when the copying flag is set to "1", a subroutine for the control of ADF 30 is executed at step S95, and the processing goes to step S97. When the ADF mode flag is judged to be set to "0" at said step S90, whether the copying flag is set to "1" or not is checked at step S96. When set to "1", the processing goes to step S97. When the copying flag is judged to be set to "0" at steps S91 and S96 respectively, the processing returns to the main routine.

When the non-sorting mode flag, sorting mode flag and grouping mode flag are verified to be set to "1" at steps S97, S100 and S102 respectively, a subroutines for the non-sorting mode, sorting mode and grouping mode can be executed at steps S99, S101 and S104 respectively. Further, a subroutine for copying operation is executed at step S105, and subroutines for other processings are executed at step S106.

The subroutines to be executed at said steps S99 and S104 can be executed by the procedures similar to the conventional ones, so that the details of these procedures are omitted here.

FIG. 25 shows a subroutine for ADF control to be executed at said step S95.

First, whether the documents are present in document tray 31 or not is checked by on-off action of the sensor at step S120. When the documents are present, whether the alarm flag F4 is set to "1" or not is checked at step S133. Said alarm flag F4 is set to "1" at step S134 which will be explained later, but, when set to "1", said flag is reset to "0" at step S134. Then, document supply processing subroutine is executed at step S121, document size detection subroutine at step S122 and document transport subroutine at step S123. On the other hand, when the documents have run out, whether the document counter registers "0" or not is checked at step S130. When "0" is registered, the alarm flag F4 is set to "1" at step S132, and the processing returns to the main routine.

On the other hand, whether optical unit 4 has scanned each copy for several minutes or not is checked at step S124. When the result is "Yes", scanning completion flag is set to "1" at step S125. Then, that the scanning completion flag is set to "1" is confirmed at step S126. The scanning completion flag is reset to "0" at step S127. Document ejection processing subroutine is executed at step 8128. Subroutines for other processings are executed at step S129.

Further, the ADF control subroutine is similar to the conventional one, so that the details of the subroutines to be executed at said steps S121, S123 and S128 are omitted here.

FIGS. 26*a* through 26*d* show a subroutine of sorting mode to be executed at said step S101. The subroutine differentiate the action of sorter bins 60 depending on whether the finishing mode is selected or not. This is because the order of distributing sheets to the bins 60 corresponds to the order of taking out the sheets from the bins 60, and such order are dependent on whether the finishing mode is selected or not. When the finishing mode is selected, the sheets are distributed first to the bottom bin 60 so that the sheet can readily be transported to stapling unit 90, and when not selected, the sheets are distributed first to the top bin 60 so that the operator can directly take out the sheets from the bins 60.

More particularly, whether the finishing mode flag is set to "1" or not is checked at step S140. When set to"1", whether the sheets are present or not in the bins 60 is checked by on-off action of the sensor Se5 at step S141. When the sheets are absent, whether alarm flag F11 is set to "1" or not is checked at step S141*a*. This alarm flag is set to "1" at steps S158 and S161 which will be explained later, but, when said alarm flag F11 has been set to "1", it is reset to "0" at step S141*b*, and the inhibition of system operation is cancelled at step S141*c*. Then, whether the bottom bin detection switch SW1 is turned on or not, that is, whether or not the bins 60 are at the bottom bin position X1, the home position of the bins 60 when the finishing mode is selected, and whether the distribution of the sheets in the finishing mode is possible are checked at step S142. Thus, when the result of the check is "Yes", the processing goes to step S148, and direction-of-rotation flag is reset to "0" in order to reverse the action of the bin for the sorting operation or to reverse the rotation of floating cam motor (not shown in the drawing). When the result of the check is "No" at step S142, the processings at steps S143 through S147 are executed to shift the bins 60 to the bottom bin position X1. That is, the floating cam motor is made to turn towards its normal direction at step 8143, and sorter weight is applied at step S144. The sorter weight means the device to inhibit the copying operation so that the sheets will not be fed to the sorting unit 41 while the bins 60 is in motion. When that the bottom bin detection switch SW1 is turned on is confirmed at step S145, the floating cam motor is turned off at step S146. The sorter weight is cancelled at step S147. The direction-of-rotation flag for the floating cam 50 is reset to "0" at step S148 in order to reverse the direction of rotation of the floating cam 50 from said step on.

On the other hand, when the finishing mode is not selected, whether the sheets are present or absent in the bins 60 is checked by on or off of the sensor Se5 at step S149. When the sheets are absent, whether the top bin detection switch SW2 is turned on or not, that is, whether or not the bin 60 is at the top bin position X2, the home position at the time of the finishing mode, and whether the distribution of the sheets in the finishing mode is possible or not are checked at step S150. Thus, when the result of the check is "Yes", the processing proceeds to step S156, and the direction-of-rotation flag for floating cam 50 is set to "1" to permit the normal rotation of floating cam 50. When said result is "No", the processings at steps S151 through S155 are executed to shift the bins 60 to top bin position X2. That, is, the rotation of the floating cam 50 is reversed at step S151; the sorter weight is applied at step S152; that the top bin detection switch SW2 is turned on is confirmed at step S153; and the motor of the floating cam 50 is turned off at step S154. Subsequently, the sorter weight is cancelled at step S155. The direction-of-rotation flag for the floating cam 50 is reset to "1" at step S156 to let the floating cam 50 rotate towards its normal direction from said step on.

Further, when the presence of the sheets in the bins 60 is detected at said steps S141 and S149, whether the sheet counter registers "0" or not is checked at steps S157 and S160. When found to be "0", alarm flag F11 is set to "1" at step S158 and S161 in order to prepare for lighting LED 160 for indicating the need of the removal of the sheets. The system operation is inhibited at steps S159 and S162, and the processing returns to the main routine.

Then, whether the ejection switch SW3 of the copying machine 1 is oa-edge or not is checked at step S163. That is, when the end of the sheets have arrived to the ejection switch SW3, the sorter transport motor is turned on at step S164, and whether the sorter ejection sensor Se1 is off-edge or not is checked at step S165. More particularly, the sheet is judged to have distributed to the bin 60 when the rear end of the sheet has passed the ejection sensor Se1. When the ejection sensor Se1 is off-edge, the timer of the sorter transport motor is started at step S166. The number of sheets to be counted is increased at step S167, and the sorter transport motor is turned off at step S169 when the time set by the timer of the sorter transport motor has passed at step S168. Subsequently, whether the sheet transported last is the last sheet or not is checked at step S170. When found to be the last sheet, the direction-of-rotation flag for the floating cam 50 is reversed at step S171. That is, when the direction-of-rotation flag for the floating cam 50 has been set to "0", it is set to "1", and it is reset to "0" when it has been set to "1". When said sheet is not the last sheet, the position of the direction-of-rotation flag for the floating cam 50 is checked at step S172 in order to continue the sorting operation. When said position is found to he "0", the rotation of the floating cam motor is reversed at step S173, and, when said position is found to be "1", the rotation of said motor is normalized at step S174. More particularly, the sheets are distributed by moving them up and down from the bottom bin 60 to the top bin 60 or from the top bin 60 to the bottom bin 60.

Then, whether the finishing mode flag is set to "1" or not is checked at step S175. When set to "1", the number M of the sheets for each bin 60 is calculated at step S175*a*, and the number M of the sheets per bin and the allowable number Cb of sheets for stapling(refer to step S52) are compared at step S176. When the number M of sheets per bin is larger than the allowable number Cb of sheets for stapling, the alarm flag F5 is set to "1" at step S177 in order to prevent the defective stapling, and the preparation is made for indicating that the number M of sheets is too large for the capacity of the stapling unit 90. The copying flag is set to "0" at step S178. Whether the print switch is turned on or not is checked at step S179. Whether the ADF start switch is turned on or not is checked at step S180. When either one of said print switch or said ADF start switch is turned on, that is, when the operator's will for the execution of the copying operation regardless of the alarm is confirmed, the finishing mode flag is reset to "0" at step S181; the alarm flag F5 is reset to "0" at step S182; and the copying flag is set to "1" at step S183 for enabling the execution of the processing in the sorting mode so that this subroutine can be completed.

When the operator wants to terminate the copying operation and execute the finishing processing when the alarm for the oversupply of the sheets for the capacity of the stapling unit 90 during the execution of the processing at steps S176 and S177, the operator is required only to turn on the finish start switch (Refer to step S205).

FIG. 27 shows a subroutine for copying operation processing to be executed at said step S105.

First, whether optical unit 4 has scanned each copy for several minutes or not is checked at step S190. When this result is "Yes", the scanning completion flag is set to "1" at step S191. When the result is "No", a subroutine for the processing of copying process is executed at step S192. This subroutine is designed for the execution of the ordinary copy process by the copying machine 1. The details of this subroutine are omitted here.

Then, after confirming that the scanning completion flag is set to "1" at step S193, the scanning completion flag is reset to "0" at step S194; the copying flag is reset to "0" at step S195; and the subroutines for other processings are executed at step S196.

Figure 28A:
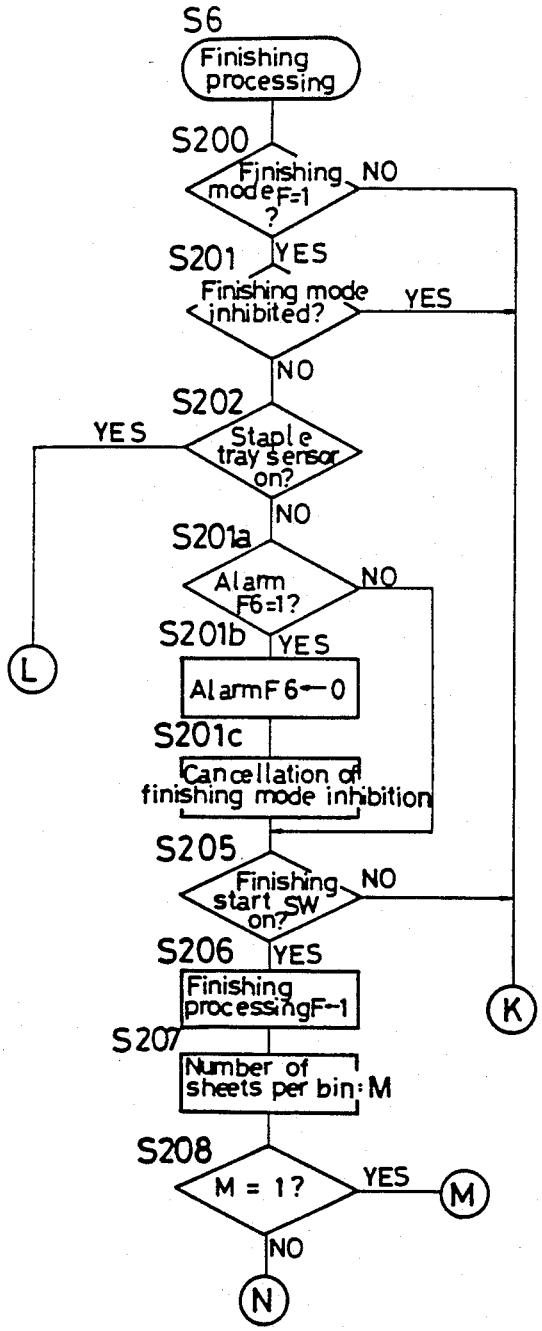
Figure 28B:
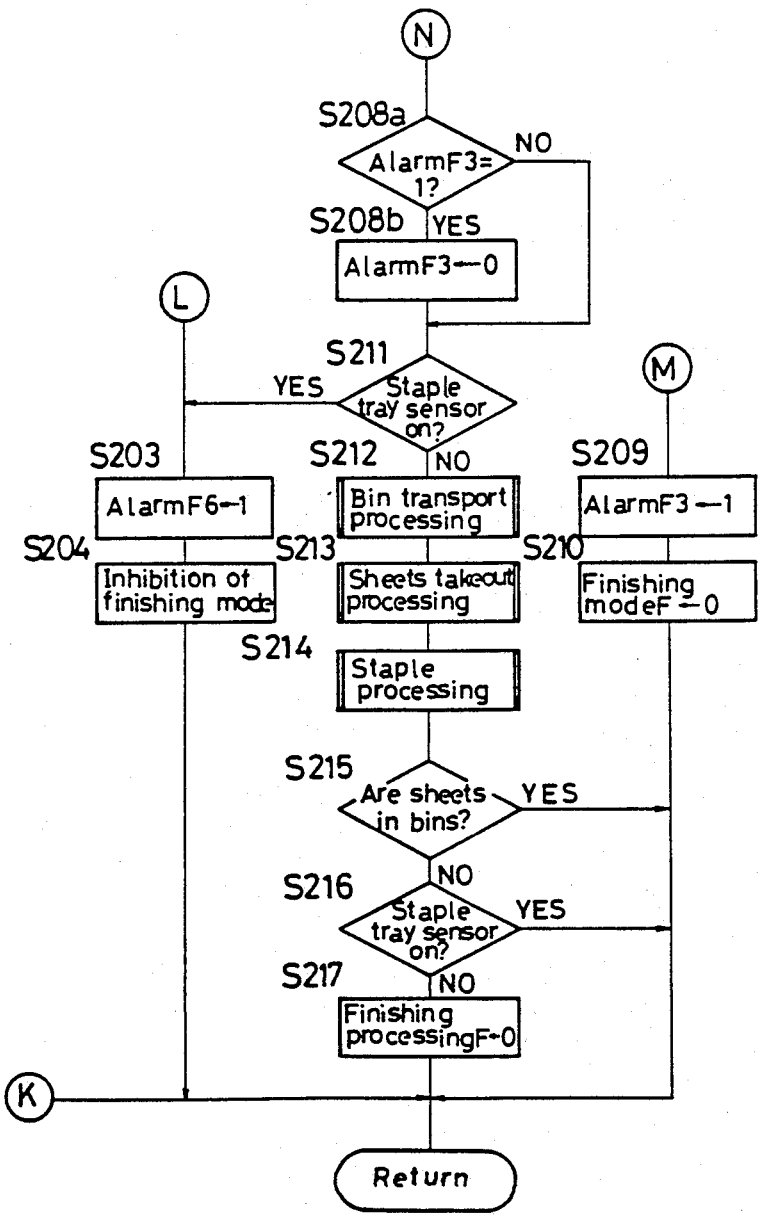

FIGS. 28*a*, 28*b* show a subroutine for finishing processing to be executed at step S6 of the main routine.

First, whether the finishing mode flag is set to "1" or not is checked at step S200. When set to "0", the processing is terminated at once. When set to "1", whether the finishing mode is inhibited or not is checked at step S200. When not inhibited, the presence or absence of the sheets is checked by on-off action of the sheet detection sensor Se6 on staple tray 91 at step S202. When the presence of the sheets on the tray 91 is detected from that the sheet detection sensor Se6 is on, the alarm flag F6 is set to "1" at step S203 in order to prepare for indicating the necessity of removing the sheets from the staple tray 91 so that the troubles such as the mixing of the sheets already on the staple tray 91 with the sheets transported later onto the staple tray 91 and the oversupply of the sheets for the capacity of stapling unit 90 can be prevented, and the finishing mode is inhibited at step S204.

On the other hand, that said finishing mode is not inhibited at step S201 and that the sheets are not present on the staple tray 91 are confirmed at step S202, whether said alarm flag F6 is set to "1" or not is checked at step S201*a*. When set to "1", the flag is reset to "0" at step S201*b*, and the inhibition of finishing mode is cancelled at step S201*c*. At step S205, whether the finishing start switch 158 is turned on or not is checked. When turned on, the finishing processing flag is set to "1" at step S206. The number of sheets per bin is calculated at step S207. At step S208, whether said number M of sheets is "1" or not is checked at step S208. More particularly, when one sheet distributed to each of bins 60, there is no need of stapling. Thus, when the number M of sheets per bin is found to be "1" at step S208, the alarm flag F3 is set to "1" at step S209 in order to prepare for indicating that the finish mode is impossible, and the finishing mode flag is reset to "0" at step S210 to cancel the finishing mode.

When the number M of sheets per bin is not "1", whether said alarm flag F3 is "1" or not is checked at step S208*a*. When set to "1", the flag is reset to "0" at step S208*b*. Then, whether the sheets are present or not on the staple tray 91 is checked again by on-off action of the sensor Se6 at step S211. When the sheets are present, the processings at said steps S203 and S204 are executed not only for giving alarm but also for cancelling the finish mode so that the troubles such as stapling unnecessary sheets and defective stapling as are described previously. When the sheets are absent, and only in such case, the finishing processing may be executed. That is, a subroutine for the bin transport processing is executed at step S212, a subroutine for the takeout of sheets at step S213, and a subroutine for staple processing at step S214 respectively. Then, when these processings have been completed, the presence or absence of the sheets in each of bins 60 is checked at step S215 and the presence or absence on the staple tray 91 is checked at step S216. When both the sheets are absent, the finishing processing flag is reset to "0" at step S217.

Further, in the case of said finishing processing subroutine, that the sheets have been removed from the staple tray 91 has to be confirmed at step S202, and then the alarm flag F6 has to be reset to "0" at step S201*b* to cancel the inhibition of the finishing mode. The finishing processing may be resumed automatically through the timer or by the input through the finishing start switch after cancelling the inhibition of the finishing mode.

FIG. 29 shows a subroutine for the bin transport to be executed at said step S212.

The presence or absence of the sheets in bins 60 is checked by on-off action of the sensor Se5 at step S220, and the processing is terminated at one when the sheets are absent. Actually, such condition cannot occur, but it can occur when the operator takes out the sheets from the bins 60 immediately after completing the copying operation. When the sheets are present, they are detected by whether the bottom bin detection switch SW1 is on or not at step S221. When the switch SW1 is not on, the motor of the floating cam 50 is turned towards its normal direction at step S222 in order to shift the floating cam 50 to bottom bin position X1, and said motor is turned off at step S224 when it is confirmed that a switch for detecting the rotation of the floating cam 50 is off-edge at step S223. The processings at steps S222, S223 and S224 will be continued until the floating cam 50 moves to the bottom bin position X1.

When the floating cam 50 has moved to the bottom bin position X1, that is, when the bottom bin detection switch SW1 is turned on at said step S221, the fixed cam motor is turned towards its normal direction at step S225, and whether the fixed cam rotation detection sensor Se2 is on-edge or not is checked at step S226. When sensor Se2 is on-edge, this indicates that the bin 60 at the bottom bin position X1 has descended to the sheet takeout position X3, and this is followed by the increment of the bin counter at step S227 and turning off of the fixed cam motor at step S228.

Then, whether the reading of the bin counter is equal to the set number A (Refer to step S10) or not is checked at step S229. When the reading of the bin counter is smaller than the set number A, the processing for letting the next bin 60 move to the sheet takeout position X3 is executed. That is, the rotation of the floating cam motor is reversed at step S230, and when the off-edge of the sensor for detecting the rotation of the floating cam motor is confirmed at step S231, the floating cam motor is turned off at step S232. This causes the next bin 60 to move to the bottom bin position X1. These steps S230, S231 and S232 will be repeated until the reading of the bin counter becomes equal to the set number A.

When the reading of the bin counter has become equal to the set number A, the stapling operation is completed, and a subroutine for resetting the bin position is executed at step S233 after confirming that the sheets are not present in the bins 60.

FIG. 30 shows a subroutine for the sheet takeout processing to be executed at said step S213. This subroutine is for the execution of the processing for transporting the sheet which have been brought down to the sheet takeout position X3 by the bins 60 to the staple tray 91 by the sheet transport unit 80.

First, whether the sheets are present in the bin 60 which is coming down to the sheet takeout position X3 or not is checked by the on-off action of the sensor 8e5 at step S240. When the sheets are absent, the alarm is given (by the system not shown in the drawings), and the processing proceeds to step S246. When the presence of the sheet is confirmed, whether or not the fixed cam rotation detection sensor Se2 is off-edge, or whether the fixed cam 70 has started to turn towards its normal direction or not is checked at step S241. When found to be off-edge, or when the bin 60 has begun descent to the sheet takeout position X3 following the start of the normal rotation of the fixed cam 70, the solenoid of the pinch roller 76 is turned on at step S242, and the pinch roller solenoid timer is started at step S243. The sheets on the bin 60 is inserted between the takeout roller 75 and the pinch roller 76 at the sheet takeout position X3 when the sheet is caused to come down as the fixed cam 70 turns towards its normal direction.

Then, whether the fixed cam rotation detection sensor Se2 is on-edge or not, that is, whether the bin 60 has descended completely to the sheet takeout position X3, is checked at step S244. When found to be on-edge, the sheet takeout motor is turned on at step S245, and this causes the sheets to be transported to staple tray 91 by the rollers 75, 76, 81*a* and 81*b*. When the expiration of the time set by the solenoid timer of pinch roller 76 is confirmed at step S246, the pinch roller solenoid is turned off at step S247. As a result, the pinch roller 76 withdraws upward away from the takeout roller 75. This is because the pinch roller 76 needs to move away from the sheet takeout position X3 before the next bin 60 starts to descend from the bottom bin position X1 so that the interference with the sheets distributed among the bins 60 can be prevented.

Then, the supply of the sheet to the staple tray 91 is confirmed by sensor Se6, which turns on when the sheet is supplied, at step S248, the sheet takeout motor is turned off at step S249 to terminate the execution of this subroutine.

FIG. 31 shows a subroutine for staple processing to be executed at said step S214.

First, whether the sensor Se6 of the staple tray 91 is oa-edge or not is checked at step S251. This sensor Se6 is turned on when the sheets are supplied onto the tray 91. Thus, when said sensor Se6 is on-edge, vibration motor 93 is turned on at step S252 in order to true up the sheets on the tray 91, and the timer of the vibration motor is started at step S253. On the other hand, when said sensor Se6 is found to be not on-edge at said step S251, and the sensor Se6 is on at step S254, or when the sheet on the tray 91 is detected, the processing proceeds to step S255.

Then, when the expiration of the time set by the timer of the vibration motor is confirmed at step S255, the vibration motor is turned off at step S256, and staple motor is turned on at step S257. Then, when the rotation detection sensor Se4 of the staple motor is found to be on-edge at step S259, or when the sheets are bound with staple 106 following the movement of the head 105, the stapling motor is turned off at step S260, and the stopper solenoid is turned on at step S262. This causes the stopper 96 to withdraw from above the tray 91, and the sheets slide downward onto stack tray 111.

Then, when the sensor 8e6 of the staple tray 91 is found to be off-edge at step S263, or when the ejection of the sheets into the stack tray 111 is detected, stopper solenoid is turned off at step S264 to return the stopper 96 on the tray 91, and the execution of this subroutine is terminated.

Furthermore, the copying apparatus according to the present invention can be controlled by various procedures other than that described in the foregoing. Such other control procedures will be explained in the following.

Figure 32A:
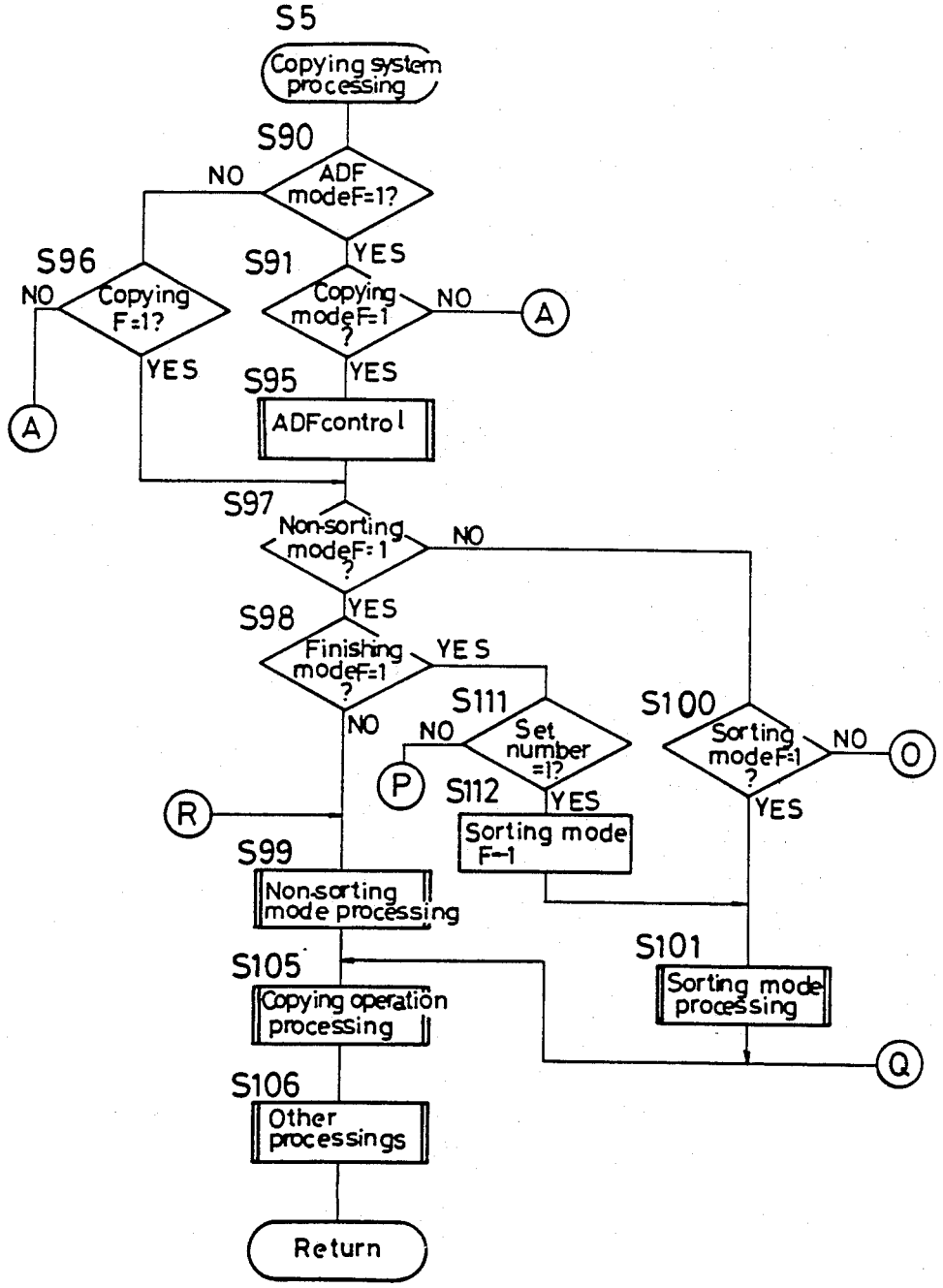
Figure 32B:
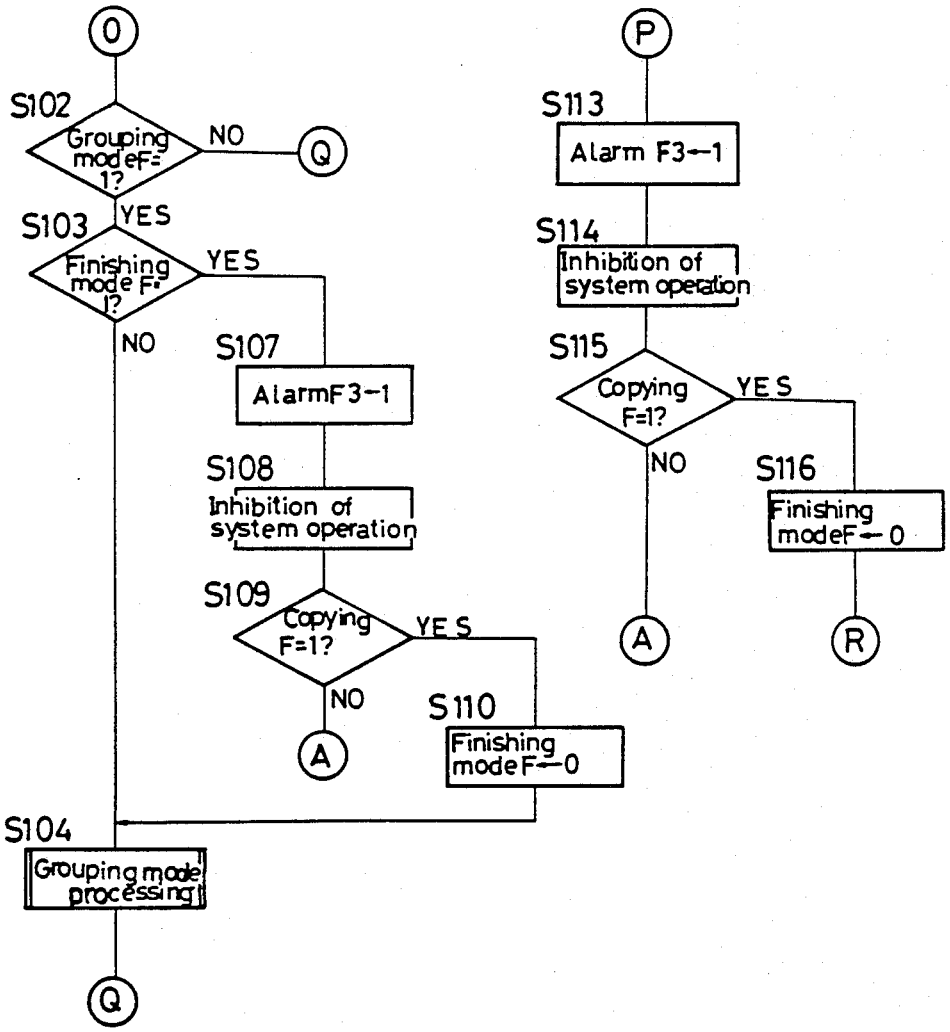

FIGS. 32*a* and 32*b* show other subroutines for the processing of the copying system to be executed at step S5 of the main routine.

First, whether the ADF mode flag is set to "1" or not is checked at step S90. When set to "1", whether the copying flag is set to "1" or not is checked at step S91. When set to "1", this means that the processing for copying operation is allowable, so that the subroutine for the ADF control is executed at step S95, and the processing proceeds to step S97. Then, when the ADF mode flag is found to be set to "1" at said step S90, whether the copying flag is set to "1" or not is checked at step S96. When set to "1", the processing proceeds to step S97. When the copying flag is found to be set to "0" at steps S91 and S96 respectively, the processing returns to the main routine.

Then, whether the non-sorting mode flag is set to "1" or not is checked at step S97. When set to "1", and non-sorting mode is selected, whether the finishing mode flag is set to "1" or not is checked at step S98. When not set to "1", the system is operated as it is. That is, the subroutine for the processing in non-sorting mode is executed at step S99, the subroutine for the processing for copying operation at step S105, and other subroutine at step S106 respectively.

When the result of the check at said step S98 is "Yes", or when the finishing mode has been selected, whether the set number A which has been inputted at said step S10 is "1" or not is checked at step S111. When the set number A is found to be "1", the sorting mode flag is set to "1" at step S112, and the subroutine for the processing in sorting mode is executed at step S101, and said steps S105 and S106 are also executed. When the set number A is not "1", the sheets distributed to the bin 60 in the non-sorting mode need not to undergo the finishing processing, so that alarm flag F3 is set to "1" at step S113, and the system operation is inhibited at step S114. Said alarm flag F3 is for indicating that the processing in the finishing mode is not allowed. Then, when the copying flag is found to be set to "1" at step S115, or when it is confirmed that the operator wants to execute the copy processing regardless of the alarm, the finishing mode flag is reset to "0" at step S116 to inhibit the processing in the finishing mode, and the copy processing is executed at said steps S99, S105 and S106.

On the other hand, when the mode other than the non-sorting mode is found to have been selected at said step S97, whether the sorting mode flag is set to "1" or not is checked at step S100. When the sorting mode has been selected and set to "1", the subroutine for the processing in the sorting mode is executed at step S101, and said steps S105 and S106 are also executed. When the sorting mode is found not to have been selected at said step S100, whether the grouping mode flag is set to "1" or not is checked at step S102. When the grouping mode has been selected and set to "1", whether the finishing mode flag is set to "1" or not is checked at step S103. When not set to "1", the subroutine for grouping processing is executed at step S104, and also said steps S105, and S106 are executed. When the finishing mode is found to have been selected at said step S103, the sheets distributed to the bins 60 in the grouping mode do not require stapling, so that the alarm flag F3 is set to "1" at step S107 in order to prepare for indicating that the finishing mode is not allowed, and the operation of the system is inhibited at step S108. Then, when it is confirmed that the copying flag is set to "1" at step S109, and the operator wants to execute the copy processing, the finishing mode flag is reset to "0" at step S110 to inhibit the processing in the finishing mode, the grouping processing at said steps S104, S105 and S106 and the subroutine for copy processing are executed respectively.

FIG. 33 shows a subroutine for the bin transport processing to be executed at step S212, which is applicable to other embodiments.

First, the presence or absence of the sheets in the bins 60 is checked by the on-off action of the sensor Se5 at step S220. When the sheets are found to be absent, the presence or absence of the sheets on the staple tray 91 is checked by the on-off action of the sensor Se6 at step S235. When the sheets are absent and the sensor Se6 is off, the LED 159 for indicating the start of finishing operation is turned off at step S236 (primarily, the LED 159 is kept turned off at this stage) to complete this subroutine. Actually, the situation such that the sheets are absent in the bins 60 at the time of the start of the finishing operation cannot occur unless the operator takes out the sheets from the bins 60 immediately after completing the copying operation. When the sheets are present in the bins 60, it is detected by the on-off action of the bottom bin detection switch SW1 at step S221 When the switch SW1 is not turned on, the motor of the floating cam 50 is turned towards its normal direction at step S222 in order to let said floating cam 50 to the bottom bin position X1, and the LED 159 for indicating the start of finishing operation is turned on at step **S222*a* to indicate that the finishing operation is in progress. Then, when the rotation detection switch of floating cam 50 is found to be off-edge at step S223, the motor of floating cam 50 is turned off at step S224. Then, the processing at said steps S222 through S224 will be continued until the floating cam 50 moves to the bottom bin position X1**.

When the floating cam 50 has moved to the bottom bin position X1, or when the bottom bin detection switch SW1 is found to have been turned on at said step 221, the fixed cam motor is turned towards its normal direction at step S225, and said LED 159 is turned on to indicate that the finishing operation is in progress. Then, whether the rotation detection sensor Se2 of the fixed cam 70 is on-edge or not is checked at step S226. When the sensor Se2 is on-edge, this means that the bin 60 has descended to the sheet takeout position X3 from the bottom bin position X1. Then, the increment of setting for the bin counter is made at step S227, and the fixed cam motor is turned off at step S228.

Then, whether the reading of the bin counter is equal to the set number A (refer to step S10) or not is checked at step S229. When the reading of the bin counter is smaller than the set number A, the processing for letting the next bin 60 move to the sheet takeout position X3 is executed. That is, the rotation of the floating cam motor is reversed at step S230. When the rotation detection sensor of the floating cam 50 is found to be off-edge at step S231, the floating cam motor is turned off at step S232. This causes the next bin 60 to move to the bottom bin position X1. These steps S230, S231 and S232 will be repeated until the reading of the bin counter becomes equal to the set number A.

When the reading of the bin counter has become equal to the set number A, the stapling process and this subroutine are completed.

On the other hand, when the stapling operation has been completed by executing the subroutines described in said FIGS. 30 and 31, this means the completion of the finishing operation. After confirming that no sheets are left in the bins 60 at steps 8220 and S235, the LED 159 is turned of at sleep S236 to cancel the indication of the finishing operation in progress.

Figure 26A:
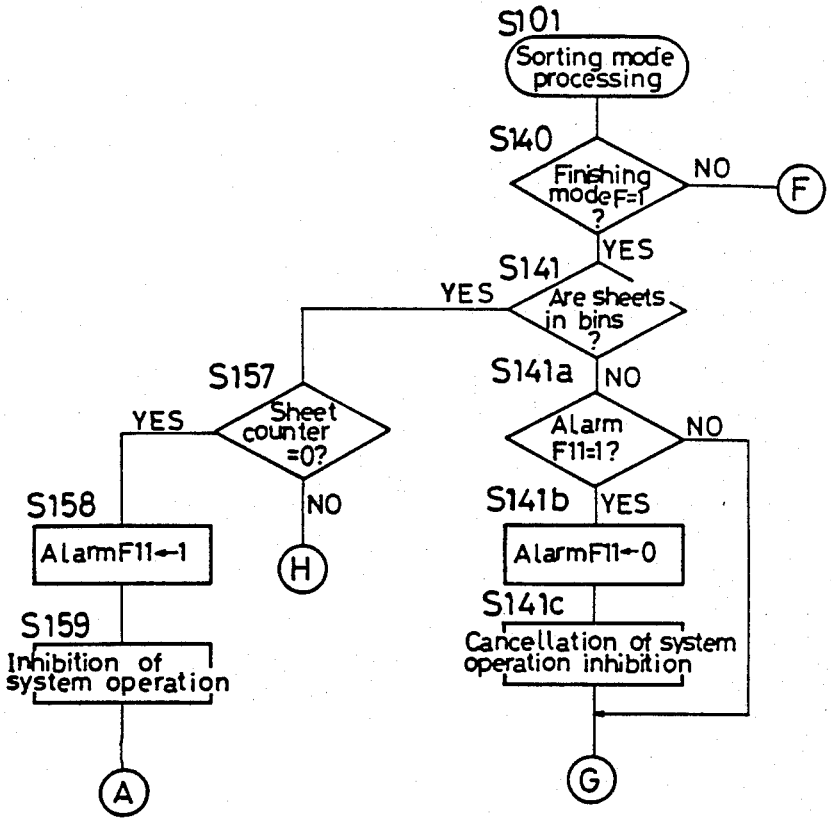
Figure 26B:
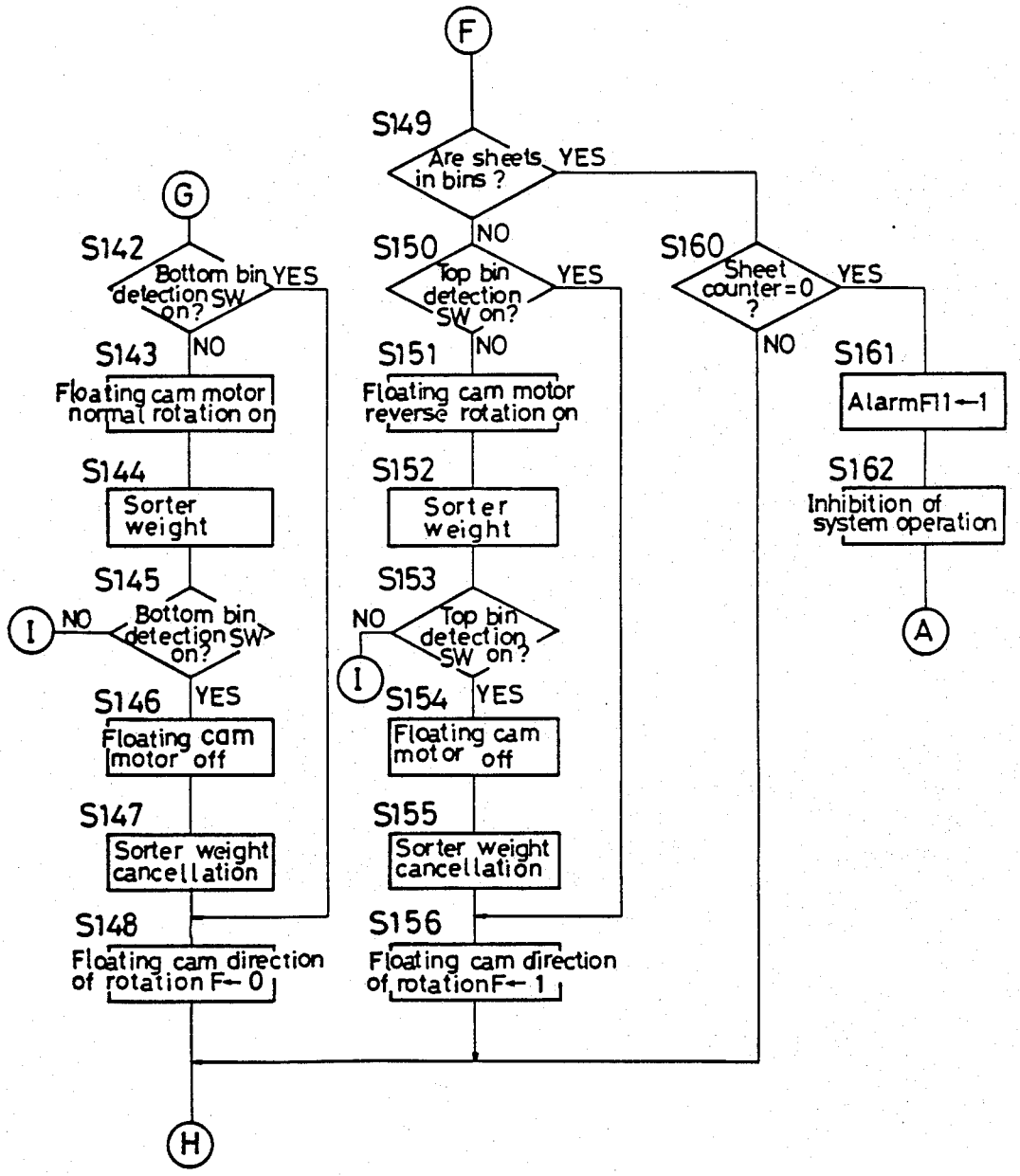
Figure 26C:
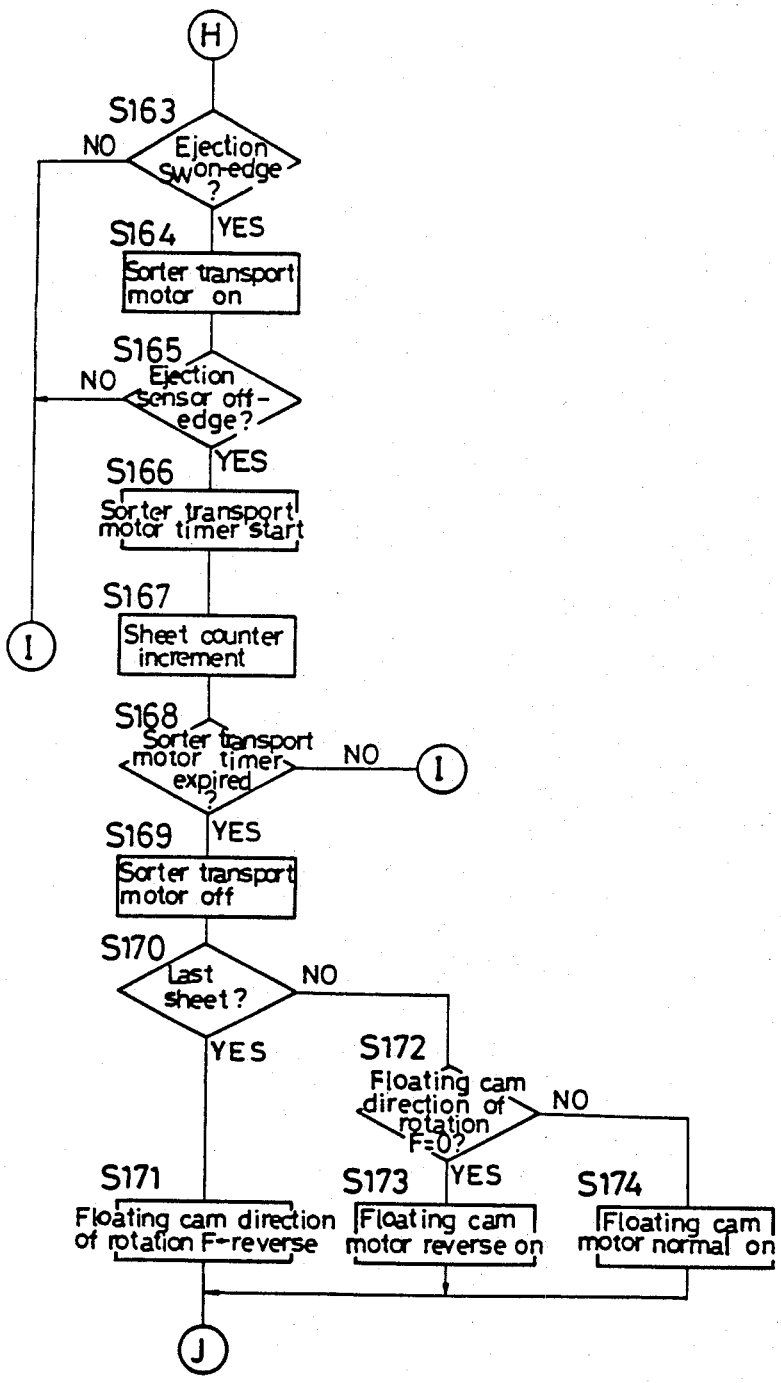
Figure 26D:
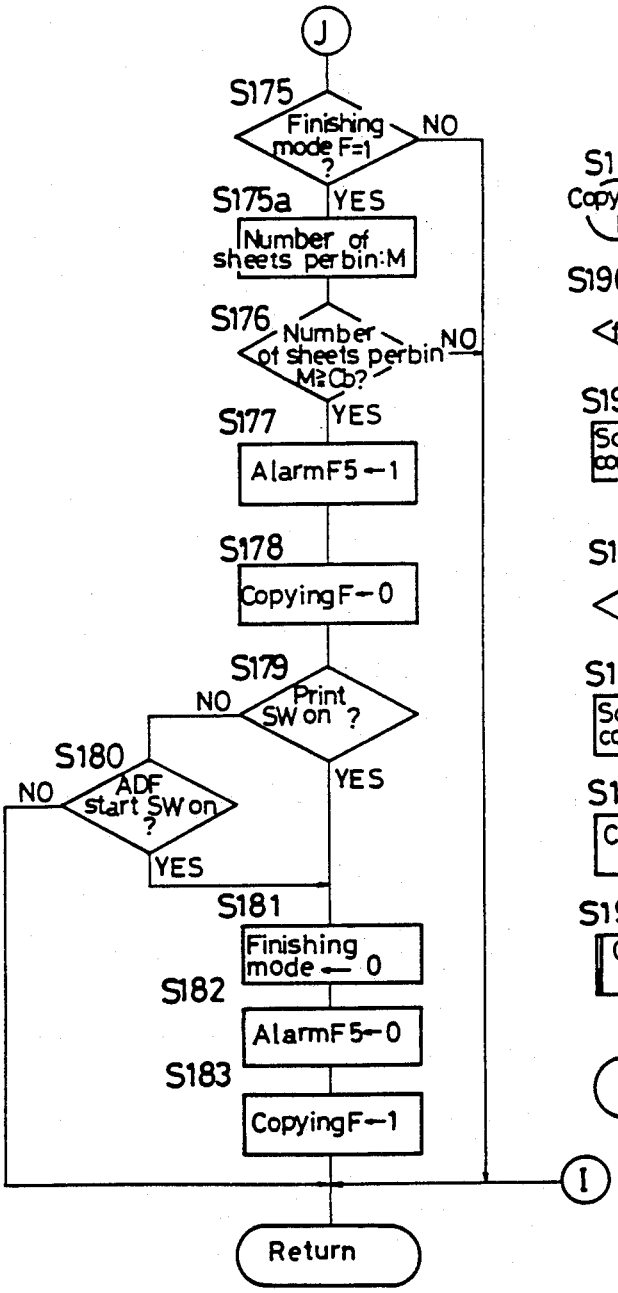

FIG. 34 shows the part of a subroutine for the processing in the sorting mode described in said FIGS. **26*a* through 26*d*, which is applicable to other embodiments, and corresponds to said FIG. 26*d*. Thus, the rest of the part of this subroutine is similar to the contents of said FIGS. 26*a* through 26*c***.

In this subroutine, the processing for distributing the sheets to the bins 60 is executed at said steps S140 through S171, S173 and S175 respectively. Then, whether the finishing mode flag is set to "1" or not is checked at step S175. When set to "0", the processing proceeds to step S184. When set to "1", the number M of sheets per bin is calculated at step **S175*a*, and the number M of sheets per bin is compared with the allowable number Cb of sheets for stapling at step S176. When the number M of sheets per bin is less than the allowable number Cb of sheets for stapling, the processing returns to the main routine. When the allowable number Cb of sheets for stapling is reached, the processing for preventing defective stapling and the processing for continuing the sorting mode will be executed at steps S184** and on.

More particularly, whether the ADF mode is set to "1" or not is checked at step S184. When set to "1", the presence or absence of the documents on the document tray 31 is checked by on-off action of the sensor. When the documents are absent, the processing returns to the main routine, and when are present, the processing proceeds to step S187. On the other hand, when ADF mode is found to be set to "0" at step S184, whether the print switch is turned on or not is checked at step S186. When it has been turned on, the processing proceeds to step S187. When it has not been turned on, the processing returns to the main routine.

When the result is "Yes" at said steps S185 and S186, or when the condition permits the continuation of copying operation, the finishing mode is reset to "0" at step S187; the finishing mode indication LED 157 is turned off at step S188; and non-finishing mode indication LED 156 is turned on to terminate this subroutine. This causes the finishing mode to be cancelled, and, from this point on, the copying operation in sorting mode will be continued.

FIGS. 35 and 36 show a subroutines for finishing processing and bin transport processing which are described in FIGS. 28*a*, 28*b* and 29 but applicable to other embodiments. FIG. 35 corresponds to said FIG. 28*b*, and the first half of the subroutine for the finishing processing shown in these figures is common to that of said FIG. 28*a*.

For the finishing processing, the subroutine for the bin transport processing is executed at step S212, the subroutine for sheet takeout operation at step S213 and the subroutine for staple processing at step S214 respectively.

Then, whether the bin counter has counted until the number B of stapling set at said step S51*a* is reached or not is checked at step S215*a*. The set number in the bin counter is increased for each finishing operation at step S227, and when the number B of stapling has not been reached, the processing returns to the main routine in order to repeat the subroutine for the finishing operation. On the other hand, when the number of sheets registered by the bin counter is found to have reached the set number B of stapling at step S215*a*, the presence or absence of the sheets on the staple tray 91 is checked at step S216. When the sheets are absent, the finishing processing flag is reset to "0" at step S217 to finish this subroutine. In this case, the remainder of the sheets left in the bin 60 without undergoing the stapling process.

FIG. 36 shows other subroutine for bin transport processing. In this subroutine, when the bin 60 at the bottom bin position X1 has descended to the sheet takeout position X3 through the normal rotation of the fixed cam 70, whether the number registered by the bin counter is equal to the number B of stapling or not is checked at step S229*a* (refer to steps S221, S225 through S228). When the number registered by the bin counter is less than the number B of stapling, the processing for letting the next bin 60 move to the sheet takeout position X3 is executed in order to continue the stapling operation. That is, the rotation of the floating cam motor is reversed at step S230, and when the off-edge of the rotation detection sensor for the floating cam 50 is confirmed at step S231, the floating cam motor is turned off at step S232. This causes the next bin 60 to move to the bottom bin position X1. These steps S230, S231 and S232 will be repeated until the number registered by the bin counter becomes equal to the number B of stapling.

When the number of sheets registered by the bin counter has become equal to the number B of stapling, this means that the stapling for the necessary number of bunches of sheets has been completed. After confirming that the sheets have been taken out from the bins 60 at step S233, the subroutine for resetting bin position is executed at step S234.

FIG. 37 shows the part of a subroutine for finishing processing which has been described in said FIGS. 28*a* and 28*b* but applicable to other embodiments. Also, FIG. 37 corresponds to said FIG. 28*b*. Thus, the rest of this subroutine is common to said FIG. 28*a*.

The subroutine for the bin transport processing is executed at step S212, the subroutine for the sheet takeout processing at step S213, and the subroutine for the staple processing at step S214 respectively. Then, the presence or absence of the sheets in the bins 60 is checked at step S215, and the presence or absence of the sheets on the staple tray 91 is checked at step S216 respectively. When the sheets are absent at these steps respectively, the finishing processing flag is reset to "0" at step S217.

On the other hand, when the sheets are found to have been left in the bins 60 at said step S215, or when the stapling operation needs to be continued further, whether the finishing start switch 158 has been turned off or not is checked at step S218. When the switch 158 has been turned on, the processing returns to the main routine in order to continue this subroutine for the finishing operation. When the switch 158 is turned of, or when the operator's will for not continuing the stapling of the sheets from that point on is confirmed, the finishing processing flag is reset to "0" at step S217 to terminate the finishing operation.

FIG. 38 shows a subroutine for the operation of copying system to be executed at step S5 of the main routine, which is applicable to other embodiments.

First, whether the ADF mode flag is set to "1" or not is checked at step S90. When set to "1", whether the copying flag is set to "1" or not is checked at step S91. When set to "1", the copy processing is considered to be allowed, and the presence or absence of the sheets on the tray 9 is checked by on-off action of the sheet detection sensor Se6 on the staple tray 91 at step S92. When the sheet detection sensor Se6 is on, and thus the sheets are found to be present on the tray 91, this situation may cause the troubles such that the sheets left on the tray 91 are stapled together with the sheets newly transported onto the tray 91 and that a bunch of sheets whose number is exceeding the number of sheets allowed for stapling is bound with the staple, so that the alarm flag F6 is set to "1" at step S93 in order to prepare for the indication to alarm for the need of removing the sheets from the staple tray 91, and the operation of the system is inhibited at step S204. When the sheets have been removed from the tray 91 by the operator, and the absence of the sheets on the tray 91 is confirmed at step S92, whether said alarm flag F6 is set to "1" or not is checked at step S92*a*. When set to "1", the flag F6 is reset to "0" at step S92*b*. The subroutine for ADF control is executed at step S95, and the processing proceeds to step S97. The inhibition of the system operation at said step S94 is cancelled when the operator has removed the sheets from the tray 91 as is described previously, but, when the higher safety and operability are desired, the separate switch for cancelling may be provided so that the cancellation can be made by the cancellation signal.

On the other hand, when the ADF mode flag is found to have been set to "0" at said step S90, whether the copying flag is set to "1" or not is cbecked at step S96. When set to "1", the processing proceeds to step S97. When the copying flag is found to have been set to "0" at both of steps S91 and S96, the processing returns to the main routine.

From the last step on, the steps 897 through S106 have to be executed, but the detailed explanation of these steps will be omitted here, since the processings at these steps are similar to those explained in reference to said FIG. 24.

FIGS. 39*a* and 39*b* show a subroutines for the staple processing to be executed at said step S214.

First, whether the stapler 100 is set in place or not is checked at step S250 by on or off of the stapler detection switch SW4. This switch SW4 is turned on when the stapler 100 is set in place. Thus, when this switch SW4 is off, this indicates the poor setting of the stapler 100 at step S298, and the stapling operation is inhibited at step S299 to terminate this subroutine. When said switch SW4 is on, whether alarm flag F7 is set to "1" or not is checked at step S290. This alarm flag F7 is set to "1" at step S277 which will be explained later. When said flag has been set to "1", it is reset to "0" at step S291. The inhibition of the stapling operation is cancelled at step S292, and whether the finishing start switch is turned on or not is checked at step S293. When said switch has been turned on, whether or not poor stapler setting indicated is checked at step S294, when has been indicated, the indication for poor stapler setting is cancelled at step S295, and the inhibition of stapling operation is cancelled at step S296.

Then, whether the finishing start switch is turned on or not is checked at step S297. When turned on, whether the sensor Se6 of the staple tray 91 is on-edge or not is checked at step S251. This sensor Se6 is turned on when the sheets are transported onto the tray 91. Thus, when it is on-edge, the sheets on the tray 91 can be trued up by turning the vibration motor 93 on at step S252, and the timer of the vibration motor is started at step 8253. On the other hand, when the sensor Se6 is found not on-edge at said step S251, and the sensor Se6 is on at step S254, or when found that the sheets are on the tray 91, the processing proceeds to step S255.

Then, when the expiration of the time set by the timer of the vibration motor is confirmed at step S255, the vibration motor is turned off at step S256, and the staple motor is turned on at step S257. When the rotation detection sensor Se4 of the staple motor is found to be on-edge at step S259, or when the sheets are stapled with the staple 106 as the result of the operation of the head 105, the staple motor is turned off at step S260, and the stopper solenoid is turned on at step S262. This causes the stopper 96 to withdraw from above the tray 91, and the sheets slide down onto the stack tray 111 for storage.

When the sensor Se6 of the staple tray 91 is found to be on-edge at step S263, or when the sheets are found to have been ejected into the stack tray 111, the stopper solenoid is turned off at step S264, and the stopper 96 is made to return onto the tray 91.

Subsequently, whether the absence-of-staple detection sensor Se3 is turned on or off is checked at step S281 in order to check whether the staples 106 are almost used up or not. The sensor Se3 is kept turned on as far as the staples 106 are present and turned off while the staples 106 are absent. Thus, when the sensor Se3 is turned off, the alarm flag F7 is set to "1" at step S277 in order to prepare for indicating the absence of the staples 106, and the finishing operation is stopped at step S278. This causes the stapled sheets to be ejected into the stack tray 111, and the operations from this point on will be stopped. The absence of the staples 106 is indicated not only for enabling the operator to readily find the reason when the machine has stopped but also for notifying the time when the replenishment of the staples 106 is needed.

FIG. 40 shows a subroutine for the staple processing to be executed at step S214, which is applicable to other embodiments. FIG. 41 shows a subroutine for detecting the absence of staples 106 to be executed at step S258.

First, whether the stapler 1? ? is set in place or not is checked at step S250 by on or off of the stapler detection switch SW4. This switch SW4 is turned on when the stapler 100 is set in place. Thus, when this switch SW4 is off, the indication LED 162 is turned on at step S300 in order to indicate poor setting of the stapler 100, and this subroutine is terminated. When the stapler detection switch SW4 is off, whether said LED 162 is on or of is checked at step S301. When the LED 162 is on, however, it is turned off at step S302. Then, whether the sensor Se6 of staple tray 91 is on-edge or not is checked at step S251. This sensor Se6 is turned on when the sheets are transported onto the tray 91. Thus, when it is on-edge, the vibration motor 93 is turned on at step S252 to true up the sheets on the tray 91, and the timer of the vibration motor is started at step S253. On the other hand, when the sensor Se6 is found not on-edge at said step S251, and the sensor Se6 is on, or when the sheets are already on the tray 91, the processing proceeds to step S255.

Then, when the expiration of the time set by the timer of the vibration motor is confirmed at step S255, the vibration motor is turned off at step S256, and the staple motor is turned on at step S257. When the rotation detection sensor Se4 of the staple motor is found to be on-edge at step S259, or when the sheets are stapled with the staple 106 as the result of the operation of the head 105, the staple motor is turned off at step S260, and the stopper solenoid is turned on at step S262. This causes the stopper 96 to withdraw from above the tray 91, and the sheets slide down onto the stack tray 111 for storage.

When the sensor Se6 of the staple tray 91 is found to be off-edge at step S263, or when the sheets are found to have been ejected into the stack tray 111, the stopper solenoid is turned off at step S264 to return the stopper 96 onto the tray 91, and the execution of this subroutine is terminated.

FIG. 41 shows a subroutine for detecting the absence of staples to be executed at said step S258, which is applicable to other embodiments.

First, whether the staple motor is turned on or not is checked at step S270. When turned on, the counting of the rotary pulse of the motor is started at step S271, and a timer TA is started at step S272. Then, on confirming that the specified pulse P has been counted at step S273, the timer TA is stopped at step S264, and the timer value TI at this point is compared with the reference value T at step S275. The reference value corresponds to the time (from the start of the stapling operation following the shift of the position of the head 105 caused by the start of staple motor) to the start of counting pulse P where the staples 106 are present. The timer value TI represents the time actually required before the pulse P starts to be counted at the time of the operation of each staple. When the timer value TI is equal to or larger than the reference value T, the stapling operation may be considered to have been done, and the timer TA is reset at step S276 to finish this subroutine.

On the other hand, when the timer value TI is smaller than the reference value T, it may be considered that the staple 106 is absent, whereby the head 105 has been operated for nothing causing the reduction of the torque of the motor and the resultant increase in the number of revolutions of the motor, which eventually has led to the reduction of the time required before starting the count of the pulse P. Thus, the alarm flag F7 is set to "1" at step S277 in order to prepare for indicating the absence of the staples 106, and the finishing operation is stopped at step S278. Then, the timer is reset at step S276. This is necessary in order to prevent the non-stapled sheets from being transported to the stack tray 111 to scatter around if the operation for the subsequent step is continued, since it is found that the stapling operation has taken place for nothing due to the absence of the staples 106, and the sheets on the staple tray 91 have been left unstapled. Also, the indication for the absence of the staples 106 is necessary so that the operator can readily find the reason for the stop of the machine when the machine has actually stopped.

Further, when the staple motor has not been turned on at said step S270, whether the alarm flag F7 is set to "1" or not is checked at step S293. When the alarm flag F7 is set to "0", the subroutine is continued as it is. When set to "1", that the staples 106 have been supplied is confirmed step S279 by confirming that the detection switch SW4 of the stapler 100 has been turned on. Then, the alarm flag F7 is reset to "0" at step S294, and the finishing operation is cancelled at step S280.

More particularly, in this embodiment, a DC motor is used as the driving source of the stapler 100. This DC motor is used for operating the head 105 of the stapler 100 through a cam. In such a stapling system, the torque of the motor required to actually staple the sheets with the staple 106 is more than 2 times that of the idle stapling. Thus, the utilization of the difference in the torque for checking the presence or absence of the staples 106 has been realized in this embodiment. More specifically, the variation of the said necessary torque is detected by measuring the time required for a rotation of a disk 109, utilizing that the number of revolutions of the DC motor is in proportion to its torque. Further, the variation of the required torque can also be detected by measuring the amperage instead of the number of the revolutions of the motor.

FIG. 42 shows the variation of a subroutine for the staple processing described in FIG. 40, and it also incorporates the subroutine for detecting the absence of staples described in FIG. 41.

Thus, at steps S250, S251 through S257, S259 and S260, the same routine as that described in FIG. 40 is executed. At step S261, as described previously, whether the staples 106 are absent or not is checked by measuring the variation of the required torque of the motor according to the number of revolutions of the stapler motor. When the staples 106 are absent, steps S277 and S278 are executed, and the alarm and finishing operations are stopped. When not absent, whether the alarm flag F7 is set to "1" or not is checked at step S293. When set to "1", the alarm flag F7 is reset to "0". Then, stopper solenoid is turned off at step S262 to eject the stapled sheets from the tray 91. When the ejection of the stapled sheets into the stack tray 111 is confirmed at step S263, the stopper solenoid is turned off at step S264 to finish this subroutine.

FIGS. 43*a* and 43*b* show the variation of a subroutine for staple processing to be executed at said step S214.

First, on confirming that the alarm flag F7 is set to "0" at step S293, whether the stapler 100 is in specified position or not checked at step S250 by on or off of the stapler detection switch SW4. The switch SW4 is on when the stapler 100 is set to the specified position. Thus, when the switch SW4 is off, this subroutine is terminated immediately, and, when the switch SW4 is on, whether the sensor Se6 of the staple tray 91 is on-edge or not is checked at step S251. This sensor Se6 is turned on when the sheets are transported onto the tray 91. Thus, when the sensor Se6 is on-edge, the vibration motor 93 is turned on at step S252 to true up the sheets on the tray 91, and the timer of the vibration motor is started at step S253. On the other hand, when the sensor Se6 is not on-edge at said step S251, and it is on at step S254, or when the sheets are on the tray 91, the processing proceeds to the next step S255.

Then, when the expiration of the time set by the timer of the vibration motor is confirmed at step S255, the vibration motor is turned off at step S256, and the staple motor is turned on at step S257. Then, when the rotation detection sensor Se4 is found to be on-edge at step S259, or when the head 105 has shifted its position to staple the sheets with the staple 106, the staple motor is turned off at step S260. Subsequently, whether the staples 106 are absent or not is checked at step S261 by the variation of the required torque of the staple motor according to its number of revolutions. When the staples 106 are not absent, the stopper solenoid is turned off at step S262. This causes the stopper 96 to withdraw from above the tray 91, and the sheets slide down onto the stack tray 111 from the tray 91. When the sensor Se6 of the staple tray 91 is found off-edge at step S263, or when the sheets are found to have been ejected into the stack tray 111, the stopper solenoid is turned off at step S264, and the stopper 96 is returned onto the tray 91 to finish this subroutine.

On the other hand, when the staples 106 are found absent at said step 261, the alarm flag F7 is set to "1" at step S277 in order to prepare for indicating the absence of the staples 106, and the finishing operation is stopped at step S278 to terminates this subroutine. The termination of this subroutine is required in order to prevent the non-stapled sheets on the staple tray 91 from being transported to the stack tray 111 to scatter around by further continuing the operation, since the stapler 100 is found to have operated for nothing without the staples 106. The absence of the staples 106 are indicated so that the operator can readily find the reason for the stop of the machine when the machine has actually stopped.

Further, when that the alarm flag F7 has been set to "1" at said step S277 is confirmed at step S293, whether the stapler detection switch SW4 has been changed from off to on or not is checked at step S285. As explained previously in relation to said step S250, the switch SW4 is for checking whether the stapler 100 is set to specified position or not and designed to become of when the stapler 100 is removed and on when the stapler 100 is set. Thus, that the position of the switch has been changed from off to on means that the stapler 100 has been replenished with the staples 106 and set again after having been removed once. Thus, when the indication at step S285 is "No", this indicates that the staples 106 are not replenished, so that this subroutine is terminated. When the indication is "Yes", this means that the staples 106 have been replenished. Then, the alarm flag F7 is reset to "0" at step S294. The stop of finishing operation is cancelled at step S280. Whether the finishing start switch is turned on or not is checked at step S310. If the said switch has been turned on, the steps after S257 are processed, and the stapling operation is executed.

In this embodiment, like the case of the variation of the embodiment described in FIG. 41, a DC motor is used as the drive power source, which operates the head 105 through the cam unit.

Further, the replenishment of the staples 106 is checked indirectly by the switch SW4, since this switch SW4 detects the presence and absence of the stapler 100. Besides, the device for detecting the presence and absence of the staples 106 itself may be used.

Further, as shown in FIG. 11, a detection sensor Se3 designed to directly detect the presence of the staples 106 may be used so that the absence of the staples 106 can be detected at said step S261. In this case, the absence detection signal is generated before the staples 106 are used up completely.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus, comprising:
means for forming images on sheets;
means capable of selectively distributing the sheets carrying the images formed thereon in either a sorting mode or a non-sorting mode;
means for binding the sheets which have been sorted by said sorting means;
first means for selecting the operation mode of said sorting means;
second means for selecting a binding mode using the binding means or a non-binding mode not using the binding means; and
control means for selecting the operation mode for the sorting means superseding the selection by the first selecting means.

2. A copying apparatus defined in claim 1 comprising:
start instruction input means for starting the operation in the binding mode; and
binding operation control means for enabling the binding means to start its operation in the binding mode when the binding mode is selected.

3. A copying apparatus, comprising:
means for forming images on the sheets;
means capable of selectively distributing the sheets carrying the images formed thereon among a plural number of bins in either a sorting mode or a grouping mode;
first means for selecting the operation mode for said sorting means;
means for binding the sheets which have been sorted by said sorting means;
second means for selecting a binding mode using the binding means or a non-binding mode not using the binding means; and
control means for prohibiting the selection of the binding mode by the second selecting means in response to the selection of the grouping mode by the first selecting means.

4. A copying apparatus, comprising:
means for forming images on sheets;
means for selecting a size of the sheets having the images formed thereon;
means for sorting the sheets carrying the images formed thereon;
means for binding the sheets which have been sorted by said sorting means; and
means for inhibiting the operation of said binding means when the size of the sheet selected by the sheet size selecting means not is in accordance with the size acceptable for the binding operation.

5. A copying apparatus defined in claim 4, wherein the inhibiting means is provided with means for indicating that the selected sheet size is not in accordance with the size acceptable for the binding operation.

6. A copying apparatus, comprising:
means for forming images on sheets;
means for selecting a size of the sheets having the images formed thereon;
means for sorting the sheets carrying the images formed thereon;
means for binding the sheets which have been sorted by said sorting means;
means for selecting a binding mode using the binding means or a non-binding mode not using the binding means;
means for indicating that the size of the sheet selected by the sheet size selecting means is not in accordance with the size acceptable for the binding operation when such size has actually been selected while the apparatus is set to the binding mode;
image forming start instruction input means for starting the image forming operation; and
control means for selecting the non-binding mode when the image forming start instruction is inputted while the indicated by the indicating means is made.

7. A copying apparatus defined in claim 6, wherein the control means is capable of selecting the non-binding mode and cancelling the indication for the sheet size not in accordance with acceptable size.

8. A copying apparatus, comprising:
means for forming images on sheets;
means for sorting the sheets carrying the images formed thereon;
means for counting the number of sheets sorted by said sorting means;
means for binding the sheets which have been sorted by said sorting means;
means for selecting a binding mode using the binding means or a non-binding mode not using the binding means; and
control means for discontinuing the copying operation when the number of sorted sheets has reached a specified number while the sorting operation is continued in the binding mode.

9. A copying apparatus defined in claim 8, wherein the control means is provided with means for indicating discontinuation of the copying operation when it has actually occurred.

10. A copying apparatus defined in claim 8, wherein the control means is capable of not only responding to a copying operation resumption instruction while the copying operation is discontinued but also selecting the non-binding mode to resume the copying operation.

11. A copying apparatus, comprising:
means for forming images on sheets;
means for sorting the sheets carrying the images formed thereon among a plurality of bins;
means for counting the number of sheets sorted among the bins of the sorting means;
means for binding the sheets which have been sorted by said sorting means; and
means for inhibiting the operation of said binding means when the number of sheets counted by the counting means is "1".

12. A copying apparatus defined in claim 11 comprising means for indicating that the operation of said binding means is inhibited.

13. A copying apparatus defined in claim 11, wherein the indicating means is capable of inhibiting the operation of the binding means when the number of sheets registered by the counting means has exceeded the number which is beyond the capacity of the binding means.

14. A copying apparatus, comprising:

means for forming images on sheets;
means for sorting the sheets carrying the images formed thereon;
means for binding the sheets which have been sorted by said sorting means;
binding frequency setting means for setting the number of times of binding to be performed in a certain period of time;
means for counting the number of times of the binding operation; and
control means for stopping the binding operation when the number of times of the binding operation has reached a specified number.

15. A copying apparatus, comprising:
means for forming images on sheets;
means for sorting the sheets carrying the images formed thereon among a plurality of bins;
means for binding the sheets which have been sorted among the bins after taking them out one by one from the bins;
means for sorting the sheets bound by said binding means;
means for inputting an instruction requiring the discontinuation of the binding operation; and
control means for stopping the operation of the binding means in response to the instruction requiring the discontinuation of the binding operation, after completing the binding operation that was in progress when the instruction was received.

16. A copying apparatus, comprising:
means for forming images on sheets;
means for sorting the sheets carrying the images formed thereon among a plurality of bins arranged vertically at specified intervals;
means installed below said sorting means for binding the sheets;
means for transporting the sheets stored in each of said bins to said binding means;
means for selecting a binding mode using the binding means or a non-binding mode not using the binding means; and
control means for enabling the sheets to be sorted to the bins one by one starting from the bottom bin towards the top bin at the time of the operation in the binding mode, and from top bin towards bottom bin at the time of the operation in the non-binding mode.

17. A copying apparatus, comprising:
means for forming images on sheets;
means for sorting the sheets carrying the images formed thereon among a plurality of bins;
means for binding the sheets;
means for transporting the sheets sorted in each of said bins to said binding means;
means for detecting the sheets supplied to said binding means; and
means for inhibiting the start of the operation of both the transporting means and the binding means while the sheets in the binding means are detected by the detecting means.

18. A copying apparatus, comprising:
means for forming images open sheets;
means for sorting the sheets carrying the images formed thereon among a plurality of bins;
means for detecting the sheets stored in the bins of the sorting means;
means for binding the sheets which have been sorted by said sorting means;
means for selecting a binding mode using the binding means or a non-binding mode not using the binding means; and
means for inhibiting the start of the image forming operation in response to the detection of the sheets by the detecting means when the binding mode is selected by the selecting means.

19. A copying apparatus defined in claim 15 comprising means for indicating that the operation of said binding means is inhibited.

20. A copying apparatus, comprising:
means for forming images on sheets;
means for sorting the sheets carrying the images formed thereon;
means for binding the sheets which have been sorted by said sorting means, which is provided at a specified position so as to be able to be mounted and dismounted freely when necessary;
means for detecting whether and binding means is set to the specified position or not; and
control means for controlling the operation of the binding means depending on the result of the detection by the detecting means.

21. A copying apparatus defined in claim 20, wherein the control means is capable of inhibiting the operation of the binding means while the detecting means is detecting that the binding means is not set to the specified position.

22. A copying apparatus, comprising:
means for forming images on sheets;
means for sorting the sheets carrying the images formed thereon;
means with an electromotive stapler driven by an electric motor for binding the sheets which have been sorted by said sorting means;
first means for detecting the amount of load of said electric motor;
second means for detecting the presence and absence of staples depending on the result of the first detecting means; and
control means capable of inhibiting the operation of the binding means when the second detecting means has detected the absence of staples.

23. A copying apparatus defined in claim 22 comprising means for indicating the absence of staples when so detected by the second detecting means.

24. A copying apparatus, comprising:
means for forming images on sheets;
means for sorting the sheets carrying the images formed thereon;
means for binding the sheets which have been sorted by said sorting means;
first means for detecting the absence of staples in the binding means;
second means for detecting the absence of staples in the binding means;
control means capable of not only inhibiting the operation of the binding means depending on the result of the detection by the first detecting means but also cancelling the inhibition of the operation of the binding means depending on the result of the detection by the second detecting means.

25. A copying apparatus, comprising:
means for forming images on sheets;
means for sorting the sheets carrying the images formed thereon;
means for binding the sheets which have been sorted by said sorting means;

means for storing the sheets bound by said binding means;

means for ejecting the bound sheets into the storing means from the binding means;

means for detecting the presence or absence of staples in said binding means; and control means capable of not only inhibiting the operation of the binding means but also for permitting the operation of the ejecting means depending on the result of the detection by the detecting means.

* * * * *

UNITED STATES PATENT AND TRADEMARK OFFICE

CERTIFICATE OF CORRECTION

PATENT NO. : 4,864,350

DATED : September 5, 1989

INVENTOR(S) : Kuniaki ISHIGURO et al

It is certified that error appears in the above-identified patent and that said Letters Patent is hereby corrected as shown below:

24. A copying apparatus, comprising:

means for forming images on sheets;

means for sorting the sheets carrying the images formed thereon;

means for binding the sheets which have been sorted by said sorting means;

first means for detecting the absence of staples in the binding means;

UNITED STATES PATENT AND TRADEMARK OFFICE

CERTIFICATE OF CORRECTION

PATENT NO. : 4,864,350

DATED : September 5, 1989

INVENTOR(S) : Kuniaki ISHIGURO, et al

It is certified that error appears in the above-identified patent and that said Letters Patent is hereby corrected as shown below:

second means for detecting that the staples have been supplied to [the absence of staples in] the binding means; and control means capable of not only inhibiting the operation of the binding means depending on the result of the detection by the first detecting means but also cancelling the inhibition of the operation of the binding means depending on the result of the detection by the second detecting means.

Signed and Sealed this

Seventh Day of April, 1992

*Attest:*

HARRY F. MANBECK, JR.

*Attesting Officer*

*Commissioner of Patents and Trademarks*